US010798968B2

(12) United States Patent
Kurthy

(10) Patent No.: US 10,798,968 B2
(45) **Date of Patent: *Oct. 13, 2020**

(54) CIGAR AIRFLOW ADJUSTMENT INSTRUMENT

(71) Applicant: PERFEC CIGAR SOLUTIONS, INC., Irvine, CA (US)

(72) Inventor: Rodger Kurthy, Coto de Caza, CA (US)

(73) Assignee: Perfec Cigar Solutions, Inc., Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/556,845

(22) Filed: Aug. 30, 2019

(65) Prior Publication Data

US 2019/0380383 A1 Dec. 19, 2019

Related U.S. Application Data

(63) Continuation of application No. 16/376,952, filed on Apr. 5, 2019, now abandoned, which is a continuation of application No. 15/523,147, filed as application No. PCT/US2015/058480 on Oct. 30, 2015, now Pat. No. 10,292,422.

(60) Provisional application No. 62/072,828, filed on Oct. 30, 2014.

(51) Int. Cl.
*A24F 13/24* (2006.01)

(52) U.S. Cl.
CPC ..... *A24F 13/24* (2013.01)

(58) Field of Classification Search
None
See application file for complete search history.

(56) References Cited

U.S. PATENT DOCUMENTS

| | | | |
|---|---|---|---|
| 258,919 | A | 6/1882 | Hayden |
| 297,396 | A | 4/1884 | Hickisson et al. |
| 706,679 | A | 8/1902 | Mountford |
| 925,158 | A | 6/1909 | Cragg |

(Continued)

FOREIGN PATENT DOCUMENTS

| | | |
|---|---|---|
| EA | 200970988 | 4/2010 |
| RU | 2191528 | 10/2002 |
| SU | 69140 | 11/1946 |

OTHER PUBLICATIONS

European Search Report dated Jun. 11, 2018 in EP application No. EP 15855274.5 in 51 pages.

(Continued)

*Primary Examiner* — Michael H. Wilson
*Assistant Examiner* — Katherine A Will
(74) *Attorney, Agent, or Firm* — Knobbe Martens Olson and Bear, LLP

(57) ABSTRACT

According to some embodiments, systems and methods for altering the draw of a cigar are provided. The systems may include an elongate shaft with a working portion at the distal end. The working portion may have any of number of blades, corners, recesses, grooves, textures, and sharp points, among others. The methods may include assessing the draw of a cigar, inserting the working portion into the cigar, using the working portion to catch, cut, and pull and then remove tobacco from within the cigar, testing the draw of the cigar, and repeating the above steps until the draw is ideal.

22 Claims, 23 Drawing Sheets

(56) References Cited

U.S. PATENT DOCUMENTS

| | | | |
|---|---|---|---|
| 1,177,852 | A | 4/1916 | Flanders |
| 1,284,566 | A | 11/1918 | Benson |
| 1,345,736 | A | 7/1920 | Bailey |
| 1,376,335 | A | 4/1921 | Hentschel |
| 1,628,570 | A | 5/1927 | Anderson |
| 1,734,620 | A | 11/1929 | August |
| 2,007,632 | A | 7/1935 | Morris |
| 2,843,135 | A | 7/1958 | Lisiewski |
| 3,199,515 | A | 8/1965 | Lowe et al. |
| 4,733,674 | A | 3/1988 | Sielck et al. |
| 5,615,694 | A | 4/1997 | Battard et al. |
| 5,740,816 | A | 4/1998 | Ghazarian et al. |
| 6,055,991 | A | 5/2000 | Benjoseph et al. |
| 6,070,593 | A | 6/2000 | Chase |
| 8,015,979 | B2 | 9/2011 | Cooper |
| 10,292,422 | B2 | 5/2019 | Kurthy |
| 2003/0056800 | A1 | 3/2003 | Lin |
| 2005/0257797 | A1 | 11/2005 | Taylor |
| 2009/0222009 | A1* | 9/2009 | Ellis ..... B23B 51/02 606/80 |
| 2009/0314300 | A1 | 12/2009 | Cooper |
| 2010/0000553 | A1 | 1/2010 | Hodges |
| 2012/0266901 | A1 | 10/2012 | Powell et al. |
| 2019/0269172 | A1 | 9/2019 | Kurthy |

OTHER PUBLICATIONS

International Search Report and Written Opinion in PCT/US2015/058480 dated Feb. 11, 2016 in 7 pages.
Image of Havana Draw Enhancer dated Jun. 6, 2010 in 1 page.
Image of Havana Saver dated Sep. 29, 2012 in 1 page.

* cited by examiner

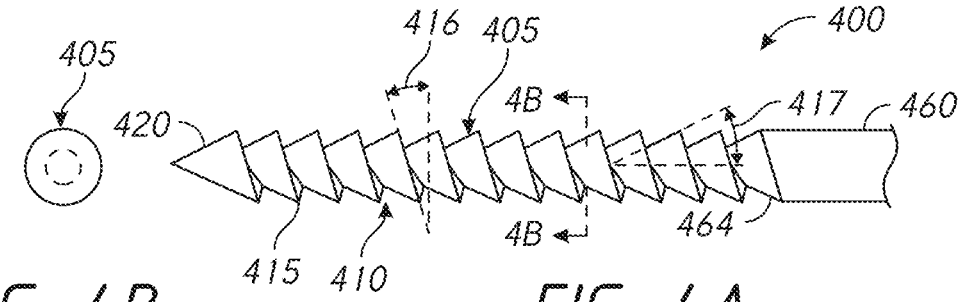
FIG. 4B FIG. 4A
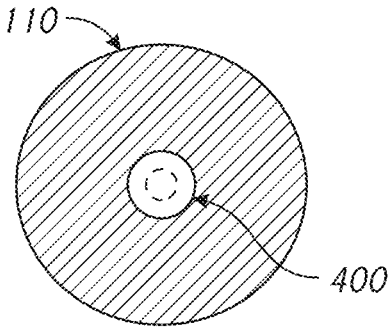
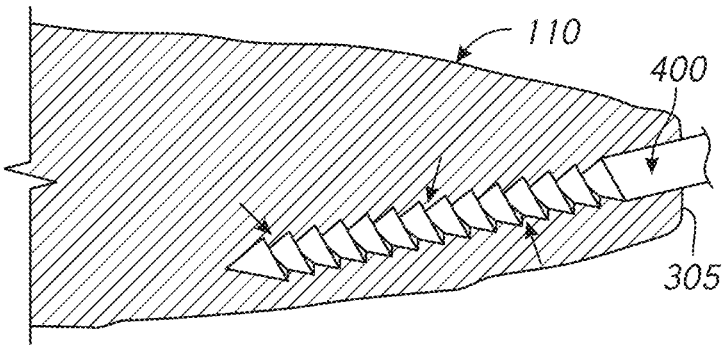
FIG. 4C FIG. 4D
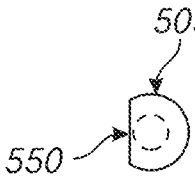
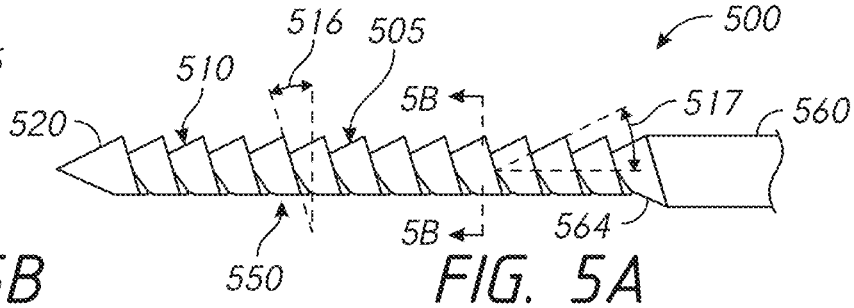
FIG. 5B FIG. 5A
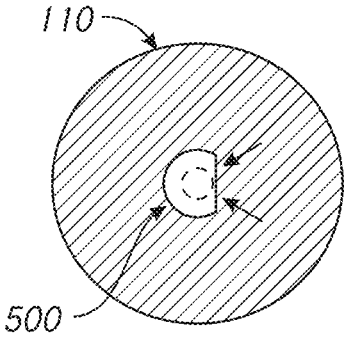
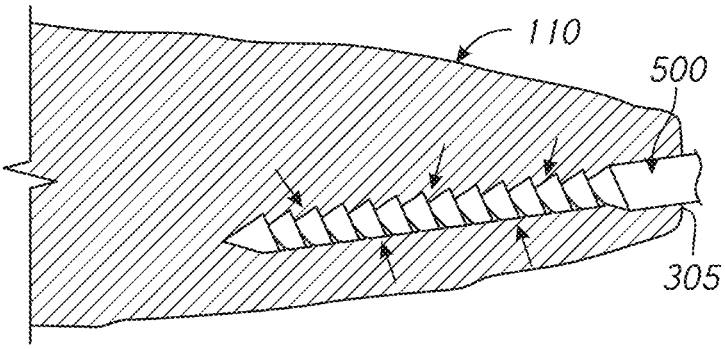
FIG. 5C FIG. 5D

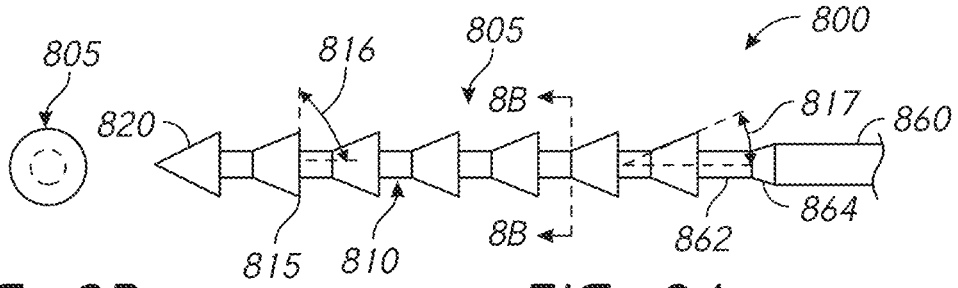
FIG. 8B FIG. 8A
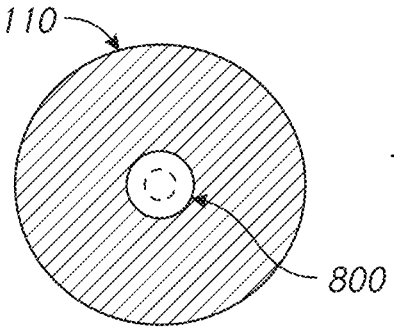
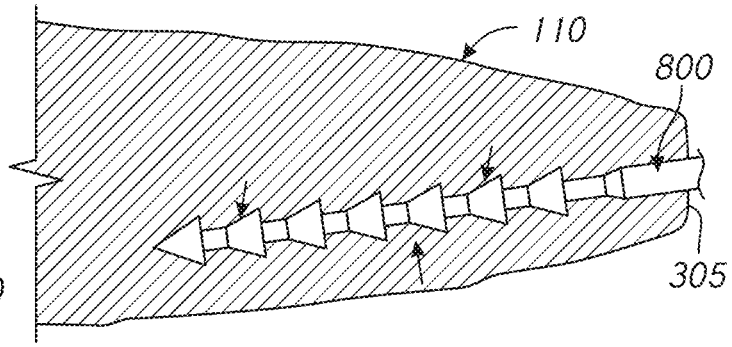
FIG. 8C FIG. 8D
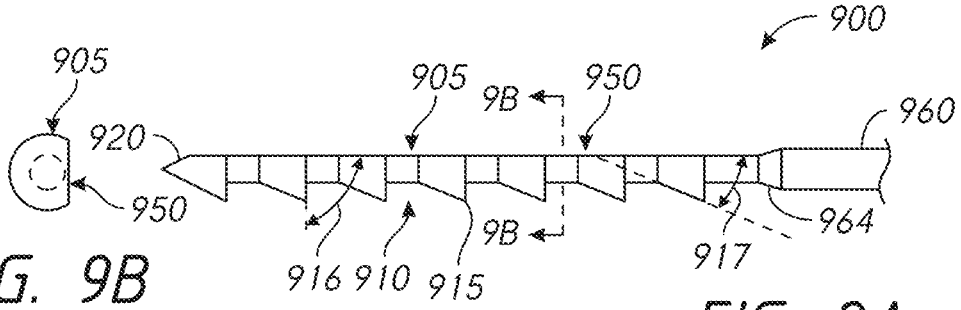
FIG. 9B FIG. 9A
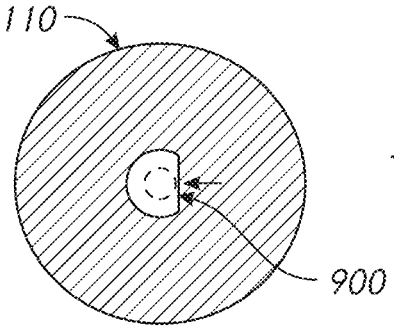
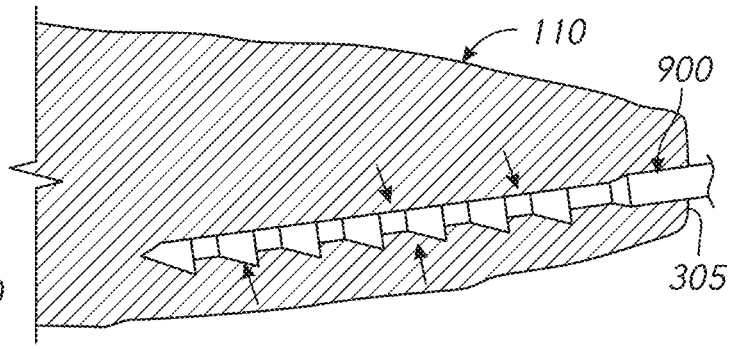
FIG. 9C FIG. 9D

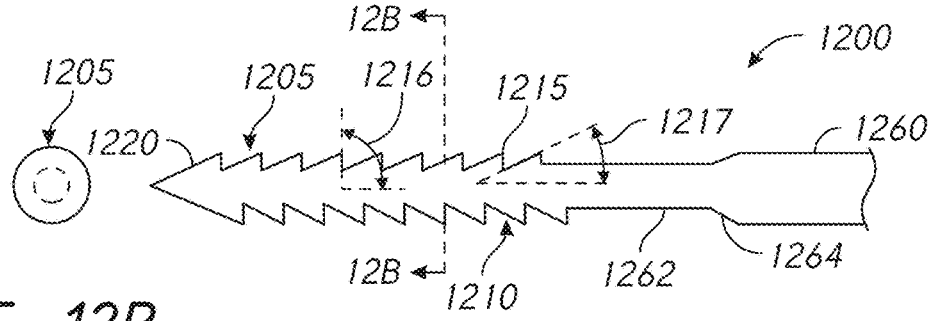
FIG. 12B
FIG. 12A
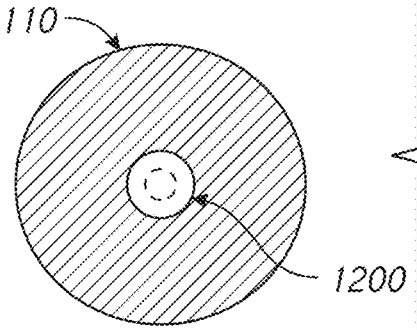
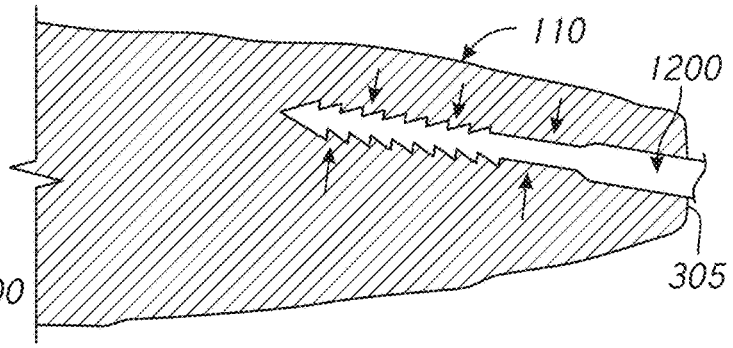
FIG. 12C
FIG. 12D
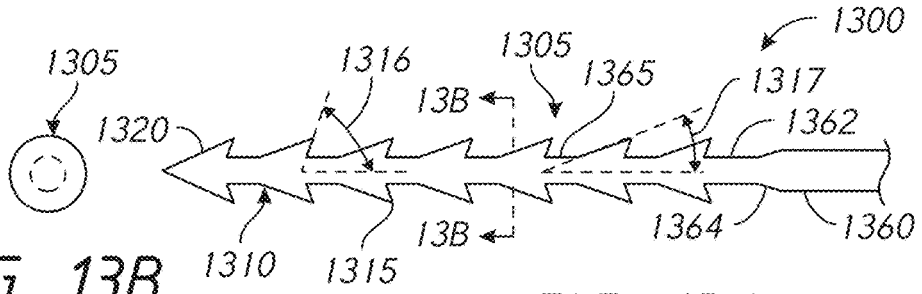
FIG. 13B
FIG. 13A
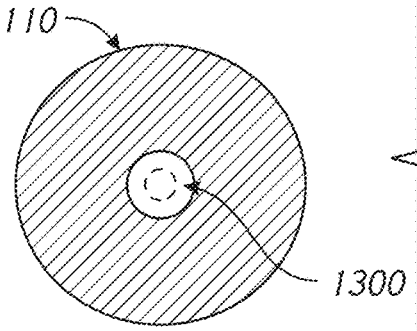
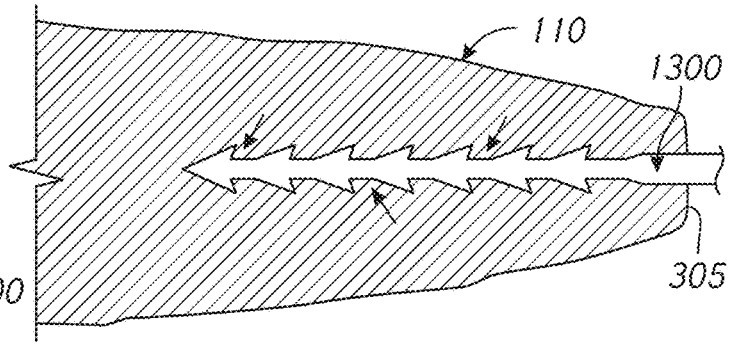
FIG. 13C
FIG. 13D

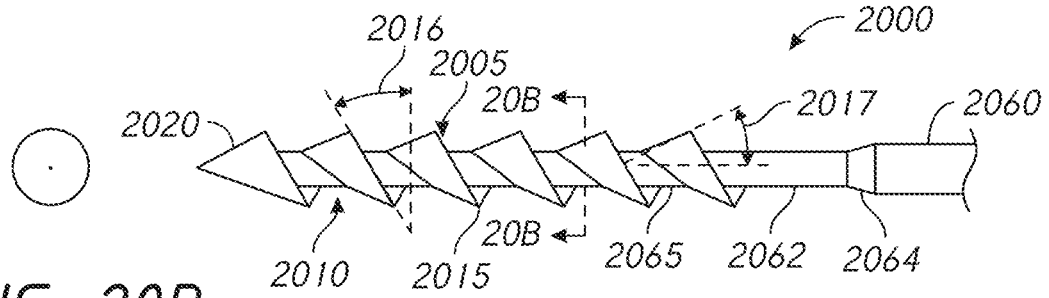
FIG. 20B
FIG. 20A
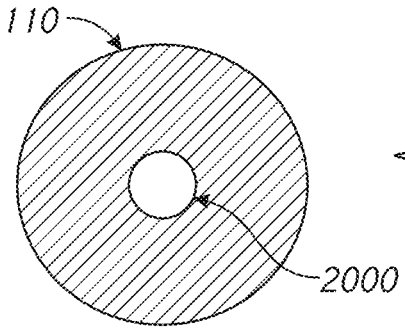
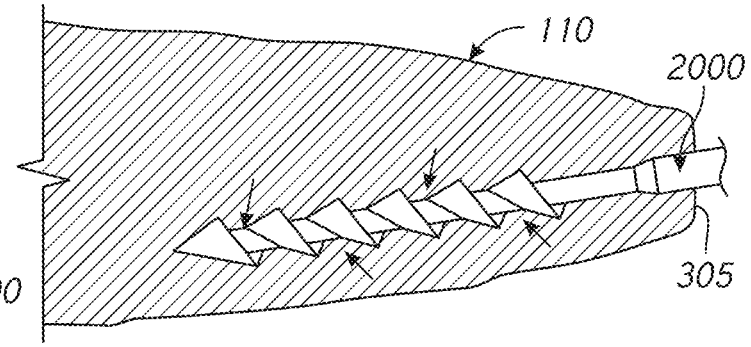
FIG. 20C
FIG. 20D
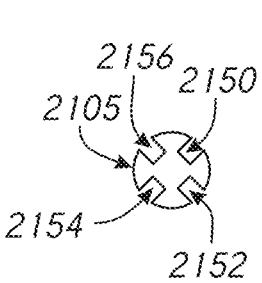
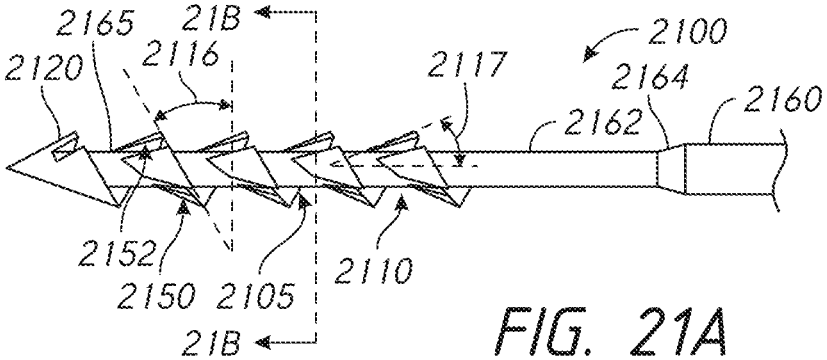
FIG. 21B
FIG. 21A
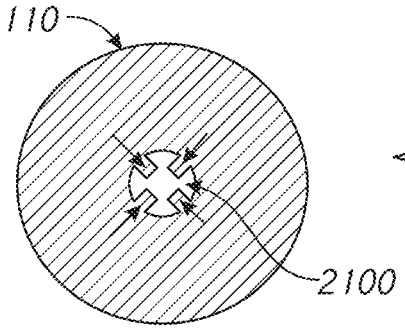
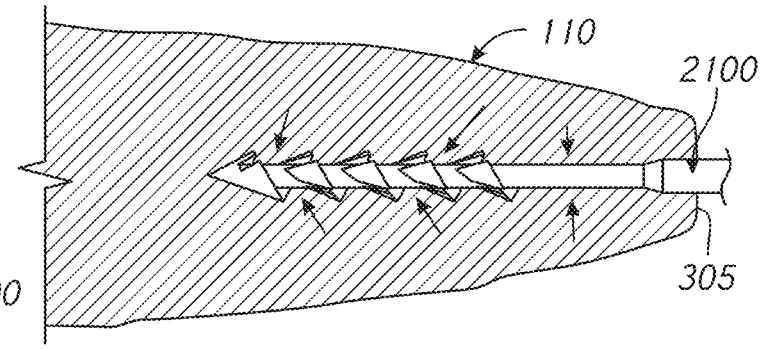
FIG. 21C
FIG. 21D

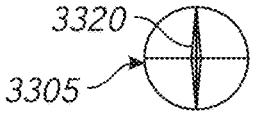
FIG. 33B
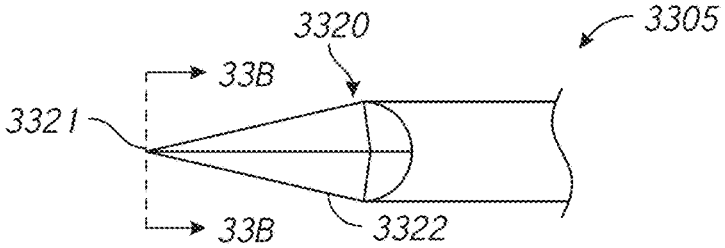
FIG. 33A
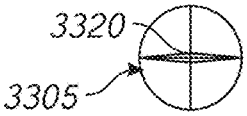
FIG. 33C
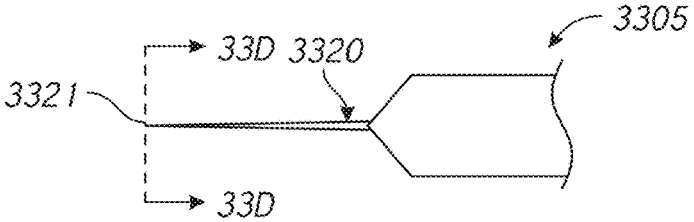
FIG. 33D
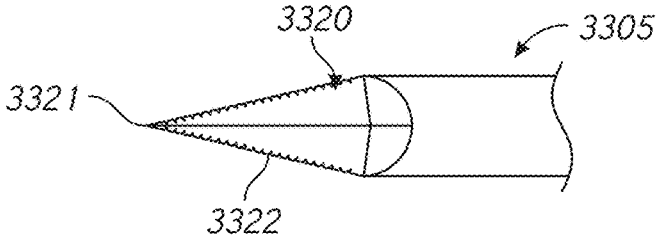
FIG. 33E
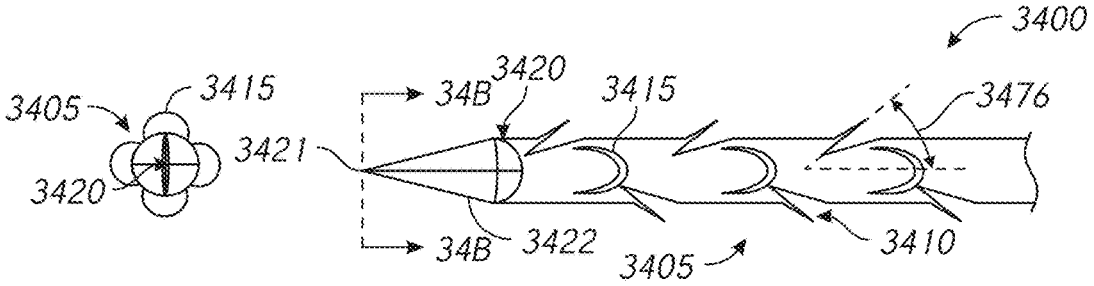
FIG. 34B
FIG. 34A
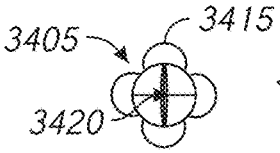
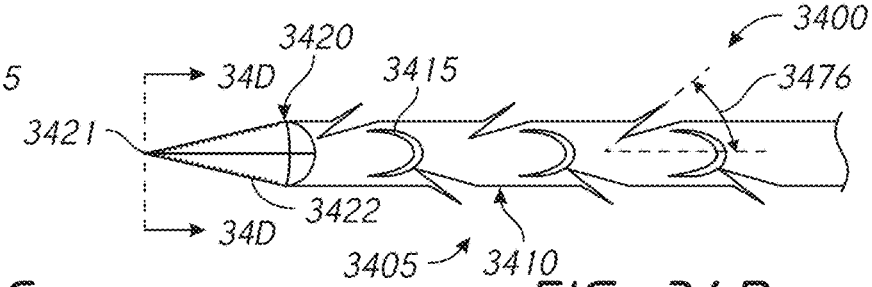
FIG. 34C
FIG. 34D

CIGAR AIRFLOW ADJUSTMENT INSTRUMENT

INCORPORATION BY REFERENCE TO ANY PRIORITY APPLICATIONS

This application is a continuing application of U.S. patent application Ser. No. 16/376,952, filed on Apr. 5, 2019, which is a continuing application of U.S. patent application Ser. No. 15/523,147, filed on Apr. 28, 2017, which is the national phase under 35 U.S.C. § 371 of PCT Int'l Appl. No. PCT/US2015/058480, which has an International filing date of Oct. 30, 2015, which claims the benefit of priority of U.S. Provisional Appl. No. 62/072,828, filed on Oct. 30, 2014. The disclosures of the aforementioned applications are hereby incorporated in their entirety herein by reference. Any and all applications for which a foreign or domestic priority claim is identified in the Application Data Sheet as filed with the present application are hereby incorporated by reference under 37 CFR 1.57.

BACKGROUND

Field of the Invention

Embodiments of the present invention relate generally to systems and methods for adjusting the airflow through a cigar, and more specifically, relate to systems and methods for improving the airflow through a cigar by removing at least some tobacco from within the cigar.

Description of the Related Art

Cigarette smokers typically smoke routinely, multiple times per day, and think little about the smoking experience. By contrast, cigar enthusiasts come in a broad spectrum ranging from the beginner enthusiast who may smoke a cigar only sporadically, to a cigar enthusiast who smokes every day. A beginner cigar enthusiast enjoys a cigar and is generally interested in the finer details of cigar enjoyment and smoking. However, he or she may not have the drive, ability, or funds to smoke cigars frequently. Nevertheless, when they do enjoy a cigar, they appreciate the finer techniques and sensory experiences involved in smoking a cigar. And, in between smoking their periodic cigar, a beginner cigar enthusiast may contemplate and look forward to their next cigar, whenever it may be. An advanced cigar enthusiast, of course, is generally well aware of the science and art behind cigar smoking. For example, he or she frequently has a very well stocked tool kit (sometimes having multiple of each tool), is knowledgeable about the source of the cigar and/or grower of the tobacco, and fully appreciates the ritual of cigar smoking. However, the average cigar smoker smokes only a few times per month.

Cigar enthusiasts typically look forward to smoking a cigar, most often with friends, as an event. For example, when planning their weekend round of golf with friends, the enthusiast may specifically look forward to the cigar they will enjoy while playing golf, and the cigar(s) they may enjoy over drinks after the game. In fact, many cigar enthusiasts appreciate the ritual of cigar smoking as much, if not more than the simple act of smoking a cigar. The ritual of cigar smoking is frequently a social event in which two or more individuals experience and explore their shared interest in cigars and the art and science behind a high quality cigar. The ritual is so social, in fact, that cigar smokers need not even know each other previously to experience a satisfying bonding time. The enthusiasts may discuss: the origins of their cigars, such as the soil qualities that produced the fine tobacco contained in their respective cigars or the country from which their cigars came; comparisons between cigars they have recently enjoyed; their favorite local, domestic, and foreign sources of cigars; their cigar care preferences, such as their home and/or travel humidor(s); and their unique cigar tools and kit.

The cigar enthusiast is not frequently found without his or her cigar kit. Most cigar kits include a cigar lighter or torch, a cigar cutter, and a small cigar case or pouch used to transport one or more cigars. The cigar kit is frequently a source of pride and individuality for the cigar enthusiast. In fact, the cigar enthusiast's cigar kit will frequently include more than one cigar lighter or torch and several cigar cutters, all of different designs and with different stories.

Prior to enjoying a cigar, the cigar enthusiast spreads out their tools in front of them. After organizing and arranging their tools, and sharing select stories behind each of them, the enthusiast removes one or more cigars from their case. Cigar enthusiasts usually critically evaluate their cigars throughout the cigar smoking ritual. In fact, evaluating the cigars' characteristics may be considered part of the ritual and important to fully enjoying the event. The cigar enthusiast may contemplate the flavor palate they desire and which cigar would consequently be the most satisfying at that time. Frequently, a group of cigar enthusiasts will discuss the positive desirable qualities and possibly the less desirable or negative qualities of each of their cigars, respectively. Each member of the experience will generally offer input on which cigar should be selected—the more the smoker enjoys his or her cigar, the better the group's experience will generally be, collectively. The individual smoker will feel his or her cigars, including the surface of the cigar: whether the cigar is smooth, rough, velvety, dry, oily, pliable, crackly, brittle, hard, lumpy, etc. He or she may then smell the cigar, both for enjoyment and to evaluate the quality of the cigar, and contribute to the selection process. He may look very carefully at the cigar. He may look for evenness of color of the cigar. They may look for the number and size of the veins in the cigar wrapper (the outer tobacco leaf that covers the surface of the cigar). The cigar enthusiast may feel the cigar for density, to see how tightly packed it may be. While each cigar enthusiast may undertake the tactile and olfactory evaluation of his or her cigars individually, the group may also help each other collectively in this process. Generally, the cigar smokers will admire the cigars and share their thoughts and impression on the subjective and objective qualities of each individual cigar. While cigar enthusiasts may carry several cigars with them at any point in time, it is frequently the case that the enthusiast will believe that only one of those cigars is perfect or right for any given situation or set of circumstances. The perfect cigar may not be right for a different situation or set of circumstances. For this reason, the selection process is critical. After the cigar enthusiast has selected the perfect cigar, they may prepare to cut the end of the cigar. Before the cigar enthusiast cuts the cigar, he or she may study the end of the cigar, deciding exactly where to cut off the tip of the cigar.

The cut is one of the most important steps in preparing the cigar because: first, it is undesirable to make many small, "shaving" cuts; and second, any cut into the cigar is permanent. The enthusiast will generally select the proper cigar cutter for the individual application. He or she may consider which cutter has the proper diameter to accommodate the cigar chosen and which cutter has a set of blades sharp enough to make a satisfactory cut. Then, the cigar is carefully examined, particularly the head of the cigar. The enthusiast will, almost always, carefully evaluate the increasing diameter of the head of the cigar to determine the most pleasing location for the cut—that is the portion of the cigar that is placed in the smoker's mouth. The cut portion is the part of the cigar that is most intimately connected with the enthusiast throughout the entire smoking process. Therefore, the desirability of the cut is of paramount importance to the enthusiast. Once the cigar enthusiast's study of the cigar's head is complete and the perfect location for the cut determined, the enthusiast decisively makes a precise cut through the head of the cigar. Following the cut, the cigar enthusiast may observe and evaluate the accuracy and smoothness of the cut. If the enthusiast is displeased with the cut, he or she may carefully "correct" the cut with a second cut. After the cut is made, the lighting process is begun.

Lighting the cigar has several steps, the first of which is toasting. To toast the cigar, the enthusiast holds the cigar in such a manner to have the foot of the cigar, which is the end to which the flame will be applied, somewhat facing him. He may intently study the foot of the cigar as he runs a flame over the end of the cigar—round and round and round. Frequently, a flame from a wooden match or a butane lighter is used for the toasting process. Many cigar enthusiasts have found that a deliberate, slow toasting on the foot of the cigar can get the ash going well at the start of the smoking experience. Consequently, a toasted cigar may have a better chance of burning evenly all the way through. The intent and purpose behind toasting is to set fire to all parts of the cigar (not just the tobacco filler), including the binder, wrapper, and filler. In the absence of toasting it is common to only ignite one part of the foot of the cigar, thereby causing an uneven burn. Toasting is properly accomplished by holding a cigar at an angle (e.g., 45-60 degrees) over a flame. The flame may or may not touch the tobacco at the foot. Many cigar smokers rotate the cigar until the foot begins to glow uniformly. Care may be taken not to overheat the cigar because the more a cigar is heated, the more tars form within the cigar. Once the enthusiast believes the foot of the cigar has been evenly toasted, the cigar may be lit with the flame. This is accomplished by placing the head of the cigar in their mouth and drawing air through the cigar while holding the flame to the foot of the cigar. The flame may be continually rotated around the surface of the foot of the cigar, or alternatively, the flame may be held in one steady position while the cigar smoker rotates the cigar while sucking air through the cigar. The intent is to create a uniform glowing red of the end of the cigar, commonly known as an "even burn." Once the enthusiast believes the foot of the cigar has an even burning ember, he will generally remove the cigar from his mouth, turn the cigar around, and gently blog on the burning foot of the cigar. Blowing air onto the foot of the cigar will cause the ember of the cigar to glow with a red burn confirming the foot of the cigar is evenly and thoroughly lit. This is commonly referred to as a "good burn."

If the cigar enthusiast does not see that the glowing red covers the entire foot of the cigar, he or she may again use/apply the flame while drawing air through the cigar, and then re-check the foot of the cigar for an even burn. Then each enthusiast tastes the smoke of his or her cigar. Then, the cigar enthusiasts will take a fresh, enjoyable draw on their cigars. The cigar is then ready for continued smoking.

Performing one or more of the above-listed steps prior to smoking a cigar may be part of the desired ritual and enjoyment for the cigar enthusiast. And, precision in any steps performed is important to the cigar enthusiast's enjoyment.

SUMMARY

In accordance with one embodiment, an instrument for adjusting the draw of a cigar is provided. The instrument for adjusting the draw of a cigar comprises a shaft, a neck, and a working portion. The neck is attached to the distal end of the shaft. The working portion is attached to the distal end of the neck. Finally, the working portion is configured to be inserted into a cigar after the cigar has been made and catch, pull, and cut tobacco within the cigar.

In accordance with another embodiment, a tool for removing tobacco from within a cigar is provided. The tool for removing tobacco from within a cigar comprises a handle, an elongate shaft, and a tobacco removing portion. The elongate shaft is connected to the handle. And, the tobacco removing portion is configured to remove a substantial amount of tobacco from within a cigar after the cigar has been made.

In accordance with another embodiment, a method for altering the draw of a cigar is provided. The method of altering the draw of a cigar comprises inserting a cigar airflow adjustment instrument into a cigar, using the cigar airflow adjustment instrument inside the cigar, and removing tobacco from within the cigar. The cigar airflow adjustment instrument comprises an elongate shaft and a working portion, the working portion configured to be inserted into a cigar after the cigar has been made and catch, pull, and cut tobacco within the cigar. The using step comprises moving the working portion within the cigar in at least one of a pushing, pulling, and rotating action. Finally, the using step effects at least one of tobacco dislodgement and tobacco repositioning.

In accordance with another embodiment, a method for altering the draw of a cigar is provided. The method for altering the draw of a cigar comprises inserting a cigar airflow adjustment instrument into a cigar, moving the tobacco remoting portion within the cigar in one or more of a pushing, pulling, and rotating action, and removing a substantial amount of tobacco from within the cigar. The cigar airflow adjustment instrument comprises an elongate shaft and a tobacco removing portion configured to remove a substantial amount of tobacco from within a cigar after the cigar has been made. The moving step described above effects at least one of tobacco dislodgement, tobacco cutting, and tobacco repositioning.

BRIEF DESCRIPTION OF THE DRAWINGS

FIG. 1A is a standard pyramid cigar while FIG. 1B is a perfecto cigar.

FIGS. 4A-4D are various views of an embodiment of a cigar airflow adjustment instrument.

FIGS. 5A-5D are various views of another embodiment of a cigar airflow adjustment instrument.

FIGS. 8A-8D are various views of another embodiment of a cigar airflow adjustment instrument.

FIGS. 9A-9D are various views of another embodiment of a cigar airflow adjustment instrument.

FIGS. 12A-12D are various views of another embodiment of a cigar airflow adjustment instrument.

FIGS. 13A-13D are various views of another embodiment of a cigar airflow adjustment instrument.

FIGS. 20A-20D are various views of another embodiment of a cigar airflow adjustment instrument.

FIGS. 21A-21D are various views of another embodiment of a cigar airflow adjustment instrument.

FIGS. 33A-33E are various views of the tip of another embodiment of a cigar airflow adjustment instrument.

FIGS. 34A-34D are various views of another embodiment of a cigar airflow adjustment instrument.

DETAILED DESCRIPTION

Figure 1A:
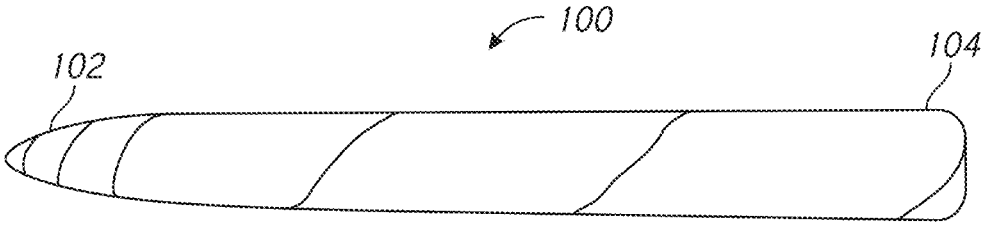
FIGS. 1A-1B are side views of various types of cigars.

The cigar enthusiast expends considerable time, effort, and expense in preparing his or her cigar prior to smoking it. Of course, the cigar enthusiast purchases the cigars he or she intends to smoke and any tools that may be necessary. Furthermore, he or she: prepares the tool kit, generally, carefully laying out each tool so that all options may be surveyed; selects the right tools for the occasion (e.g., which cigar lighter or match will suit the cigar and the occasion the best); removes one or more cigars from a cigar carrying case or humidor; experiences the cigars with other cigar enthusiasts; selects the perfect cigar for the occasion; examines and studies the cigar, observing the textures, shapes, dryness, flexibility, brittleness, and many other characteristics; selects the perfect location for a cut on the head of the cigar through which the cigar enthusiast will draw smoke once the cigar is lit; cuts the cigar with care, decision, and precision; performs a cold draw of the cigar; toasts the cigar; and ultimately lights the cigar. Of course, each cigar enthusiast engages in his or her own unique steps of the above ritual. However, each ritual is characterized by care, so that the best smoking experience is achieved for each enthusiast.

While the preparation process is critical, it is merely setting the stage for the ultimate smoking event. Each step is taken so that each draw on the cigar is as enjoyable as possible. The first draw the cigar enthusiast takes identifies for him or her the quality of the draw—the ideal, or perfect draw, is one that is uniform and even, pulling smoke evenly through the entire body of the cigar without excessive effort (suction produced by the cigar enthusiast's mouth). The draw, in simple terms, is how hard/strongly the cigar enthusiast needs to puff on the cigar to draw in the desired amount of air and/or smoke from the cigar. The cigar enthusiast generally considers an ideal or perfect draw, after his or her extensive preparation (possibly before the cigar has been lit with the cold draw, but certainly afterwards), to be one of the most satisfying experiences or parts of the cigar smoking ritual. However, while the cigar enthusiast may control many factors, such as the evenness of the burn, the identity of the cigar, or the tools used, a cigar's draw has been generally difficult if not impossible for the cigar enthusiast to improve: if it is a poor draw, the cigar enthusiast has in the past been helpless to alter its condition.

Any given cigar's draw is determined during the rolling process—by the individual artisan preparing and hand-rolling the cigar. If the cigar is rolled too loosely, there is little to no noticeable restriction on the air and smoke mixture travelling through the cigar during the cigar enthusiast's puff: air and smoke rushes through the cigar as if it was empty. Such a "loose" draw is generally disappointing and leaves the cigar enthusiast dissatisfied. By contrast, if the artisan rolled the cigar too tightly, there may be a mild to serious restriction on the air and smoke mixture travelling through the cigar during the cigar enthusiast's puff, sometimes called a "snug" or a "tight" draw. Encountering a cigar with a draw that is tighter than the individual cigar enthusiast's ideal draw is common and frequently results in diminished enjoyment on the part of the enthusiast. Occasionally, a cigar may be so tightly packed that the cigar enthusiast can barely draw any air into the cigar. Such "snug" or "tight" draws are commonly referred to as a "plugged cigar" and are generally highly disappointing to the enthusiast and often result in a cigar that is un-smokable.

Such cigars are frequently discarded. A snug draw is caused by too much tobacco having been packed inside the cigar wrapper. Such excess of tobacco may be packed inside the cigar's wrapper either in specific localized areas of a cigar, or generally throughout the entire length of a cigar. Regardless, such tightly packed cigars frequently require an undesirably high amount of negative pressure to suck air through the cigar. Additionally, some cigars are not uniformly packed throughout the entirety of the cigar (some being more or less uniform). When the tobacco filled is not packed uniformly, smoking of the cigar may start with an even burn, but may become uneven during the smoking process, when a denser area of the cigar is reached. In such cases, the denser area may burn slower than the looser areas around it, causing the cigar to burn faster on one side than the other. When the burn becomes uneven, many cigar enthusiasts will use a flame to touch up their cigars by flaming the part of the cigar that is not burning well, in an attempt to even the burn. Unfortunately, the draw of a cigar is very difficult, if not impossible, to determine prior to cutting, let alone prior to purchase. Consequently, a suboptimal draw (either loose or snug) is a periodic fact of life for most cigar enthusiasts. The cigar's draw is of sufficient importance, that some enthusiasts may store their cigars in suboptimal conditions to help improve the draw. For example, the class humidity to store and smoke cigars is 70% humidity. That being said, the moister the tobacco is, the more it swells. And swollen tobacco takes up more space, thereby potentially creating a tighter draw. Therefore, some cigar enthusiasts, in an attempt to overcome the common snug draw issue, may keep their cigars at lower humidities (e.g., only 62-65%). In lower humidities, the cigars may experience less swelling of the tobacco filler and therefore less tightness.

The cigar enthusiast unfortunate enough to acquire a cigar having a loose draw will likely either discard the cigar, or smoke it dissatisfied. The lack of restriction on airflow in a loose draw cigar allows very rapid and hot burning. Therefore, such a cigar will create more tars and will likely be finished well before other enthusiasts finish their cigars. Both of these results are very undesirable. However, a loose draw is caused by insufficient tobacco being contained in a loose fashion within the cigar, and tobacco can never be added or tightened by the cigar enthusiast. Consequently, it is generally accepted that there is little or nothing that can be done to help or fix a loose draw.

Again, by contrast to a loose draw, a snug draw is caused by too much tobacco being contained in a tightly packed fashion within the cigar. Such cigars are very common. Various solutions to break up the tobacco and decrease airflow resistance (and thereby improve draw) have been suggested or offered, but none of them truly work. Many of these solutions are ice pick-shaped tools that may be used to poke a hole down the long axis of the cigar with the intent of creating a path by which air may flow through the cigar. Unfortunately, such tools frequently do not improve the draw whatsoever. Instead, they merely spread the already over-packed cigar and break the wrapper, thereby destroying the cigar. Even if the wrapper is not broken, the hole merely closes. Such tools do not generally improve the draw of the cigar in any meaningful fashion.

Even beyond the issue/possibility of chronically improper draw, such as the loose or snug draws discussed above, every cigar enthusiast has his or her own ideal level of draw. Each cigar enthusiast has different facial structure, mouth size, and lung volume, among many other characteristics. Consequently each cigar enthusiast is most comfortable creating a different amount of negative pressure on the head of the cigar during smoking. That is to say, each cigar enthusiast prefers his or her own level of suction during smoking (i.e., the ideal amount of resistance to airflow is different for each individual enthusiast). And, for a cigar enthusiast, having the desired or ideal amount of resistance to air flow enhances the cigar smoking experience compared to achieving only an acceptable resistance. However, historically, changing the draw of any given cigar to match the cigar enthusiast's own best preferences has not been a possibility. The cigar enthusiast has been bound by chance—the cigar he or she purchased may be too tight, too loose, just acceptable, or it could be perfect. Most frequently, when the cigar enthusiast tries the first puff after cutting his or her cigar, he discovers that the draw is merely acceptable—the cigar may be smoked, but the draw is slightly too tight. In this case, the cigar enthusiast generally wishes the draw were more suited to his or her tastes, but will smoke it anyway. As mentioned above, there has not been any solution for fixing a snug draw (i.e., making an unacceptably tight cigar acceptable). Moreover, there has not been any solution for slightly improving a draw (i.e., making an acceptable draw ideal or "perfect").

Figure 1B:
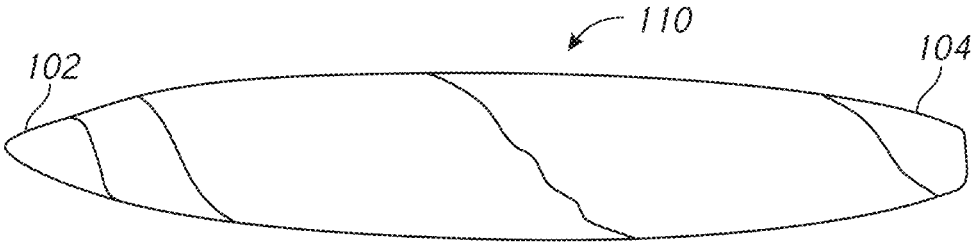

Another consideration that may affect the enjoyment of the cigar enthusiast is the type of cigar being smoked. Cigars may be manufactured in various diameters, lengths and shapes. FIGS. 1A-1B illustrate two different types of cigars: FIG. 1A is generally referred to as a "torpedo," "belicoso," or "pyramid" cigar. The torpedo cigar 100 has an elongate body defined by a tapered head 102 on one end, and a foot 104 on the other. The torpedo cigar 100 generally increases in diameter all the way from the tip of the head 102 to the end of the foot 104. FIG. 1B is generally referred to as a "perfecto" or "figurado" cigar. The perfecto cigar 110 also has an elongate body defined by a tapered head 102 on one end and a foot 104 on the other end. By contrast to the torpedo cigar 100, the perfecto cigar 110 has a sharper taper in the head 102 and frequently decreases in diameter at the foot 104 as well. The perfecto cigar 110 comes to a sharp or blunt tapered tip at the head 102

Many cigar enthusiasts enjoy a perfecto cigar 110 because the perfecto cigar's 110 shape allows the smoker to cut a relatively small portion off the head 102 of the cigar to have a pleasantly tapered shape that may feel more comfortable in the mouth. However, a common shortcoming of the perfecto cigar 110 is that the tobacco in the tapered head is often tightly compressed during manufacture, by hand or machine, thereby increasing resistance to airflow through the tightly packed tobacco in the tapered head 102 of the cigar. In fact, when premium cigars are hand-rolled, tobacco is forced into the head 102 of the cigar to seal the cigar. This forcing and sealing process, particularly in a perfecto cigar 110 often results in the head 102 being the most tightly packed area of the cigar, leaving clumps of tightly packed tobacco which may impede, restrict, or block the draw of the cigar.

Figure 2A:
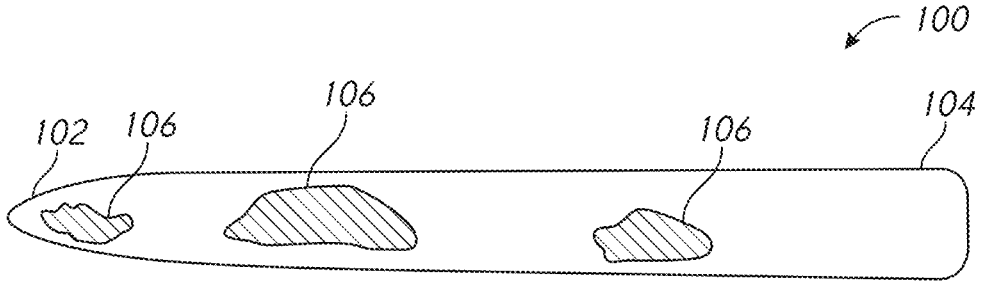
FIGS. 2A-2B are cross-sectional views of the cigars of FIGS. 1A-1B showing regions of localized densely packed tobacco filler.
Figure 2B:
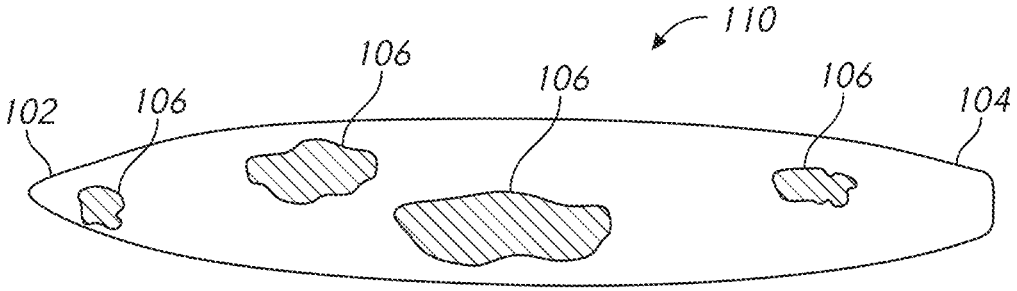

FIGS. 2A-2B are example cross sectional view of the torpedo cigar 100 of FIG. 1A and the perfecto cigar 110 of FIG. 1B, respectively. FIGS. 2A-2B illustrate the shape of the cigars, defined on one end by the sharply tapered head 102 and on the other end by the foot 104. Inside each of torpedo cigar 100 and perfecto cigar 110 are multiple areas of localized densely packed filler 106. As discussed above, a cigar with a snug or tight draw may be uniformly over-packed with tobacco filler, or it may have areas of localized densely packed filler 106, as shown in FIGS. 2A-2B, or it may be both generally over-packed with tobacco filler and have areas of localized densely packed filler 106. Regardless of the type of cigar being smoked, whether it is a torpedo cigar 100 or a perfecto cigar 110, for example, certain problems may be encountered during the cutting process.

As mentioned above, the first cut is planned and made on a predominantly visual basis. The cigar enthusiast visually judges the diameter of the cigar and potential mouth feel. Then, the cigar enthusiast makes his or her cut based on that visual judgment. Frequently, immediately thereafter, the cigar enthusiast will draw air through the cigar, even before lighting the cigar (this is sometimes called the "cold draw"). Some enthusiasts draw air through the unlit cigar merely to savor the flavor of the cigar (i.e., taste the cold tobacco). However, many cigar enthusiasts engage in this process as a test of the cigar's draw and the cut's mouth feel—they draw air through to check the resistance to airflow through the cigar (the amount of negative pressure necessary to suck air through the body of the cigar, from the foot 104 to the head 102). When the cigar enthusiast experiences a high amount of resistance to air flow through the cigar, he or she may cut off more of the cigar in an attempt to get deeper into the cigar where the tobacco may not be as tightly packed. Sometimes, the additional cut may be relatively small, (e.g., even just a millimeter or two). However, an additional cut is frequently disappointing for the cigar enthusiast because the he or she is forced to settle for a different cut than originally desired. Furthermore, an additional cut of even a millimeter or two may result in the cigar wrapper tobacco leaf starting to unravel. Making an additional cut higher up the body of the cigar is, therefore, not desirable. While any cigar may experience tightness in the head 102, perfecto cigars 110 may exhibit particularly pronounced problems.

As mentioned above, many cigar enthusiasts enjoy the perfecto cigar 110 because the perfecto cigar's 110 shape allows the smoker to cut a relatively small portion off the head 102 of the cigar to have a pleasantly tapered shape that may feel more comfortable in the mouth. When the enthusiast cuts the tip off, he or she will intentionally cut off only the tip of the head 102, not the entire taper. However, when a cigar enthusiast cuts the tapered head 102 off of a perfecto cigar 110, a common result is an unacceptably tight airflow because of the tightly packed tobacco in the tapered head 102. To address the tight airflow, the cigar enthusiast may cut more off the tapered head 102 to achieve an "acceptable airflow." Cutting off more of the tapered head 102 may result in a less desired feel of the tapered head in the mouth. Therefore, the cigar enthusiast preparing a perfecto cigar 110 has been presented with two generally undesirable options: 1) cut off exactly the amount of the tapered head 102 that creates the proper mouth feel, and experience an uncomfortably snug or tight draw through the perfecto cigar 110 during the entire smoking experience (i.e., have to puff hard to draw any smoke through the perfecto cigar 110); or 2) cut off more of the tapered head 102 than originally desired, thereby destroying the perfecto cigar's 110 pleasant mouth feel, in an attempt to achieve an acceptable (but rarely ideal) draw through the body of the perfecto cigar 110 (and, not unimportantly, experience the frustration of being required to cut off more of the head 102 than was desired). Ultimately, it is not uncommon for a cigar enthusiast to cut off most of, if not the entire tapered head 102 to improve airflow through a perfecto cigar 110, thereby nullifying the benefit of starting with a tapered head 102 of the perfecto cigar 110.

In view of the above, it can be seen that devices, systems, and methods for improving the draw of a cigar would therefore be highly advantageous and desirable to improve the cigar smoking experience. Devices, systems, and methods in accordance with the present invention allow a user to adjust the draw of a cigar. Some embodiments disclosed herein permit gross adjustment of a cigar's draw—these embodiments allow the user to adjust the draw of a cigar from entirely unacceptable (e.g., significant negative pressure required to draw smoke through the cigar or entirely stopped) to acceptable. Other embodiments disclosed herein permit fine adjustment of a cigar's draw—these embodiments allow the user to adjust the draw of a cigar from acceptable (e.g., slightly snug and more negative pressure required that is ideal for the individual user) to ideal (i.e., what the individual user desires). Finally, other embodiments disclosed herein permit both gross adjustment and fine adjustment of a cigar's draw—these embodiments allow the user to adjust the draw of a cigar from entirely unacceptable to ideal. At least one embodiment disclosed herein allows a user to generally decrease the resistance to airflow in a cigar with an undesirably high resistance to airflow. Decreasing the resistance to airflow may improve enjoyment of the cigar smoking event/experience. In some embodiments, an instrument as disclosed herein may be used to create a hole through areas of airflow obstruction by removing tobacco from inside the cigar.

Figure 3:
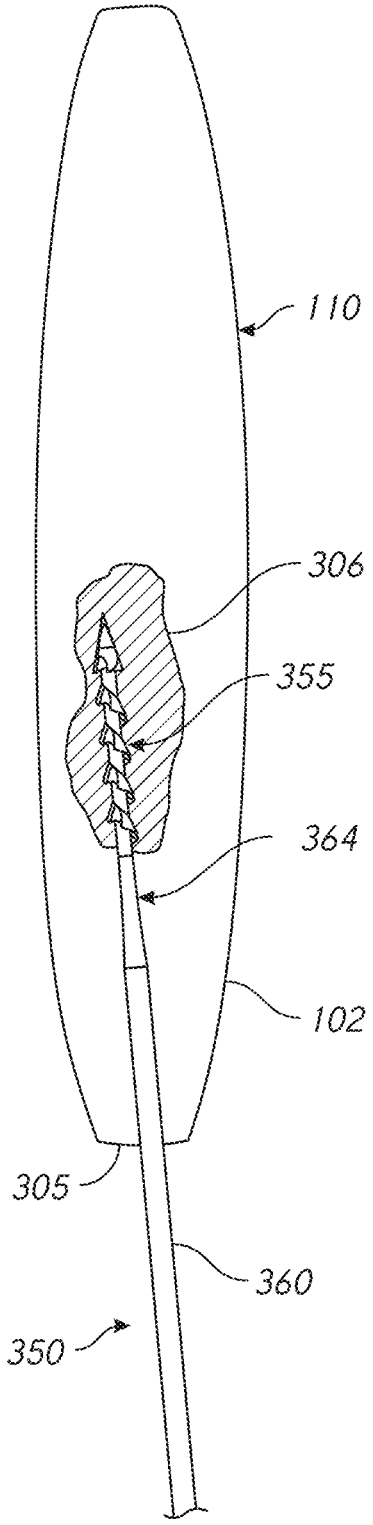
FIG. 3 is a view of an airflow adjustment instrument inserted into a cross-sectional view of a cigar, such as that shown in FIG. 1B, having a region of localized densely packed filler.

FIG. 3 illustrates a cigar airflow adjustment instrument 350 inserted into a perfecto cigar 110 (shown in cross-section, similarly to FIG. 2A-2B) and being used to adjust the airflow of the perfecto cigar 110. Note that the cigar airflow adjustment instrument 350 may be used in any type of cigar—the perfecto cigar 110 is shown for illustration purposes only. The cigar airflow adjustment instrument 350 generally includes a working portion 355 and a shaft 360. The working portion 355 generally has some type of blade, corner, or sharpened portion. The working portion 355 shown in FIG. 3 includes counter-clockwise spiral blade with scalloped cut-outs. In some embodiments, the working portion 355 may be attached to the shaft 360 by a neck 364, such as a tapered neck as shown in FIG. 3.

Some embodiments of the cigar airflow adjustment instrument 350 allow a user to remove an amount of the tobacco filler contained within a cigar, such as the localized densely packed filler 306. The user may remove as much or as little tobacco as necessary to adjust the cigar's draw to ideal for that particular user. Certain embodiments are particularly useful for use on perfecto cigars, such as the perfecto cigar 110 of FIG. 1B. As discussed above, perfecto cigars frequently have an unacceptably tight airflow because of the tightly packed tobacco in the tapered head 102. To address that unacceptably tight airflow the user generally either: 1) cuts off exactly the amount of the head that is desired (thereafter experiencing an uncomfortably snug or tight draw); or 2) cuts off more of the tapered head 102 than originally desired (thereby destroying the perfecto cigar's shape and pleasant mouth feel). Using a cigar airflow adjustment instrument 350 as disclosed herein may allow the user to adjust the draw of the perfecto cigar by selectively removing tobacco from only the localized densely packed filler 306. Thereby, the user may both achieve an ideal draw while saving the entirety of the perfecto cigar's pleasant tapered tip—a result that was previously not possible.

Some embodiments of the cigar airflow adjustment instrument 350 include a working portion on the distal end of the shaft 360. The cigar airflow adjustment instrument 350 may be shaped like a rod with a diameter in the range of about 1.4-9.8 mm, about 1.6-9.0 mm, about 1.8-8.2 mm, about 2.0-7.4 mm, about 2.2-6.6 mm, about 2.4-5.8 mm, about 2.6-5.0 mm, about 2.8-4.2 mm, and about 3.0-3.4 mm, or any other diameter that facilitates functioning of the systems disclosed herein. The working portion 355 of the cigar airflow adjustment instrument 350 may include one or more blades or protrusions configured to do one or more of cut tobacco in a cigar, pull on tobacco in a cigar, and/or remove tobacco from a cigar. As just mentioned above, the working portion 355 shown in FIG. 3 includes a pointed head, a conical blade wrapped around the rod, and longitudinal scallops in the blade and pointed head. The working portion 355 may be fabricated out of metals, metal alloys, plastics, composite materials, or any other materials capable of the necessary rigidity and maintenance of sharpness of the working portion 355, for example, materials such as any type of steel, titanium, sterling silver, bronze, gold alloys, hard polymers, plastics, carbon, etc.

In some embodiments, the shaft 360 of the cigar airflow adjustment instrument 350 may be shaped like a rod with a diameter in the range of about 1.4-9.8 mm, about 1.8-8.2 mm, about 2.2-6.6 mm, about 2.6-5.0 mm, and about 3.0-3.4 mm, or any other diameter that facilitates functioning of the systems disclosed herein. In some embodiments, the shaft 360 may have a length in the range of about 3-20 cm, about 5-17 cm, about 7-14 cm, and about 9-11 cm, or any other length that facilitates functioning of the systems disclosed herein. In some embodiments, it is desirable that the shaft 360 have a length sufficient to extend through approximately half of a given cigar (i.e., from the head 102 to approximately the mid-point of the cigar and from the foot 104 to approximately the midpoint of the cigar). Thereby, the cigar airflow adjustment instrument 350 would be able to reach any point in the cigar. In other embodiments, it is desirable that the shaft 360 have a length sufficient to extend (through approximately the entirety of a given cigar (i.e., all the way from the head 102 of the cigar to the foot 104 of the cigar, or vise versa). Embodiments of the cigar airflow adjustment instrument 350 capable of extending through approximately the entirety of a cigar may be preferable to those that can extend through only half the length of a cigar because such long embodiments of the cigar airflow adjustment instrument 350 may advantageously be able to adjust the draw of the cigar through the head 102 of the cigar even while the cigar is lit (it would be undesirable to insert a cigar airflow adjustment instrument 350 through a foot 104 of a lit cigar as doing so may damage the cigar airflow adjustment instrument 350, damage the cigar, or cause painful burns to the user). In some embodiments, the shaft 360 of the cigar airflow adjustment instrument 350 is fabricated out of the same material as the working portion 355 of the device. In other embodiments, the shaft 360 of the cigar airflow adjustment instrument 350 is fabricated out of another material, different from the material of the working portion 355. In some embodiments, the shaft 360 is fabricated out of metals, metal alloys, plastics, or composite materials (e.g., any type of steel, titanium, sterling silver, bronze, gold alloys, hard polymers, plastics, carbon, etc.). In other embodiments, the shaft 360 is made out of any other material having the necessary rigidity to force the working portion 355 through the filler tobacco of the cigar 110 to reach the localized densely packed filler 306, and to use the working portion 355 at the localized densely packed filler 306 (as will be discussed in more detail below).

In some embodiments, the shaft 360 is straight or substantially straight. In other embodiments, the shaft 360 may incorporate a curve or a curved portion. In still other embodiments, the shaft 360 may incorporate an angle or an angled portion. Such curved portion or angled portion of the shaft 360 may facilitate improved access to certain areas of the cigar 110 by the working portion 355 of the cigar airflow adjustment instrument 350.

Some embodiments of the cigar airflow adjustment instrument 350 have a neck 364 that connects the working portion 355 to the shaft 360. In some embodiments, as shown in FIG. 3, the rod of the working portion 355 has a smaller diameter than the rod of the shaft 360. In such cases, the neck 364 has a tapered profile, connecting the larger diameter of the shaft 360 to the smaller diameter of the working portion 355. In such embodiments, the neck 364 may have: a smaller diameter (the diameter of the neck 364 closest to the working portion 355) in the range of about 1.4-9.8 mm, about 1.6-9.0 mm, about 1.8-8.2 mm, about 2.0-7.4 mm, about 2.2-6.6 mm, about 2.4-5.8 mm, about 2.6-5.0 mm, about 2.8-4.2 mm and about 3.0-3.4 mm, or any other diameter that facilitates functioning of the systems disclosed herein; and a larger diameter (the diameter of the neck 364 closest to the shaft 360) in the range of about 1.4-9.8 mm, about 1.8-8.2 mm, about 2.2-6.6 mm, about 2.6-5.0 mm, and about 3.0-3.4 mm, or any other diameter that facilitates functioning of the systems disclosed herein. In some embodiments, the neck 364 of the cigar airflow adjustment instrument 350 is fabricated out of the same material as the working portion 355 of the device. In other embodiments, the neck 364 of the cigar airflow adjustment instrument 350 is fabricated out of the same material as the shaft 360 of the device. In still other embodiments, the neck 364 of the cigar airflow adjustment instrument 350 is fabricated out of another material, different from the material of the working portion 355 or the shaft 360. In some embodiments, the neck 364 is fabricated out of metals, metal alloys, plastics, composite materials (e.g., any type of steel, titanium, sterling silver, bronze, gold alloys, hard polymers, plastics, carbon, etc.). In other embodiments, the neck 364 is made out of any other material having the necessary rigidity to force the working portion 355 through the filler tobacco of the cigar 110 to reach the localized densely packed filler 306, and to use the working portion 355 at the localized densely packed filler 306.

The taper rate of the neck 364 is defined by the length of the neck 364. For example, the gently tapered neck 364 shown in FIG. 3A is relatively long (e.g., about 2 cm). By contrast, the neck 364 may be very short and sharply tapered, thereby forming more of a shoulder than a graduated connector. In some embodiments, the length of the neck 364 is in the range of about 0.5-40 mm, about 1-30 mm, about 2-25 mm, about 3-20 mm, about 4-15 mm, and about 5-10 mm, or any other length that facilitates functioning of the systems as disclosed herein.

Various embodiments of the cigar airflow adjustment instrument 350 may have various combinations of working portion 355, neck 364, and shaft 360. For example, some embodiments have a working portion 355, no neck 364, and no shaft 360; other embodiments have a working portion 355, no neck 364, and a shaft 360; still other embodiments have a working portion 355, a neck 364, and a shaft 360. However, all embodiments of the cigar airflow adjustment instrument 350 have some type of working portion 355 (several other working portions according to other embodiments will be discussed below). Embodiments of the cigar airflow adjustment instrument 350 having only a working portion 355 and no shaft 360 may have a working portion 355 with a length in the range of about 3-20 cm, about 5-17 cm, about 7-14 cm, and about 9-11 cm, or any other length that facilitates functioning of the systems as disclosed herein.

In some embodiments, one or more of any shaft 360, neck 364, and working portion 355 present in the cigar airflow adjustment instrument 350 are formed monolithically or are at least one solid piece (formed by any appropriate technique such as welding or soldering). In some embodiments, one or more of any shaft 360, neck 364, and working portion 355 present in the cigar airflow adjustment instrument 350 are separate or detachable from each other. In such embodiments, for example, the working portion 355 may advantageously be replaced if the blades or protrusions of the working portion 355 should dull and/or become less effective. In much the same way, in such embodiments, the working portion 355 could be replaced should the user wish to use a working portion 355 with a different type or character of blade.

Figure 36A:
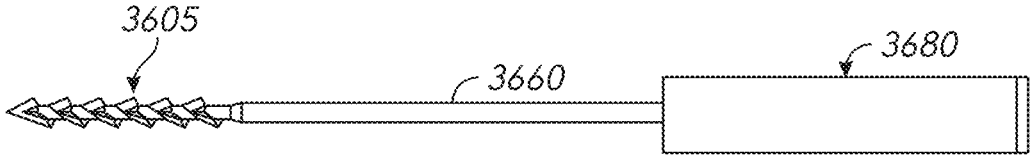
FIGS. 36A-36B are side views of an embodiment of a pen-style cigar airflow adjustment instrument.
Figure 36B:
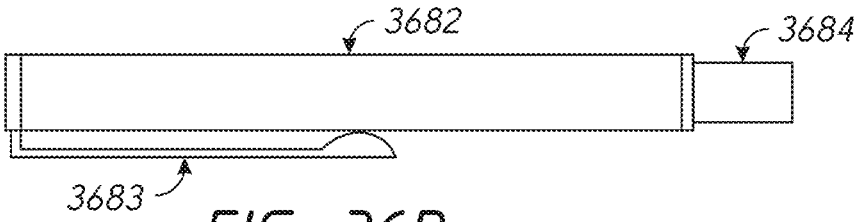
Figure 37A:
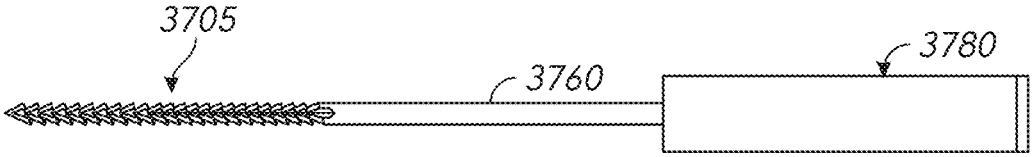
FIGS. 37A-37B are side views of an embodiment of a pen-style cigar airflow adjustment instrument.
Figure 37B:
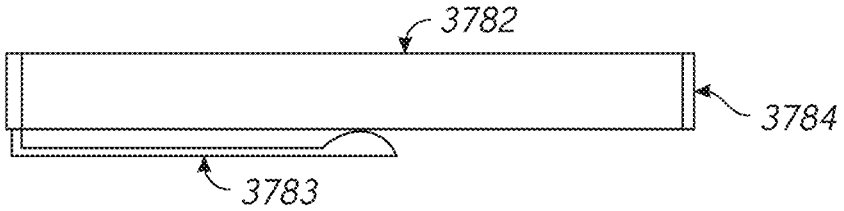
Figure 38:
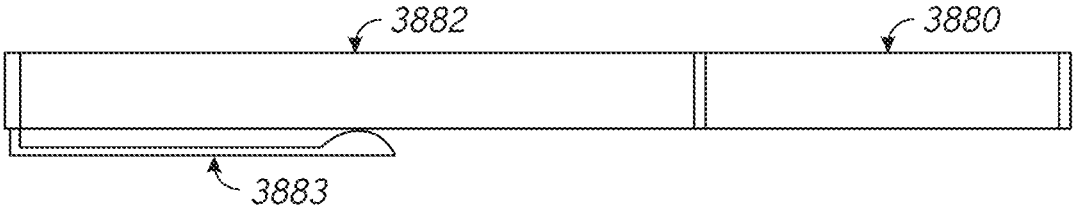
FIG. 38 is a side view of an embodiment of a pen-style cigar airflow adjustment instrument.

The shaft 360 and/or working portion 355 of the cigar airflow adjustment instrument 350 may be attached to a handle of any type and/or configuration. In some embodiments, the working portion 355 is kept in a sheath or container when not in use to prevent mistaken injury to a user when transporting and storing the cigar airflow adjustment instrument 350. FIGS. 36A-36B show an embodiment of the cigar airflow adjustment instrument 350 incorporated into a pen-like case. Working portion 3605 is connected to shaft 3660 as described above. The working portion 3605 shown in FIG. 36A is substantially the same as that shown in and described with respect to FIGS. 18A-18D. Shaft 3660 is fixed (either removably or fixedly) to a pen handle 3680, which may provide a convenient location or handle for the user to hold while using the cigar airflow adjustment instrument 350. In some embodiments, the shaft 3660 has a male thread (e.g., on its end opposite the working portion 3605) that mates with a female thread inside the pen handle 3680. In other embodiments, the shaft 3660 may be welded to the pen handle 3680. In other embodiments, any form attachment reasonable for the application may be used, for example, glues, epoxies, clips, buttons, friction, etc. The pen cap 3682 shown in FIG. 36B may include a hollow cavity into which the working portion 3605 and shaft 3660 may fit. The pen cap 3682 may include a pen cap clip 3683 and a closure mechanism 3684. The pen cap clip 3683 may be included so that a user may attach the device to his or her shirt or any other object. Alternatively, the pen cap clip 3683 may be included for decorative purposes. The closure mechanism 3684 may serve to keep the pen cap 3682 attached to the pen handle 3680 once the working portion 3605 has been inserted into the pen cap 3682. The closure mechanism 3684 may be a threaded closure mechanism 3684. For example, the closure mechanism 3684 may include a male thread on the outer surface of the closure mechanism 3684 that mates with a female thread on the inner surface of the pen handle 3680. In other embodiments, any form of detachable or releasable closure mechanism 3684 may be used, for example, clips, springs, friction, magnets, etc. FIGS. 37A-37B illustrate another embodiment of the cigar airflow adjustment instrument 350 incorporated into another pen-like case. Working portion 3705, different from the working portion 3605 shown in FIG. 36A, is attached to shaft 3760. The working portion 3705 shown in FIG. 37A is substantially the same as that shown in and described with respect to FIGS. FIGS. 14A-14D. Shaft 3760 is attached to pen handle 3780 in much the same way as described with respect to FIG. 36A. Similar to FIG. 36B, pen cap 3782 has a pen cap clip 3783 and a closure mechanism 3784. However, the closure mechanism 3784 illustrated in FIG. 37B is of a different type than that shown in FIG. 36B. FIG. 38 illustrates an assembled device such as those shown in FIGS. 36A-36B and 37A-37B. Here, pen cap 3882, which has a pen cap clip 3883, has been placed over a working portion and shaft (not shown) and attached to pen handle 3880 using a closure mechanism (such as those described above).

Figure 39A:
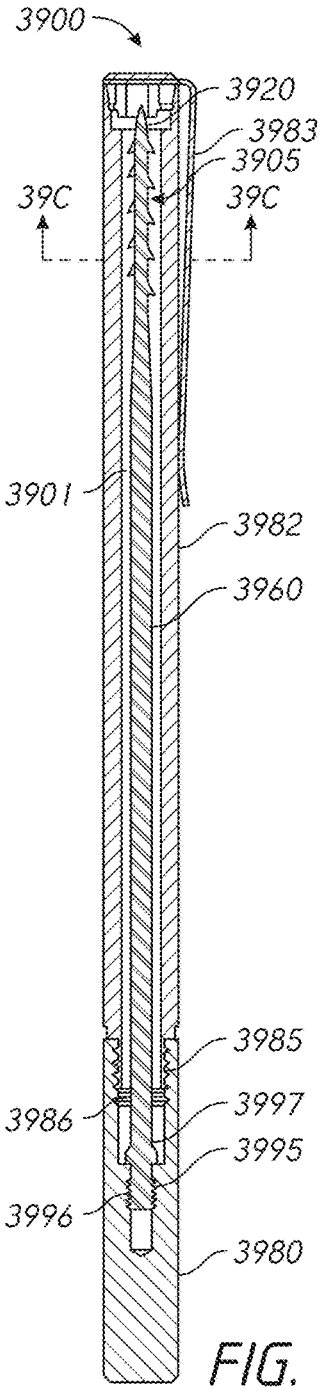
FIGS. 39A-39D are various schematic views of an embodiment of a pen-style cigar airflow adjustment instrument.
Figure 39B:
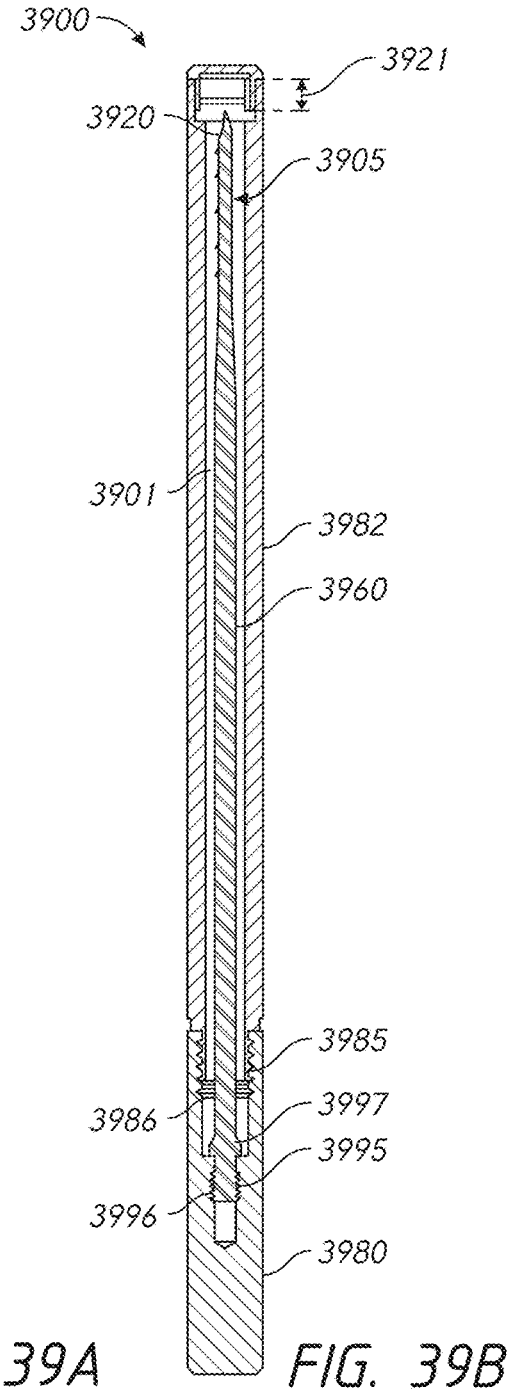
Figure 39D:
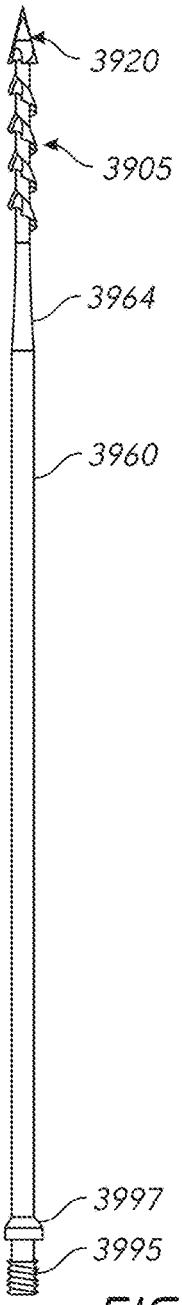
Figure 39C:
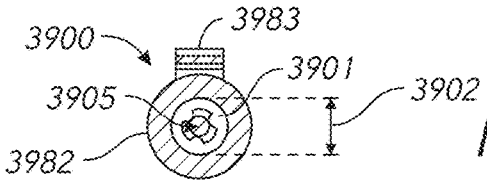

FIGS. 39A-39D show another embodiment of a pen-style cigar airflow adjustment tool 3900. FIG. 39A is a cross-sectional view of the pen-style cigar airflow adjustment tool 3900 taken from the side of the device. FIG. 39B is a cross sectional view of the pen-style cigar airflow adjustment tool 3900 of FIG. 39A rotated 90 degrees counterclockwise. FIG. 39C is a cross sectional view of the pen-style cigar airflow adjustment tool 3900 of FIG. 39A taken along line 39C-39C. Finally, FIG. 39D is the inner portion of the pen-style cigar airflow adjustment tool 3900 of FIG. 39A-39C, including a working portion 3905, a neck 3964, a shaft 3960, a shaft shoulder 3997, and shaft threads 3995.

Turning to FIG. 39A, the pen-style cigar airflow adjustment tool 3900 has a cap 3982 and a handle 3980. The cap 3982 and the handle 3980 have an attachment mechanism to releasably or reversibly hold the two portions of the pen-style cigar airflow adjustment tool 3900 together. In this embodiment, the cap 3982 has a set of cap threads 3985 on the outer surface of its base (i.e., male threads) and the handle 3980 has a set of handle threads 3986 on the inner surface of its opening. In some embodiments, threads are not used. Instead, any form of detachable or releasable attachment mechanism may be used, for example, clips, springs, friction, magnets, etc.

The handle 3980 of the pen-style cigar airflow adjustment tool 3900 includes a cavity having handle threads 3996 that mate with corresponding shaft threads 3995 on the shaft 3960. The shaft 3960 may therefore be screwed or threaded into the handle 3980 thereby providing a user with a convenient, stable location to grasp the shaft 3960 and use the pen-style cigar airflow adjustment tool 3900. In the absence of some type of handle 3980, the shaft 3960 may otherwise be too thin for a user to comfortably grasp and use the pen-style cigar airflow adjustment tool 3900. As can be seen easily in FIG. 40D, the shaft 3960 may have a shaft shoulder 3997 that may serve to stop the shaft 3960 from threading further into the handle 3980. For example, as shown in FIG. 39A, the shaft 3960 may be threaded into the handle 3980 until the shaft shoulder 3997 meets the shoulder in the handle 3980 that is immediately above the handle threads 3996. At that time, the shaft 3960 is fully installed and ready for use. In some embodiments, no shaft shoulder 3997 is included and the shaft 3960 may be threaded into the handle 3980 until either there are no more threads to mate with, or the shaft 3960 has reached the end of the cavity in the handle 3980. Of course, other types of attachment between the shaft 3960 and the handle 3980 may be used, including both releasable attachment (such as the threads shown in FIGS. 39A-39B, or spring, clips, friction, etc.) or fixed attachment (such as welding, epoxies, glues, etc.).

The cap 3982 of the pen-style cigar airflow adjustment tool 3900 has a pen cap inner cavity 3901 that is slightly longer than the combined length of the working portion 3905, neck 3964, and shaft 3960. This way, the cap 3982 may fit over and the pen cap inner cavity 3901 may fully accommodate the inner portion of the tool when the cap 3982 is screwed into the handle 3980. As shown in FIG. 39B, the pen cap inner cavity 3901 extends only just past the working portion tip 3920, by the pen cap tip gap 3921. In some embodiments, the pen cap tip gap 3921 is in the range of about 0.5-5 mm, about 1-4 mm, and about 2-3 mm, or any other distance that facilitates functioning of the systems disclosed herein. In addition to having a pen cap inner cavity 3901, the cap 3982 has an inner cavity diameter 3902, as shown in FIG. 39C. The inner cavity diameter 3902 is sufficiently large that it may accommodate the entire cross section of each of the working portion 3905, neck 3964, and shaft 3960. In some embodiments, the inner cavity diameter 3902 is larger than the diameter of the largest of the working portion 3905, neck 3964, and shaft 3960 by about less than 0.5 mm, less than about 1 mm, less than about 2 mm, less than about 3 mm, and less than about 4 mm, or any other distance that facilitates functioning of the systems disclosed herein. The cap 3982 may also have a pen cap clip 3983 for convenience of the user or aesthetics. In some embodiments, the cap 3982 has no pen cap clip 3983.

FIG. 39D shows the inner portion of the pen-style cigar airflow adjustment tool 3900 of FIG. 39A-39C, including a working portion 3905, a neck 3964, a shaft 3960, a shaft shoulder 3997, and shaft threads 3995. It should be understood that this inner portion is representative only and that any other shaft, neck, working portion, and/or tip as disclosed herein may be used and/or substituted for what is shown in FIG. 39D.

FIGS. 35A-35E show a cigar airflow adjustment instrument 3500, similar to the cigar airflow adjustment instrument 350 of FIG. 3, in various states of use. When a cigar enthusiast cuts the end of the head 102 of a cigar, such as a torpedo cigar 100 or a perfecto cigar 110, the user may draw air through the cigar 110 to test the airflow resistance. If the resistance is higher than desired, the cigar airflow adjustment instrument 3500 may be inserted into the cut head 305 of the cigar 110 and/or the foot 104 of the cigar 110 by using one or more of pushing, and pushing and rotating motions. When there are localized areas of densely packed filler, it may be desirable to direct the cigar airflow adjustment instrument 3500 to such localized areas, assuming they can be located. In some embodiments, it may be possible to locate localized areas of densely packed filler by inserting the cigar airflow adjustment instrument 3500 or an icepick-like probe device into the cigar at multiple locations. When/if the cigar airflow adjustment instrument 3500 or icepick-like probe becomes noticeably or significantly more difficult to insert, the user may know that he or she has found a localized area of densely packed filler within the cigar 110.

The user may then insert the cigar airflow adjustment instrument 3500 into the cigar 110, either to a localized area of densely packed filler or to any other location of which the user desires to decrease the density of the tobacco filler. The cigar airflow adjustment instrument 3500 may be inserted by using one or more of a pushing, rotating, and pulling motion. Some embodiments, such as the cigar airflow adjustment instrument 350 shown in FIG. 3, include scallops or other types of cut-outs in the working portion, leaving a discontinuous edge that may make it difficult to insert by merely pushing. Such embodiments, in particular, may benefit from the incorporation of a rotating motion during insertion to advantageously prevent the scallops or other cut-outs from becoming caught on the tightly packed tobacco.

Once the cigar airflow adjustment instrument 3500, and in particular the working portion (e.g., working portion 355 of FIG. 3), is within the cigar 110 a desired distance or at the desired location, the cigar airflow adjustment instrument 3500 may be removed by using one or more of a pulling, rotating, and pushing motion, which can effectively and efficiently remove considerable amounts of filler tobacco. In some embodiments, the cigar airflow adjustment instrument 3500 is inserted through the head 102 of the cigar 110. In other embodiments, the cigar airflow adjustment instrument 3500 is inserted through the foot 104 of the cigar 110. In some embodiments, the cigar airflow adjustment instrument 3500 is inserted parallel to the longitudinal axis of the cigar 110. And, in some embodiments, the cigar airflow adjustment instrument 3500 is inserted at an angle to the longitudinal axis of the cigar 110. When inserted at an angle, the cigar airflow adjustment instrument 3500 is inserted generally in the range of between about 1-30 degrees, about 2-25 degrees, about 3-20 degrees, about 4-15 degrees, and about 5-10 degrees, or any other degree that facilitates functioning of the systems disclosed herein. In some embodiments, the cigar airflow adjustment instrument 3500 may be inserted into a cigar 110 in the range of about 0.5-20 cm, about 1-16 cm, about 1.5-12 cm, about 2-8 cm, about 2.5-4 cm, including about 3 cm. In other embodiments, the instrument may be inserted into a cigar to any portion of the cigar from which the user wishes to remove any amount of filler tobacco, such as any portion of the cigar the user has determined is too tightly packed.

Figure 35A:
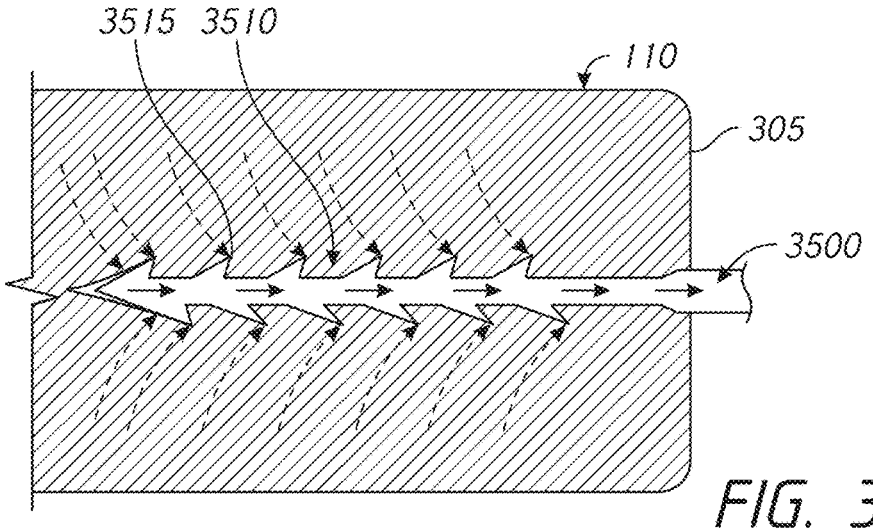
FIGS. 35A-35E are schematic representations of a cigar airflow adjustment instrument being used to adjust the airflow of a cigar.

FIG. 35A illustrates a cigar airflow adjustment instrument 3500 that has been inserted some distance through the cut head 305 of cigar 110. As shown in the figures, the filler tobacco of the cigar 110 has extended or pressed into the working portion recess 3510 of the cigar airflow adjustment instrument 3500. Unlike cigarettes, cigars are filled with long strips of tobacco leaves instead of chopped tobacco debris. Therefore, once inserted into a cigar 110 a cigar airflow adjustment instrument 3500, as disclosed herein, may be pushed, pulled (as shown by arrows in the center of the cigar airflow adjustment instrument 3500), or rotated into or in a cigar 110 to cause one or more working portion blades 3515 to engage the tobacco leaf filler and pull it and/or loosen it toward the center of the cigar (shown by the curved, dashed arrows in FIGS. 35A-35E).

Figure 35B:
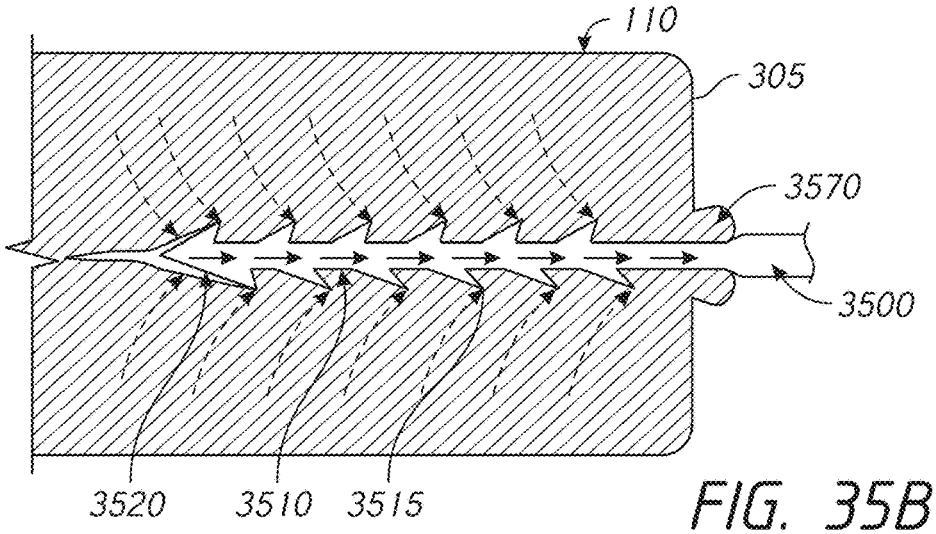

FIG. 35B illustrates a cigar airflow adjustment instrument 3500 as it is first being pulled out of a cigar 110, as shown by the arrows in the center of the cigar airflow adjustment instrument 3500. The filler tobacco pushes in on the cigar airflow adjustment instrument 3500 and specifically into the working portion recess 3510. The working portion blade 3515 may catch, cut, and/or pull the filler tobacco residing in the working portion recess 3510 of the cigar airflow adjustment instrument 3500. Therefore, as the cigar airflow adjustment instrument 3500 is withdrawn from the cigar, each combination of working portion recess 3510 and working portion blade 3515 catch, cut, and/or pull the filler tobacco toward the center of the cigar 110 and/or out of the cigar as excavated filler material 3570. FIG. 35B shows only a small amount of excavated filler material 3570 as the cigar airflow adjustment instrument 3500 has only been pulled out of the cigar 110 a short distance.

Figure 35C:
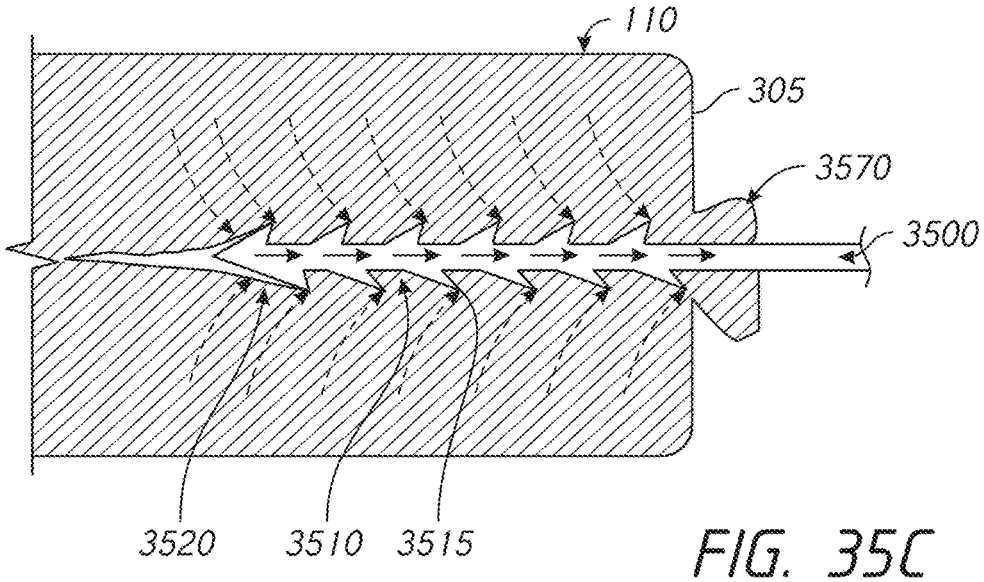
Figure 35D:
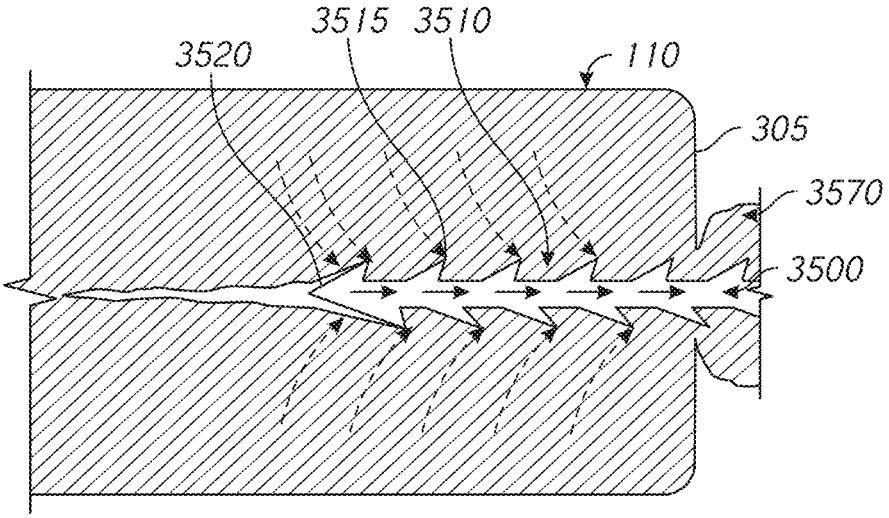
Figure 35E:
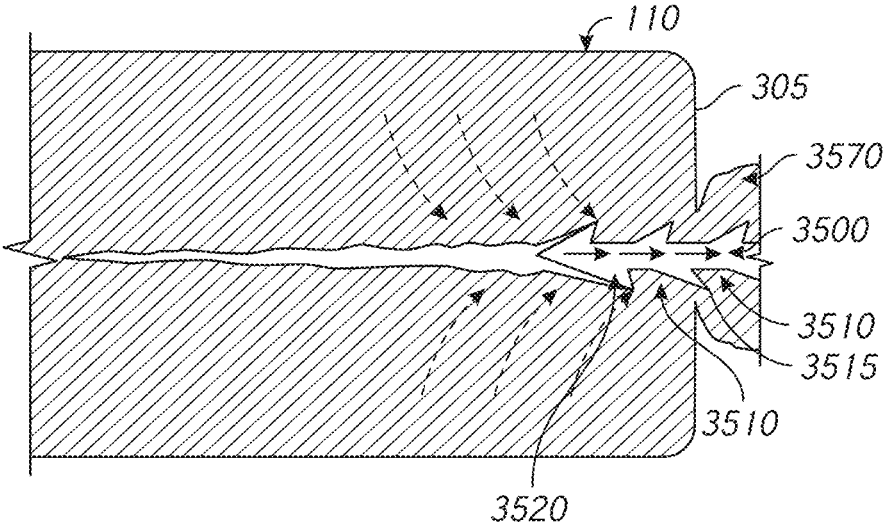

In FIG. 35C-35E the cigar airflow adjustment instrument 3500 has been withdrawn even further from the cut head 305 of the cigar 110 (again, along the arrows in the center of the cigar airflow adjustment instrument 3500). As shown by the dashed arrows, the cigar airflow adjustment instrument 3500 has continued to catch the tobacco, pull the tobacco toward the center of the cigar, and/or cut the tobacco. Because of its shape, as the cigar airflow adjustment instrument 3500 is withdrawn, the tobacco filler is pulled toward the center, behind the pointed head 3520, closing the track of the cigar airflow adjustment instrument 3500. As can be seen, additional excavated filler material 3570 is present in FIG. 35C-35E, in increasing amounts (the amount of excavated filler material 3570 in 35E being greater than 35D, which is greater than 35C). That is because the working portion blade 3515 and working portion recess 3510 continue to work together as the cigar airflow adjustment instrument 3500 is withdrawn to catch, cut, and/or pull the filler tobacco residing in the working portion recess 3510 of the cigar airflow adjustment instrument 3500.

Pulling tobacco leaves from the perimeter more toward the center of the cigar 110, as discussed with respect to FIGS. 35A-35E, may serve to both reduce the size of the hole left after the cigar airflow adjustment instrument 3500 is removed from the cigar 110, and to loosen (and more homogeneously redistribute) the previously tightly packed tobacco filler so that more air/smoke may be drawn through the tobacco filler. Some embodiments of the cigar airflow adjustment instrument 3500 disclosed herein leave behind a hole that is smaller in diameter than the cigar airflow adjustment instrument 3500 itself (some embodiments leave substantially no hole whatsoever). This not only closes the resulting hole in the tobacco, but also loosens up the surrounding tobacco (which may have originally been tightly packed), thereby encouraging more air flow through more of the body of the cigar, rather than merely through a hole or track left by a boring tool.

Gentle rolling and massaging of the outer aspect of the cigar 110 between the user's fingers may further cause the loosened tobacco filler to expand into the center of the cigar 110, thereby decreasing the presence of or even eliminating the hole created by the cigar airflow adjustment instrument 3500. However, minimizing the amount of rolling and/or massaging of a cigar 110 may advantageously prevent cracking, breaking, unraveling, and/or otherwise damaging the potentially fragile cigar wrapper. Cracking, breaking, unraveling, and/or otherwise damaging a cigar wrapper may render the cigar 110 unfit for smoking, thereby completely destroying the cigar 110. Some embodiments of the cigar airflow adjustment instrument 3500 advantageously cut and pull sufficient tobacco leaves toward the center of the cigar 110 during operation that the size of the remaining hole is reduced if the hole is not eliminated completely; hence, only minimal rolling and/or massaging of the cigar 110 may be useful to improve the distribution of tobacco filler within the cigar 110. Therefore, the possibility of damaging the cigar's wrapper may be minimized. Other embodiments of the cigar airflow adjustment instrument 3500 advantageously pull sufficient tobacco leaves toward the center of the cigar 110 during operation that no rolling and/or massaging of the cigar 110 is useful and/or necessary to improve the distribution of tobacco filler within the cigar 110.

In some embodiments, blades or edges (e.g., working portion blade 3515 of the cigar airflow adjustment instrument 3500) that extend outward from the recessed areas and/or working portion of the cigar airflow adjustment instrument 3500 allow the user to apply sideways force on the instrument while pushing, pulling, and/or rotating. Such selective application of sideways force to the cigar airflow adjustment instrument 3500 may advantageously cause the working portion blade 3515 on the side of the cigar airflow adjustment instrument 3500 opposite to the application of force to be pushed into and bite further into the tobacco filler on that side. In addition to biting deeper on that side, less force is applied on the opposite side. Therefore, the user may selectively remove more tobacco in specific, targeted areas of the cigar 110, for example, areas of the cigar 110 that are more tightly packed than other areas (such as localized densely packed filler 306 of FIG. 3).

While holding the cigar 110 firmly, sideways force may be applied to the cigar airflow adjustment instrument 3500 (e.g., by pressing against the shaft) to create a sideways force on the working portion blade 3515 of the cigar airflow adjustment instrument 3500 which consequently can create a sideways force of the working portion blade 3515 against the tobacco filler. Such an application of sideways force may engage the blades or edges of the working portion blade 3515 of the cigar airflow adjustment instrument 3500 into and selectively remove more tobacco, while also pulling on the remaining tobacco filler to loosen it and encourage it to expand toward the center of the cigar 110. Sideways (or lateral) force may be combined with one or more of pushing, pushing and rotating, pulling, and pulling and rotating to remove any desired amount of filler tobacco from within a cigar 110. Such application of lateral force, pushing, pulling, and/or rotating may be performed as many times as desired or until the resistance to airflow is as desired by the cigar smoker.

Applying sideways force on the instrument while pushing, pulling, and/or rotating the cigar airflow adjustment instrument 3500 may allow the user to: 1) remove more tobacco in specific areas of the cigar 110 that may be more tightly packed than other areas; and 2) avoid removing additional tobacco from areas in the cigar 110 that are not tightly packed. This can provide significant control of exactly where tobacco will be removed and how much. In this way, embodiments of the cigar airflow adjustment instrument 3500 may be used, not only to unplug a plugged cigar 110, but also to adjust and/or fine-tune the draw of any cigar 110 to the desire of the individual user.

Some variations of the cigar airflow adjustment instrument 3500 may have fewer blades or edges in a smaller area, providing the user with the ability to remove tobacco filler more precisely where desired, while not removing it in other areas. This provides increased control over where and how much tobacco will be removed advantageously allowing the user to remove tobacco from areas in the cigar 110 that are tightly packed while desirably leaving tobacco in the areas in the cigar 110 that are not as tightly packed.

After the cigar airflow adjustment instrument 3500 has been fully withdrawn from the cut head 305 of the cigar 110, the cigar 110 may then be turned around and the user can blow air into the opposite end of the cigar 110 (assuming the cigar is not lit) to blow out any loose tobacco that was removed and/or loosened by the cigar airflow adjustment instrument 3500 during operation. By blowing the loose tobacco out, the user can decrease the chance that loose tobacco cut or dislodged during operation enters the user's mouth when another airflow (draw) test is performed on the cigar 110 or when the cigar 110 is lit and smoked. The user may then again test the airflow of the cigar 110. If the airflow (draw) resistance is still higher than desired, the cigar airflow adjustment instrument 350 may again be inserted into the cigar 110 through the same entry point as previously (or another entry point on the head 102 or foot 104 of the cigar 110). In some embodiments, the cigar airflow adjustment instrument 3500 is inserted deeper by using a pushing motion, a pulling motion (e.g., combined with a pushing motion), and/or rotation. The cigar airflow adjustment instrument 3500 may be used by any combination of pushing, pulling, and rotating (e.g., one or more of pushing, pushing and rotating, pushing and pulling once or back and forth, and/or rotating once or back and forth). Then, the cigar airflow adjustment instrument 3500 may be removed from the cigar 110 using one or more of a pulling, or pulling and rotating motions to remove more tobacco filler. The cigar 110 may then be turned around and the user can again blow air into the opposite end of the cigar 110 to dislodge and/or blow out any loose tobacco that was removed and/or loosened by the cigar airflow adjustment instrument 3500 during operation. The user may then again test the airflow of the cigar 110. This same procedure may be performed as many times as necessary or desired (e.g., until the airflow is at the level desired by the user).

Figure 40:
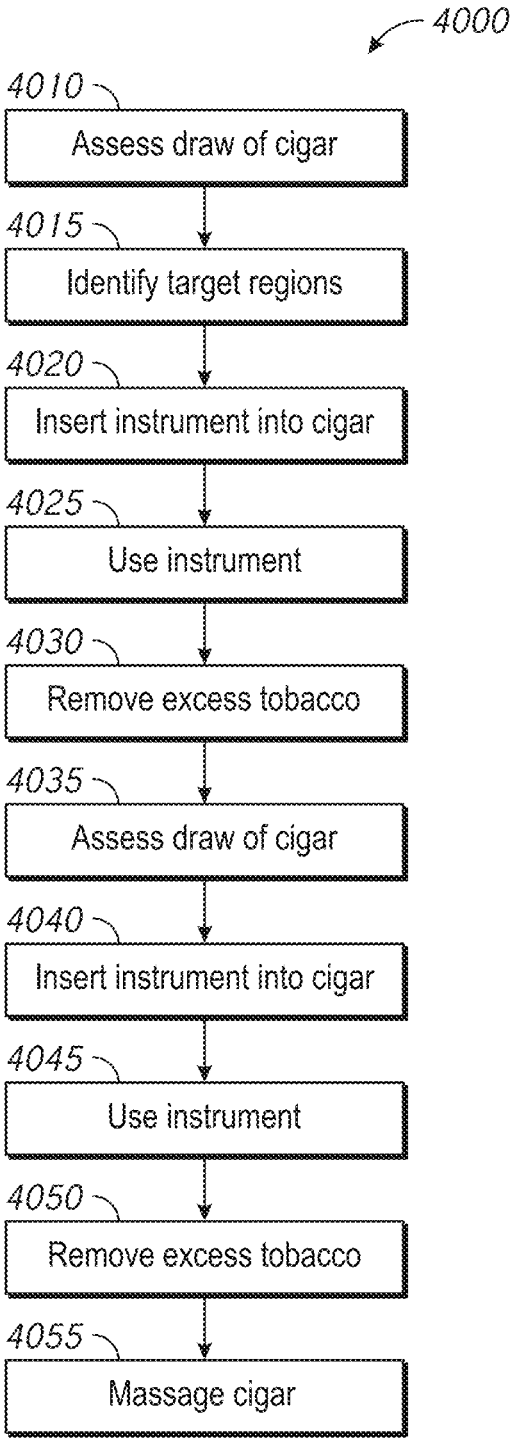
FIG. 40 is a schematic of an example embodiment of a method of adjusting the draw of a cigar

FIG. 40 illustrates an example embodiment of a method of adjusting the draw of a cigar 4000. In some embodiments, the method of adjusting the draw of a cigar 4000 includes assessing the draw of the cigar 4010. For example, after the cigar has been cut and before the cigar has been lit, the user may draw air through the cigar to determine if the draw is too snug or ideal. If it is ideal, the user need not continue with the method of adjusting the draw of a cigar 4000. In some embodiments, the method of adjusting the draw of a cigar 4000 includes identifying overly packed regions in the cigar 4014. For example, the user may insert an icepick-like tool into the cigar to identify "harder" spots, or the user may identify over-packed regions in any other fashion. Alternatively, the user may not need to identify a specific target and may instead simply generally loosen the filler tobacco. In some embodiments, the method of adjusting the draw of a cigar 4000 includes inserting a cigar airflow adjustment instrument into the cigar 4020. For example, the cigar airflow adjustment instrument may be inserted using one or more of pushing, pulling, and rotating. In some embodiments, the method of adjusting the draw of a cigar 4000 includes using a cigar airflow adjustment instrument 4025. For example, the cigar airflow adjustment instrument may be used within the cigar by using one or more of pushing, pulling, and rotating so that the working portion of the cigar airflow adjustment instrument engages the tobacco filler within the cigar. In some embodiments, the method of adjusting the draw of a cigar 4000 includes removing excess tobacco from the cigar 4030. For example, the user may simply withdraw the cigar airflow adjustment instrument from within the cigar, thereby pulling torn tobacco bits out of the cigar. Additionally, the user may blow into the foot of the cigar to knock out any loose excess pieces of tobacco. In some embodiments, using the cigar airflow adjustment instrument allows the user to remove substantial amounts of tobacco from within the cigar. In some embodiments, substantial amounts of tobacco is defined as any volume of tobacco. In other embodiments, substantial amounts of tobacco is defined as a sufficient volume of tobacco to improve the draw of the cigar. In still other embodiments, substantial amounts of tobacco is defined as being more than a few pieces, shreds, dustings, or other small amount. In some embodiments, the method of adjusting the draw of a cigar 4000 includes assessing the draw of the cigar again 4035. For example, the user may again test the draw of the cigar by drawing air through the cigar to determine if the draw is still too snug or if it has become ideal. If it is ideal, the user need not continue with the method of adjusting the draw of a cigar 4000. In some embodiments, the method of adjusting the draw of a cigar 4000 includes inserting a cigar airflow adjustment instrument into the cigar again 4040. For example, the cigar airflow adjustment instrument may be inserted using one or more of pushing, pulling, and rotating. In some embodiments, the method of adjusting the draw of a cigar 4000 includes using the cigar airflow adjustment instrument again 4045. For example, the cigar airflow adjustment instrument may be used within the cigar by using one or more of pushing, pulling, and rotating so that the working portion of the cigar airflow adjustment instrument engages the tobacco filler within the cigar. In some embodiments, the method of adjusting the draw of a cigar 4000 includes removing excess tobacco from the cigar again 4050. For example, the user may simply withdraw the cigar airflow adjustment instrument from within the cigar, thereby pulling torn tobacco bits out of the cigar. Additionally, the user may blow into the foot of the cigar to knock out any loose excess pieces of tobacco. In some embodiments, the method of adjusting the draw of a cigar 4000 includes rolling or massaging the cigar 4090. For example, user may roll and massage the outside of the cigar between the fingers in the area where tobacco was removed to decrease the presence or noticeability of the hole and/or residual space in the cigar left by using the device. Rolling the cigar after removing some tobacco using the device may also advantageously cause the tobacco inside the cigar to generally reorganize more homogenously thereby allowing air to be sucked through the tobacco more uniformly. Massaging is, however, not always required by the method of adjusting the draw of a cigar 4000.

In some embodiments, the working portion may be a flat blade with a width in the range of about 1.4-6.4 mm, about 1.6-6.0 mm, about 1.8-5.6 mm, about 2.0-5.2 mm, about 2.2-4.8 mm, about 2.4-4.4 mm, about 2.6-4.0 mm, and about 2.8-3.6 mm, or any other width that facilitates functioning of the systems disclosed herein. In embodiments having a flat blade, the blade may remain flat along the length of the working portion or the blade may be twisted along the length of the working portion. In some embodiments, portions of the rod or blade may be formed or machined in any configuration that allows the effective and efficient removal of tobacco from the cigar 110 as the instrument is inserted into the head or foot of the cigar and pushed, pulled and/or rotated clockwise, counter clockwise or both, inside the cigar. In other embodiments, portions of the rod or blade may be formed or machined in any configuration that allows sufficient removal of tobacco to improve airflow through the cigar after the instrument has been inserted into the head or foot of the cigar and pushed, pulled, and/or rotated clockwise, counter clockwise or both, at one or more locations inside the cigar.

In some embodiments, the tobacco removing feature(s) of the rod or blade may be a blunt, sharp, or tapered tip, cutting blades, or pulling or tearing edges. In other embodiments, the tobacco removing feature(s) of the rod or blade may be spikes. In yet other embodiments, the tobacco removing feature(s) of the rod or blade may be sharp cutting threads that allow the instrument to be screwed or pushed into the head or foot of the cigar and then pulled and/or rotated to cut, pull, or tear tobacco loose from the cigar's tobacco filler. In other embodiments, the tobacco removing feature(s) of the rod or blade may be one or more flattened sides. In still other embodiments, the tobacco removing feature(s) of the rod or blade may be one or more grooves down the length of the rod, or any other configuration capable of removing sufficient amounts of tobacco from the cigar's tobacco filler to improve the cigar's airflow.

In some embodiments, in addition to the cutting, pulling, or tearing portions of the formed or machined rod or blade, the working portion includes recessed areas having width, length and depth. Recessed areas having width, length, and depth may allow the tobacco filler to expand toward the center of the device (as described above), which may enhance the ability of the cutting, pulling, and/or tearing portions of the cigar airflow adjustment instrument to remove tobacco filler when pushed, pulled, and/or rotated. After inserting a device having recesses, the cigar filler tobacco may expand into the recesses of the instrument's working portion, such that when pulling, pushing, and/or rotating the instrument, the cutting blades or pulling or tearing edges may remove the tobacco filler that had expanded into the recesses of the instrument. In some embodiments, the recesses in the working portion of the cigar airflow adjustment instrument act as at least one reservoir for the removed tobacco filler to occupy so that it may accumulate when the instrument is used, and then be removed when the cigar airflow adjustment instrument is removed from within the cigar.

FIGS. 4A-34C illustrate various embodiments of working portions. Below, FIGS. 4A-4D will be described in detail. It should be appreciated that certain characteristics may be shared between the various working portions. Therefore, not every working portion will be described in such a high level of detail.

FIG. 4A illustrates an embodiment of a working portion 405 of a cigar airflow adjustment instrument 400. FIG. 4B shows the cross section of the working portion 405 of FIG. 4A taken along line 4B-4B. FIG. 4C shows the cigar airflow adjustment instrument 400 inserted into an axial cross-section of a cigar 110. FIG. 4D shows the cigar airflow adjustment instrument 400 inserted into a longitudinal cross-section of a cigar 110 through the cut head 305 of the cigar 110. Working portion 405 includes a pointed head 420 and one or more blades 415. In this embodiment, working portion 405 includes a single, spiral blade 415 wrapped around the length of the working portion 405. The spiral is defined by pitch angle 416—a larger pitch angle 416 may produce fewer spirals, while a smaller pitch angle 416 may produce more spirals. In some embodiments, the pitch angle 416 is in the range of about 5-45 degrees, about 7.5-35 degrees, and about 10-25 degrees, or any other angle that facilitates functioning of the devices disclosed herein. The blade 415 is also defined by the blade angle 417—a larger blade angle 417 may cause the blades 415 to "stand out" further from the inner rod, whereas a smaller blade angle 417 may cause the blades 415 to "lay closer" to the inner rod. The pitch angle 416 and blade angle 417 illustrated are representative only and may be changed as desired to alter the characteristics of the device.

The number of spirals of the blade 415 determines the number of working portion recesses 410. As described above, working portion recesses 410 may help the working portion 405 to catch, cut, and or pull tobacco during use of the working portion 405 in a cigar 110. Additionally, how much the blades 415 stand out from the inner rod or lay closer to the inner rod may define how deep the working portion recesses 410 are—blades 415 standing out far from the inner rod may create deep working portion recesses 410 while blades 415 laying close to the inner rod may create shallow working portion recesses. The dark arrows in FIG. 4D illustrate tobacco within the cigar 110 pushing into the working portion recesses 410.

The working portion 405 is attached to a shaft 460 as described above. In some embodiments, a neck 464 is interposed between the working portion 405 and the shaft 460, as described above.

FIG. 5A illustrates an embodiment of a working portion 505 of a cigar airflow adjustment instrument 500. FIG. 5B shows the cross section of the working portion 505 of FIG. 5A taken along line 5B-5B. FIG. 5C shows the cigar airflow adjustment instrument 500 inserted into an axial cross-section of a cigar 110. FIG. 5D shows the cigar airflow adjustment instrument 500 inserted into a longitudinal cross-section of a cigar 110 through the cut head 305 of the cigar 110. Working portion 505 is very similar to the working portion 405 of FIGS. 4A-4D except that one side of working portion 505 is flattened to form a non-cutting flat face 550 (shown clearly in FIG. 5B). The non-cutting flat face 550 may allow the working portion to better target certain portions of the tobacco filler in a cigar 110 because only certain portions of the working portion 505 may catch, cut, or pull tobacco. A user may direct only these portions of the working portion 505 toward the tobacco that needs to be loosened. The dark arrows in FIGS. 5C-5D illustrate tobacco within the cigar 110 pushing into the working portion recesses 510 and up against the non-cutting flat face 550 (shown in FIG. 5D protecting the tobacco near the outer perimeter of the cigar 110).

Figures 6A, 6B:
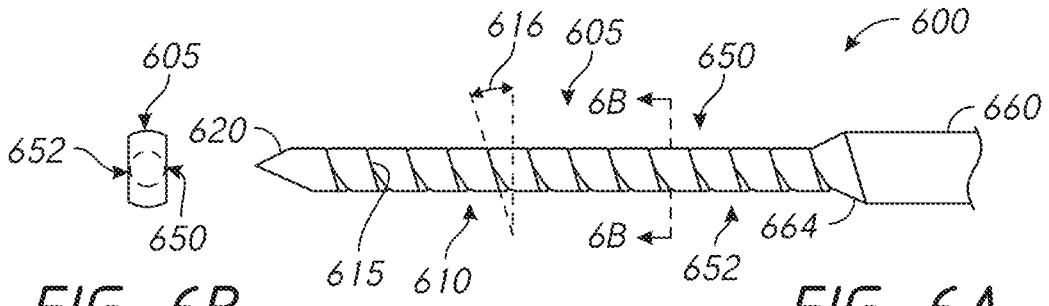
FIGS. 6A-6D are various views of another embodiment of a cigar airflow adjustment instrument.
Figures 6C, 6D:
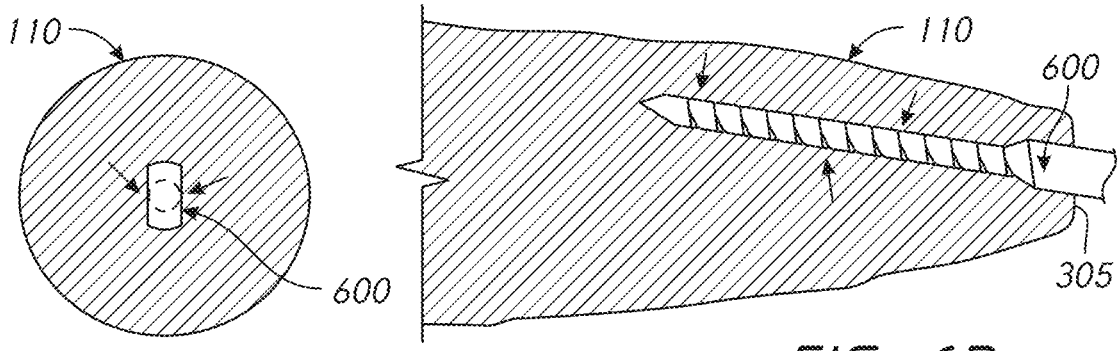

FIG. 6A illustrates an embodiment of a working portion 605 of a cigar airflow adjustment instrument 600. FIG. 6B shows the cross section of the working portion 605 of FIG. 6A taken along line 6B-6B. FIG. 6C shows the cigar airflow adjustment instrument 600 inserted into an axial cross-section of a cigar 110. FIG. 6D shows the cigar airflow adjustment instrument 600 inserted into a longitudinal cross-section of a cigar 110 through the cut head 305 of the cigar 110. Working portion 605 is very similar to the working portion 405 of FIGS. 4A-4D and the working portion 505 of FIGS. 5A-5D except that two sides of working portion 605 are flattened to form a first non-cutting flat face 650 and a second non-cutting flat face 652 (shown clearly in FIG. 6B). The first non-cutting flat face 650 and second non-cutting flat face 652 may allow the working portion to better target certain portions of the tobacco filler in a cigar 110 because only certain portions of the working portion 605 may catch, cut, or pull tobacco. A user may direct only these portions of the working portion 605 toward the tobacco that needs to be loosened. The dark arrows in FIGS. 6C-6D illustrate tobacco within the cigar 110 pushing up against the first non-cutting flat face 650 and second non-cutting flat face 652.

Figures 7A, 7B:
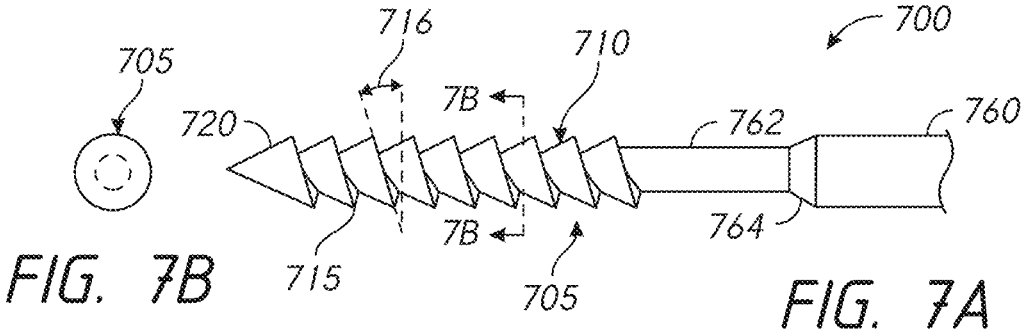
FIGS. 7A-7D are various views of another embodiment of a cigar airflow adjustment instrument.
Figures 7C, 7D:
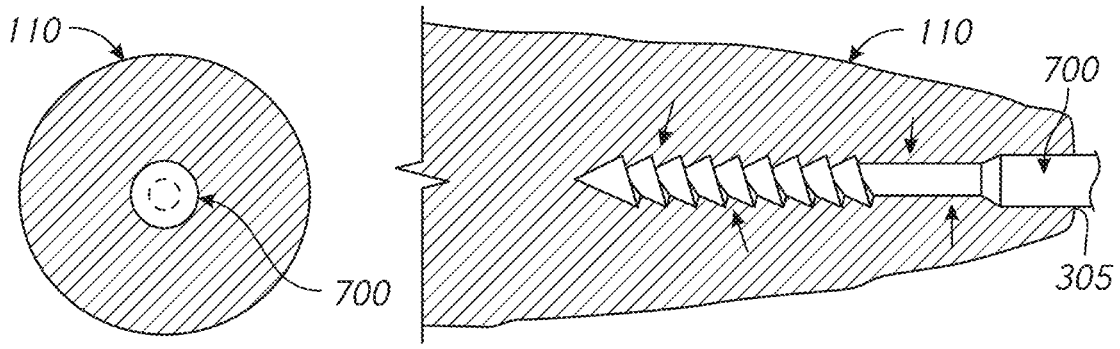

FIG. 7A illustrates an embodiment of a working portion 705 of a cigar airflow adjustment instrument 700. FIG. 7B shows the cross section of the working portion 705 of FIG. 7A taken along line 7B-7B. FIG. 7C shows the cigar airflow adjustment instrument 700 inserted into an axial cross-section of a cigar 110. FIG. 7D shows the cigar airflow adjustment instrument 700 inserted into a longitudinal cross-section of a cigar 110 through the cut head 305 of the cigar 110. Working portion 705 is very similar to the working portion 405 of FIGS. 4A-4D except that the spiral of the blade 715 stops short of the neck 764, leaving an exposed inner rod 762, which has a diameter smaller than the outer diameter of the blade 715. Exposed inner rod 762 may act like a single, large working portion recess 710: during use the area around the exposed inner rod 762 may collect amounts of tobacco filler, larger than what the working portion recesses 710 may collect. Therefore, the cigar airflow adjustment instrument 700 having an exposed inner rod may be able to more efficiently remove tobacco from within the cigar 110. The dark arrows in FIG. 7D illustrate tobacco within the cigar 110 pushing into the working portion recesses 710 and up against the exposed inner rod 762.

FIG. 8A illustrates an embodiment of a working portion 805 of a cigar airflow adjustment instrument 800. FIG. 8B shows the cross section of the working portion 805 of FIG. 8A taken along line 8B-8B. FIG. 8C shows the cigar airflow adjustment instrument 800 inserted into an axial cross-section of a cigar 110. FIG. 8D shows the cigar airflow adjustment instrument 800 inserted into a longitudinal cross-section of a cigar 110 through the cut head 305 of the cigar 110. Working portion 805 includes a pointed head 820 and one or more blades 815. In this embodiment, unlike the spiral-bladed embodiments of FIGS. 4-7, working portion 805 includes several discrete blades 815 positioned around inner rod 862. Each of these discrete blades is defined by shoulder angle 816—increasing shoulder angle 816 may create a smaller cavity (or no cavity) under/distal to the blade 815, while decreasing the shoulder angle 816 may produce a larger or sharper cavity under/distal to the blade 815. In some embodiments, the shoulder angle 816 is in the range of about 30-130 degrees, 40-120 degrees, about 50-110 degrees, about 60-100 degrees, about 70-95 degrees, and about 80-90 degrees, or any other angle that facilitates functioning of the devices disclosed herein. The blade 815 is also defined by the blade angle 817—a larger blade angle 817 may cause the blades 815 to "stand out" further from the inner rod 862, whereas a smaller blade angle 817 may cause the blades 815 to "lay closer" to the inner rod 862. In some embodiments, the blade angle 817 is in the range of about 5-90 degrees, about 10-80 degrees, about 15-70 degrees, about 20-60 degrees, about 25-50 degrees, and about 30-40 degrees, or any other angle that facilitates functioning of the devices disclosed herein. The shoulder angle 816 and blade angle 817 illustrated are representative only and may be changed as desired to alter the characteristics of the device.

The number of discrete blades 815 determines the number of working portion recesses 810. As described above, working portion recesses 810 may help the working portion 805 to catch, cut, and/or pull tobacco during use of the working portion 805 in a cigar 110. Additionally, how much the blades 815 stand out from the inner rod or lay closer to the inner rod may define how deep the working portion recesses 810 are—blades 815 standing out far from the inner rod may create deep working portion recesses 810 while blades 815 laying close to the inner rod may create shallow working portion recesses. The dark arrows in FIG. 8D illustrate tobacco within the cigar 110 pushing into the working portion recesses 810.

The working portion 805 is attached to a shaft 860 as described above. In some embodiments, a neck 864 is interposed between the working portion 805 and the shaft 860, as described above. In the embodiments shown in FIGS. 8A-8D, both the neck 864 and the shaft 860 have diameters smaller than the diameter of the discrete blades 815. In some embodiments, the diameter of the shaft 860 (and consequently the neck 864, if one is present) is less than the diameter of the blades 815. In some embodiments, the diameter of the shaft 860 is about equal to the diameter of the blades 815. In yet other embodiments, the diameter of the shaft 860 is greater than the diameter of the blades 815.

FIG. 9A illustrates an embodiment of a working portion 905 of a cigar airflow adjustment instrument 900. FIG. 9B shows the cross section of the working portion 905 of FIG. 9A taken along line 9B-9B. FIG. 9C shows the cigar airflow adjustment instrument 900 inserted into an axial cross-section of a cigar 110. FIG. 9D shows the cigar airflow adjustment instrument 900 inserted into a longitudinal cross-section of a cigar 110 through the cut head 305 of the cigar 110. Working portion 905 is very similar to the working portion 805 of FIGS. 8A-8D except that one side of working portion 905 is flattened to form a non-cutting flat face 950 (shown clearly in FIG. 9B). The non-cutting flat face 950 may allow the working portion to better target certain portions of the tobacco filler in a cigar 110 because only certain portions of the working portion 905 may catch, cut, or pull tobacco. A user may direct only these portions of the working portion 905 toward the tobacco that needs to be loosened. The dark arrows in FIGS. 9C-9D illustrate tobacco within the cigar 110 pushing into the working portion recesses 910 and up against the non-cutting flat face 950 (shown in FIG. 5D protecting the tobacco near the center of the cigar 110).

Figures 10A, 10B:
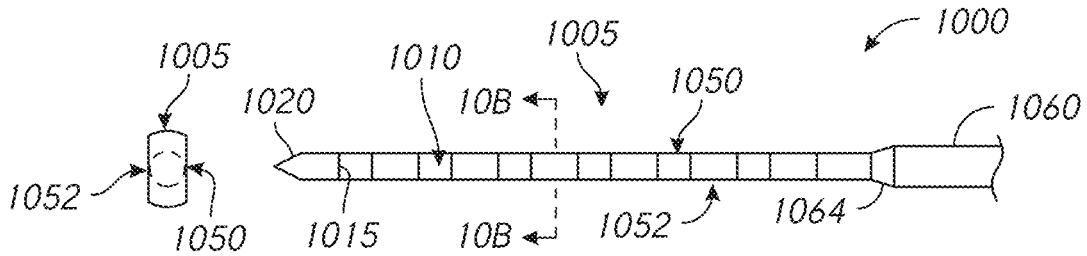
FIGS. 10A-10D are various views of another embodiment of a cigar airflow adjustment instrument.
Figures 10C, 10D:
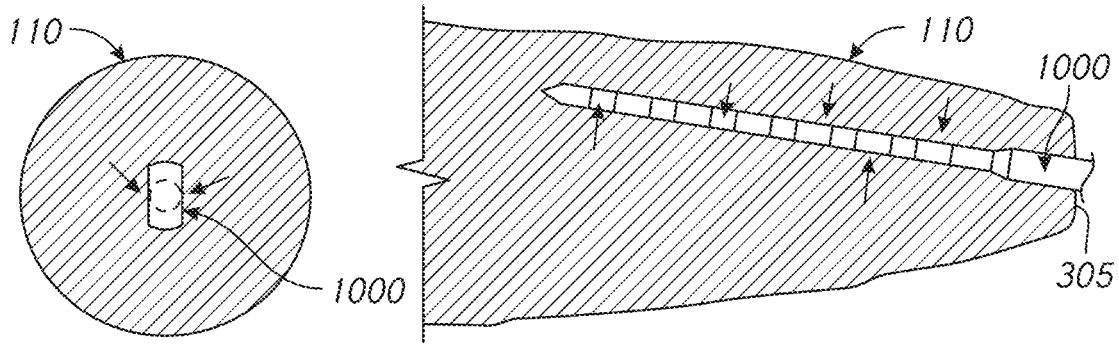

FIG. 10A illustrates an embodiment of a working portion 1005 of a cigar airflow adjustment instrument 1000. FIG. 10B shows the cross section of the working portion 1005 of FIG. 10A taken along line 10B-10B. FIG. 10C shows the cigar airflow adjustment instrument 1000 inserted into an axial cross-section of a cigar 110. FIG. 10D shows the cigar airflow adjustment instrument 1000 inserted into a longitudinal cross-section of a cigar 110 through the cut head 305 of the cigar 110. Working portion 1005 is very similar to the working portion 805 of FIGS. 8A-8D and the working portion 905 of FIGS. 9A-9D except that two sides of working portion 1005 are flattened to form a first non-cutting flat face 1050 and a second non-cutting flat face 1052 (shown clearly in FIG. 10B). The first non-cutting flat face 1050 and second non-cutting flat face 1052 may allow the working portion to better target certain portions of the tobacco filler in a cigar 110 because only certain portions of the working portion 1005 may catch, cut, or pull tobacco. A user may direct only these portions of the working portion 605 toward the tobacco that needs to be loosened. The dark arrows in FIGS. 10C-10D illustrate tobacco within the cigar 110 pushing up against the first non-cutting flat face 1050 and second non-cutting flat face 1052.

Figures 11A, 11B:
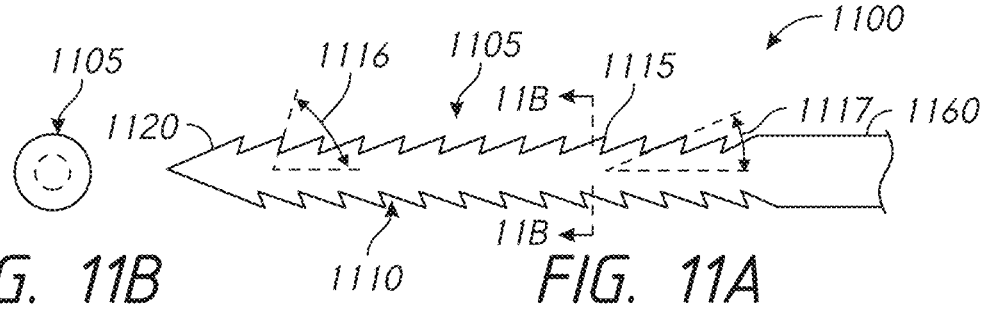
FIGS. 11A-11D are various views of another embodiment of a cigar airflow adjustment instrument.
Figures 11C, 11D:
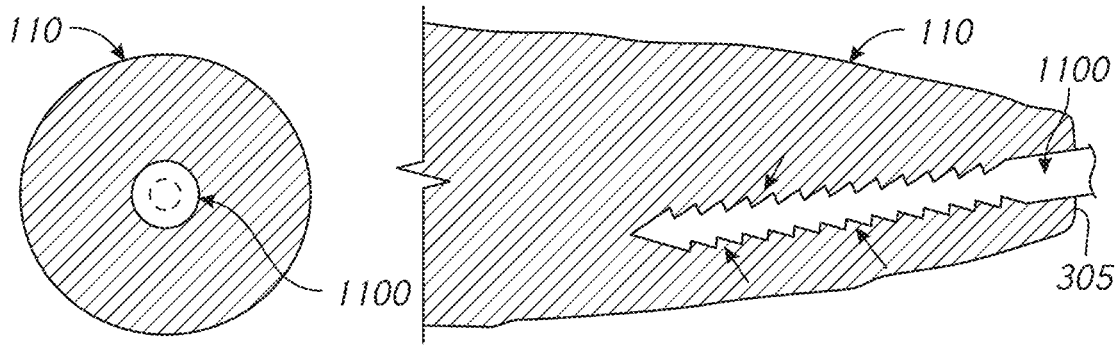

FIG. 11A illustrates an embodiment of a working portion 1105 of a cigar airflow adjustment instrument 1100. FIG. 11B shows the cross section of the working portion 1105 of FIG. 11A taken along line 11B-11B. FIG. 11C shows the cigar airflow adjustment instrument 1100 inserted into an axial cross-section of a cigar 110. FIG. 11D shows the cigar airflow adjustment instrument 1100 inserted into a longitudinal cross-section of a cigar 110 through the cut head 305 of the cigar 110. Working portion 1105 includes a pointed head 1120 and one or more blades 1115. In some embodiments, working portion 1105 includes a single, spiral blade 1115 wrapped around the length of the working portion 1105. In such embodiments, the spiral is defined at least partially by a pitch angle (as described with respect to FIGS. 4A-4D). In some embodiments, the one or more blades 1115 are not a single spiral wrapped around the length of the working portion 1105. In such embodiments, the blades 1115 are defined by shoulder angle 1116—increasing shoulder angle 1116 may create a smaller cavity (or no cavity) under/distal to the blade 1115, while decreasing the shoulder angle 1116 may produce a larger or sharper cavity under/distal to the blade 1115. In some embodiments, the shoulder angle 1116 is in the range of about 30-130 degrees, 40-120 degrees, about 50-110 degrees, about 60-100 degrees, about 70-95 degrees, and about 80-90 degrees, or any other angle that facilitates functioning of the devices disclosed herein. The blade 1115 is also defined by the blade angle 1117—a larger blade angle 1117 may cause the blades 1115 to "stand out" further from the inner rod, whereas a smaller blade angle 1117 may cause the blades 1115 to "lay closer" to the inner rod. In some embodiments, the blade angle 1117 is in the range of about 5-90 degrees, about 10-80 degrees, about 15-70 degrees, about 20-60 degrees, about 25-50 degrees, and about 30-40 degrees, or any other angle that facilitates functioning of the devices disclosed herein. The shoulder angle 1116 and blade angle 1117 illustrated are representative only and may be changed as desired to alter the characteristics of the device.

The number of blades 1115 determines the number of working portion recesses 1110. As described above, working portion recesses 1110 may help the working portion 1105 to catch, cut, and/or pull tobacco during use of the working portion 1105 in a cigar 110. Additionally, how much the blades 1115 stand out from the inner rod or lay closer to the inner rod may define how deep the working portion recesses 1110 are. The dark arrows in FIG. 11D illustrate tobacco within the cigar 110 pushing into the working portion recesses 1110.

The working portion 1105 is attached to a shaft 1160 as described above. In the embodiments shown in FIGS. 11A-11D, the shaft 1160 has a diameter that is about equal to the diameter of the blades 1115. In some embodiments, the diameter of the shaft 1160 (and consequently a neck, if one is present) is less than the diameter of the blades 1115. In some embodiments, the diameter of the shaft 1160 is about equal to the diameter of the blades 1115. In yet other embodiments, the diameter of the shaft 1160 is greater than the diameter of the blades 1115.

FIG. 12A illustrates an embodiment of a working portion 1205 of a cigar airflow adjustment instrument 1200. FIG. 12B shows the cross section of the working portion 1205 of FIG. 12A taken along line 12B-12B. FIG. 12C shows the cigar airflow adjustment instrument 1200 inserted into an axial cross-section of a cigar 110. FIG. 12D shows the cigar airflow adjustment instrument 1200 inserted into a longitudinal cross-section of a cigar 110 through the cut head 305 of the cigar 110. Working portion 1205 is very similar to the working portion 1105 of FIGS. 11A-11D except that the spiral of the blades 1215 stops short of the shoulder 1260 to leave a neck 1264 and an exposed inner rod 1262, which has a diameter smaller than the outer diameter of the blade 1215. Exposed inner rod 762 may act like a single, large working portion recess 1210: during use the area around the exposed inner rod 1262 may collect amounts of tobacco filler, larger than what the working portion recesses 1210 may collect. Therefore, the cigar airflow adjustment instrument 1200 having an exposed inner rod may be able to more efficiently remove tobacco from within the cigar 110. Additionally, like the working portion 1105, the working portion 1205 has a pointed head 1220 and one or more blades 1215. In some embodiments, working portion 1205 includes a single, spiral blade 1215 wrapped around the length of the working portion 1205. In such embodiments, the spiral is defined at least partially by a pitch angle (as described with respect to FIGS. 4A-4D). In some embodiments, the one or more blades 1215 are not a single spiral. In such embodiments, the blades 1215 may be defined by shoulder angle 1216 and a blade angle 1217 (similar to those shoulder angle and blade angle described with respect to FIGS. 11A-11D). The shoulder angle 1216 shown in FIG. 12A is approximate 90 degrees while the blade angle shown in FIG. 12A is about 30 degrees. Of course, these angles may have other values, as described above—the shoulder angle 1216 and blade angle 1217 illustrated are representative only and may be changed as desired to alter the characteristics of the device. The dark arrows in FIG. 12D illustrate tobacco within the cigar 110 pushing into the working portion recesses 1210 and up against the exposed inner rod 1262.

FIG. 13A illustrates an embodiment of a working portion 1305 of a cigar airflow adjustment instrument 1300. FIG. 13B shows the cross section of the working portion 1305 of FIG. 13A taken along line 13B-13B. FIG. 13C shows the cigar airflow adjustment instrument 1300 inserted into an axial cross-section of a cigar 110. FIG. 13D shows the cigar airflow adjustment instrument 1300 inserted into a longitudinal cross-section of a cigar 110 through the cut head 305 of the cigar 110. Working portion 1305 is very similar to the working portion 805 of FIGS. 8A-8D except that the shoulder angle 1316 of the blade 1315 shown in FIGS. 13A-13D is less than the shoulder angle 816 of the 816 shown in FIGS. 8A-8D. For example, the shoulder angle 816 of FIG. 8A is about 90 degrees, whereas the shoulder angle 1316 of FIG. 13A is about 80 degrees. As discussed above, the illustrated angles are not exclusive: the shoulder angle 1316 and blade angle 1317 illustrated are representative only and may be changed as desired to alter the characteristics of the device. The dark arrows in FIG. 13D illustrate tobacco within the cigar 110 pushing into the working portion recesses 1310.

Figure 14B:
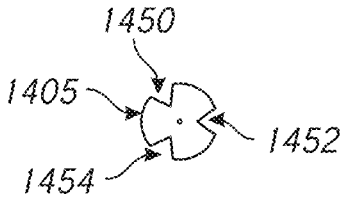
FIGS. 14A-14D are various views of another embodiment of a cigar airflow adjustment instrument.
Figure 14A:
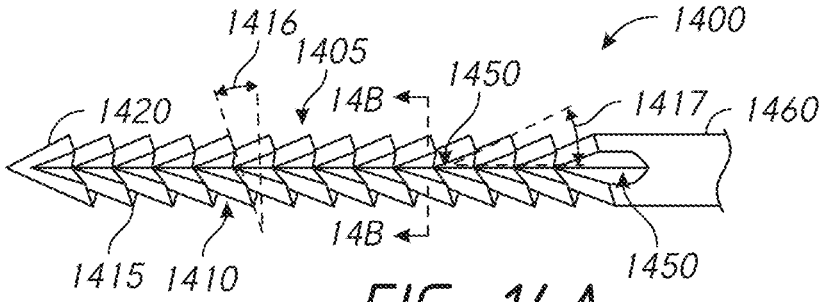
Figure 14C:
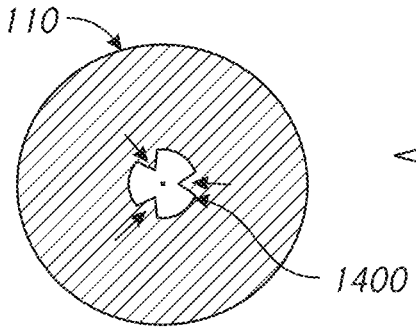
Figure 14D:
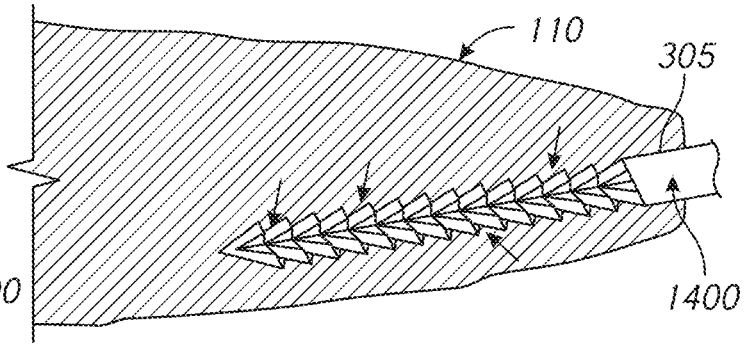

FIG. 14A illustrates an embodiment of a working portion 1405 of a cigar airflow adjustment instrument 1400. FIG. 14B shows the cross section of the working portion 1405 of FIG. 14A taken along line 14B-14B. FIG. 14C shows the cigar airflow adjustment instrument 1400 inserted into an axial cross-section of a cigar 110. FIG. 14D shows the cigar airflow adjustment instrument 1400 inserted into a longitudinal cross-section of a cigar 110 through the cut head 305 of the cigar 110. Working portion 1405 is very similar to the working portion 405 of FIGS. 4A-4D except the working portion 1405 includes three longitudinal v-grooves 1450, 1452, 1454 extending from just below the tip of the pointed head 1420, through the working portion 1405, and partially into the shaft 1460. FIG. 14A illustrates only a single v-groove 1450. All three v-groves are visible in the cross-sectional view of the working portion 1405 shown in FIGS. 14B and 14C. The v-grooves 1450, 1452, 1454 create more corners on the blade 1415. Therefore, a working portion with v-grooves 1450, 1452, 1454 may be more effective in catching, cutting, and/or pulling the filler tobacco during use. Therefore, a working portion with v-grooves 1450, 1452, 1454, such as 1405, may be more efficient at removing tobacco from within the cigar 110 than a working portion with no v-grooves 1450, 1452, 1454. The three v-grooves 1450, 1452, 1454 shown are approximately 30 degrees wide (similar to the v-groove angle 1818 shown in FIG. 18B). However, it should be understood that other numbers of v-grooves may be used, including 1 v-groove, 2 v-grooves, 4 v-grooves, and 5 v-grooves, or any other number of v-grooves that facilitates functioning of the devices disclosed herein. Additionally, it should be understood that other degrees of v-groove (or v-groove angle) may be used, including about 5-45 degrees, about 15-40 degrees, and about 20-35 degrees, or any other degree of v-groove that facilitates functioning of the devices disclosed herein. The dark arrows in FIGS. 14C-14D illustrate tobacco within the cigar 110 pushing into the working portion recesses 1410 (shown in FIG. 14D) and the v-grooves 1450, 1452, 1454 (shown in FIG. 14D).

Figure 15B:
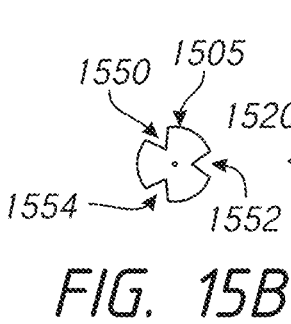
FIGS. 15A-15D are various views of another embodiment of a cigar airflow adjustment instrument.
Figure 15A:
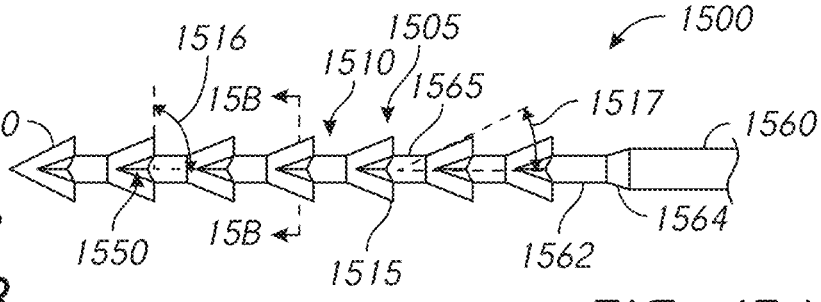
Figure 15C:
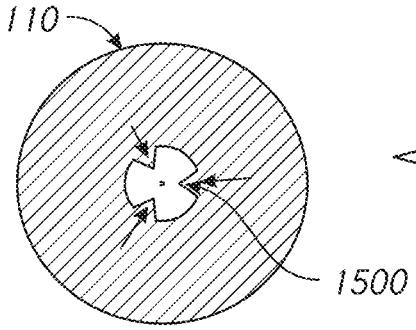
Figure 15D:
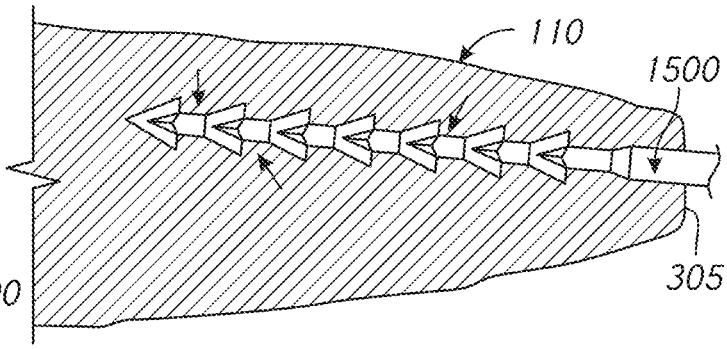

FIG. 15A illustrates an embodiment of a working portion 1505 of a cigar airflow adjustment instrument 1500. FIG. 15B shows the cross section of the working portion 1505 of FIG. 15A taken along line 15B-15B. FIG. 15C shows the cigar airflow adjustment instrument 1500 inserted into an axial cross-section of a cigar 110. FIG. 15D shows the cigar airflow adjustment instrument 1500 inserted into a longitudinal cross-section of a cigar 110 through the cut head 305 of the cigar 110. Working portion 1505 is very similar to the working portion 805 of FIGS. 8A-8D except that the working portion 1505 includes three v-grooves 1550, 1552, 1554, similar to those disclosed with respect to FIG. 14A. The dark arrows in FIGS. 15C-15D illustrate tobacco within the cigar 110 pushing into the working portion recesses 1510 (shown in FIG. 15D) and the v-grooves 1550, 1552, 1554 (shown in FIG. 15D).

Figures 16A, 16B:
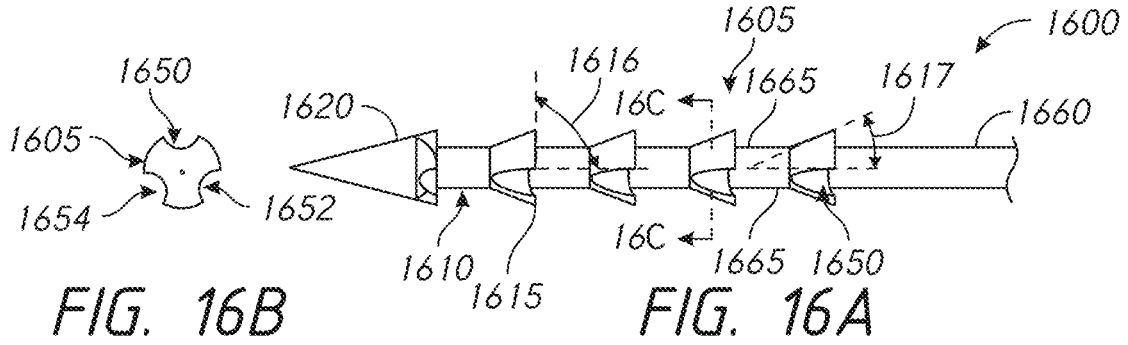
FIGS. 16A-16D are various views of another embodiment of a cigar airflow adjustment instrument.
Figures 16C, 16D:
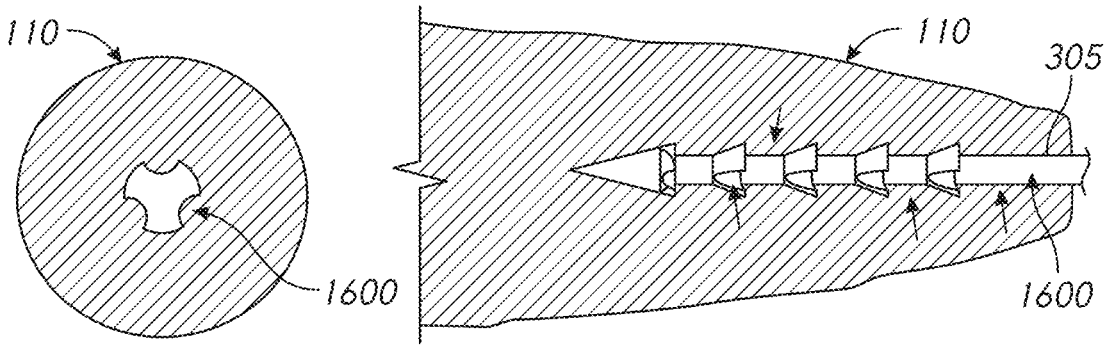

FIG. 16A illustrates an embodiment of a working portion 1605 of a cigar airflow adjustment instrument 1600. FIG. 16B shows the cross section of the working portion 1605 of FIG. 16A taken along line 16B-16B. FIG. 16C shows the cigar airflow adjustment instrument 1600 inserted into an axial cross-section of a cigar 110. FIG. 16D shows the cigar airflow adjustment instrument 1600 inserted into a longitudinal cross-section of a cigar 110 through the cut head 305 of the cigar 110. Working portion 1605 is very similar to the working portion 1505 of FIGS. 15A-15D except that instead of having three v-grooves 1550, 1552, 1554 (like the working portion 1505), working portion 1605 has three u-grooves 1650, 1652, 1654. The u-grooves 1650, 1652, 1654 function along similar principles to the v-grooves of prior embodiments. In the embodiment shown in FIGS. 16A-16D, the u-grooves 1650, 1652, 1654 extend into the blades 1615 approximate the depth of the inner rod 1665. It should be understood that the u-grooves 1650, 1652, 1654 may be deeper or shallower. Additionally, it should be understood that sharper or gentler slopes to the side of the "U" may be used. The dark arrows in FIGS. 16C-16D illustrate tobacco within the cigar 110 pushing into the working portion recesses 1610 (shown in FIG. 16D) and the u-grooves 1650, 1652, 1654 (shown in FIG. 16D).

Figures 17A, 17B:
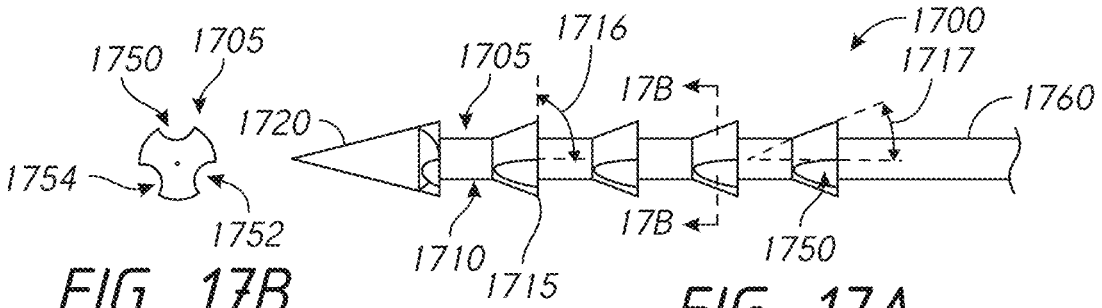
FIGS. 17A-17D are various views of another embodiment of a cigar airflow adjustment instrument.
Figures 17C, 17D:
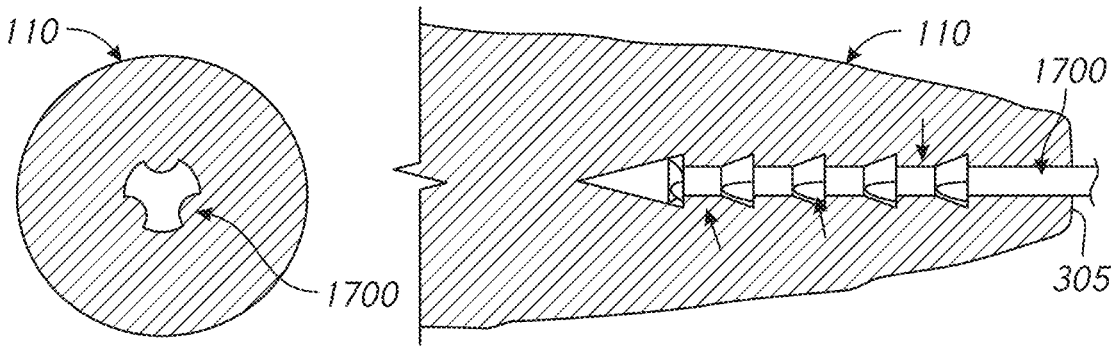

FIG. 17A illustrates an embodiment of a working portion 1705 of a cigar airflow adjustment instrument 1700. FIG. 17B shows the cross section of the working portion 1705 of FIG. 17A taken along line 17B-17B. FIG. 17C shows the cigar airflow adjustment instrument 1700 inserted into an axial cross-section of a cigar 110. FIG. 17D shows the cigar airflow adjustment instrument 1700 inserted into a longitudinal cross-section of a cigar 110 through the cut head 305 of the cigar 110. Working portion 1705 is very similar to the working portion 1605 of FIGS. 16A-16D except that the u-grooves 1750, 1752, 1754 are more shallow than the u-grooves 1650, 1652, 1654 shown in FIGS. 16A-16D. The dark arrows in FIGS. 17C-17D illustrate tobacco within the cigar 110 pushing into the working portion recesses 1710 (shown in FIG. 16D) and the u-grooves 1750, 1752, 1754 (shown in FIG. 17D).

Figure 18B:
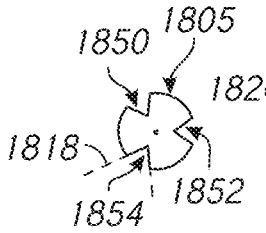
FIGS. 18A-18D are various views of another embodiment of a cigar airflow adjustment instrument.
Figure 18A:
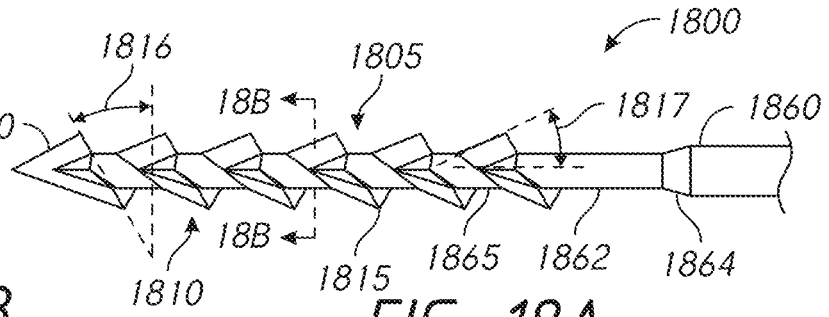
Figure 18C:
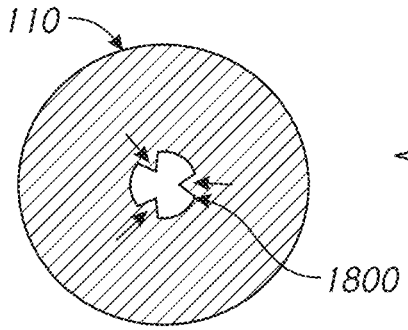
Figure 18D:
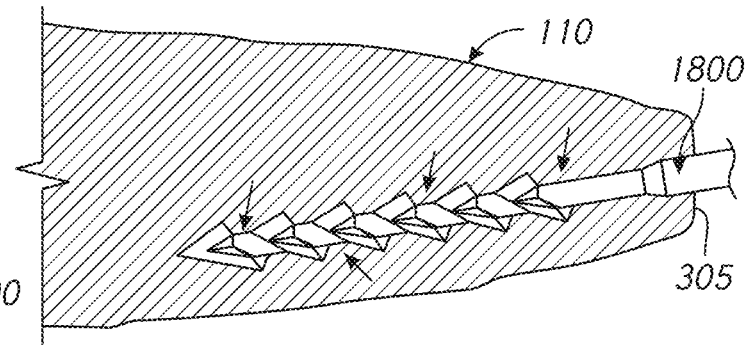

FIG. 18A illustrates an embodiment of a working portion 1805 of a cigar airflow adjustment instrument 1800. FIG. 18B shows the cross section of the working portion 1805 of FIG. 18A taken along line 18B-18B. FIG. 18C shows the cigar airflow adjustment instrument 1800 inserted into an axial cross-section of a cigar 110. FIG. 18D shows the cigar airflow adjustment instrument 1800 inserted into a longitudinal cross-section of a cigar 110 through the cut head 305 of the cigar 110. Working portion 1805 is very similar to the working portion 705 of FIGS. 7A-7D except that: 1) that the working portion 1805 includes three v-grooves 1850, 1852, 1854; and 2) the pitch angle 1816 of the working portion 1805 is greater. First, the v-grooves 1850, 1852, 1854 are similar to those described with respect to FIG. 14A-14D. The pitch angle 716 shown in FIGS. 7A-7D is small enough that each spiral sits just below the spiral immediately preceding it, thereby leaving none of the inner rod uncovered. By contrast, the pitch angle 1816 shown in FIGS. 18A-18D is large enough that sections of the inner rod 1865 are exposed between each spiral and the spiral immediately preceding it. Exposing the inner rod 1865 in this manner creates larger working portion recesses 1810 which may have the benefits discussed above. The dark arrows in FIGS. 18C-18D illustrate tobacco within the cigar 110 pushing into the working portion recesses 1810 (shown in FIG. 18D) and the v-grooves 1550, 1552, 1554 (shown in FIG. 18D).

Figure 19B:
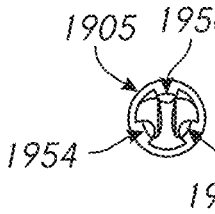
FIGS. 19A-19D are various views of another embodiment of a cigar airflow adjustment instrument.
Figure 19A:
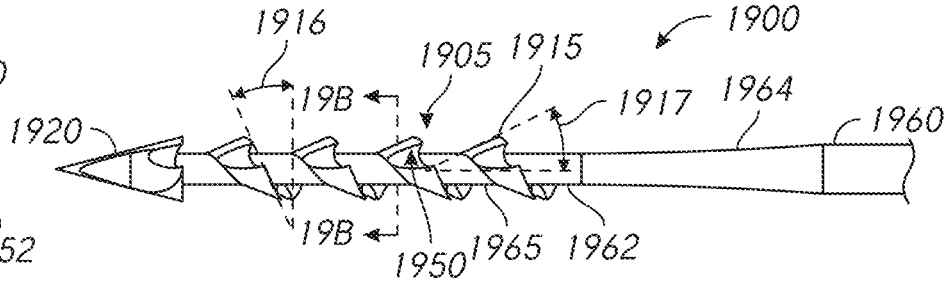
Figure 19C:
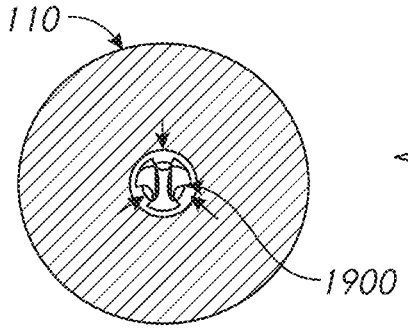
Figure 19D:
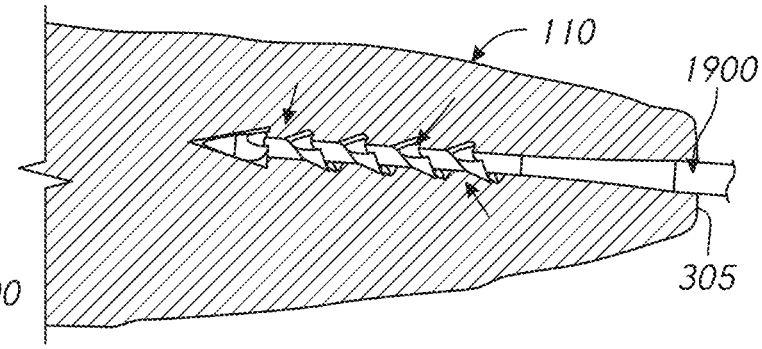

FIG. 19A illustrates an embodiment of a working portion 1905 of a cigar airflow adjustment instrument 1900. FIG. 19B shows the cross section of the working portion 1905 of FIG. 19A taken along line 19B-19B. FIG. 19C shows the cigar airflow adjustment instrument 1900 inserted into an axial cross-section of a cigar 110. FIG. 19D shows the cigar airflow adjustment instrument 1900 inserted into a longitudinal cross-section of a cigar 110 through the cut head 305 of the cigar 110. Working portion 1905 is very similar to the working portion 1805 of FIGS. 18A-18D except that instead of having three v-grooves, the working portion has three u-grooves 1950, 1952, 1954, similar to those described with respect to FIGS. 16A-16D. Additionally, the neck 1964 is longer and therefore more gently tapered than the neck 1864 shown in FIG. 18A. The dark arrows in FIGS. 19C-19D illustrate tobacco within the cigar 110 pushing into the working portion recesses 1910 (shown in FIG. 19D) and the u-grooves 1950, 1952, 1954 (shown in FIG. 19D).

FIG. 20A illustrates an embodiment of a working portion 2005 of a cigar airflow adjustment instrument 2000. FIG. 20B shows the cross section of the working portion 2005 of FIG. 20A taken along line 20B-20B. FIG. 20C shows the cigar airflow adjustment instrument 2000 inserted into an axial cross-section of a cigar 110. FIG. 20D shows the cigar airflow adjustment instrument 2000 inserted into a longitudinal cross-section of a cigar 110 through the cut head 305 of the cigar 110. Working portion 2005 is very similar to the working portion 705 of FIGS. 7A-7D except that the pitch angle 2016 of the working portion 2005 is greater. As mentioned above, the pitch angle 716 shown in FIGS. 7A-7D is small enough that each spiral sits just below the spiral immediately preceding it, thereby leaving none of the inner rod uncovered. Like the pitch angle 1816 of FIG. 18A, the pitch angle 2016 shown in FIGS. 20A-20D is large enough that sections of the inner rod 2065 are exposed between each spiral and spiral immediately preceding it. Exposing the inner rod 2065 in this manner creates larger working portion recesses 2010 which may have the benefits discussed above. The dark arrows in FIGS. 20C-20D illustrate tobacco within the cigar 110 pushing into the working portion recesses 2010 (shown in FIG. 20D).

FIG. 21A illustrates an embodiment of a working portion 2105 of a cigar airflow adjustment instrument 2100. FIG. 21B shows the cross section of the working portion 2105 of FIG. 21A taken along line 21B-21B. FIG. 21C shows the cigar airflow adjustment instrument 2100 inserted into an axial cross-section of a cigar 110. FIG. 21D shows the cigar airflow adjustment instrument 2100 inserted into a longitudinal cross-section of a cigar 110 through the cut head 305 of the cigar 110. Working portion 2105 is very similar to the working portion 1805 of FIGS. 18A-18D except that instead of having three v-grooves, the working portion 2005 has four rectangular-grooves 2150, 2152, 2154, 2156. The four rectangular-grooves 2150, 2152, 2154, 2156 shown are approximately 0.5 mm wide. However, it should be understood that other numbers of rectangular-grooves may be used, including 1 rectangular-groove, 2 rectangular-grooves, 3 rectangular-grooves, and 5 rectangular-grooves, or any other number of rectangular-grooves that facilitates functioning of the devices disclosed herein. Additionally, it should be understood that other widths (and depths) of rectangular-groove may be used, including about 0.2-2 mm, about 0.3 1.5 mm, about 0.4-1 mm, and about 0.5 mm, or any other width of rectangular-groove that facilitates functioning of the devices disclosed herein. The dark arrows in FIGS. 21C-21D illustrate tobacco within the cigar 110 pushing into the working portion recesses 2110 (shown in FIG. 21D) and the four rectangular-grooves 2150, 2152, 2154, 2156 (shown in FIG. 21D).

Figure 22B:
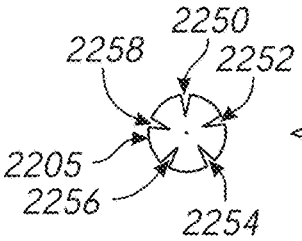
FIGS. 22A-22D are various views of another embodiment of a cigar airflow adjustment instrument.
Figure 22A:
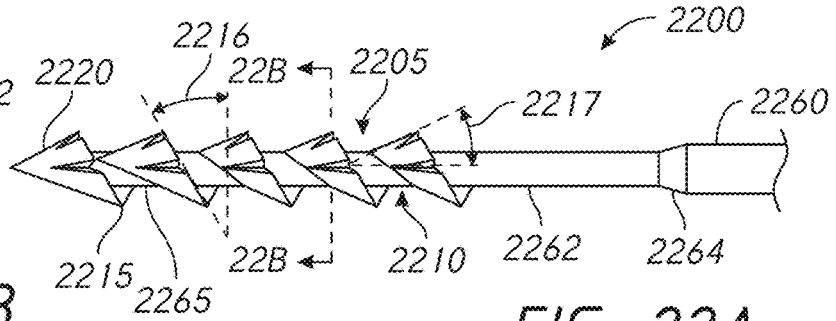
Figure 22C:
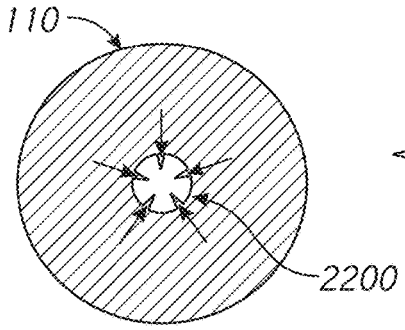
Figure 22D:
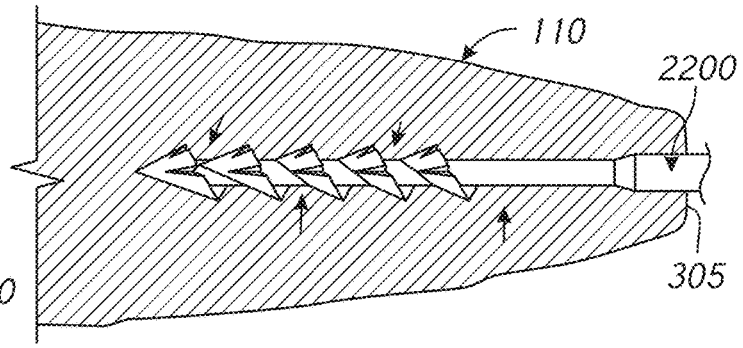

FIG. 22A illustrates an embodiment of a working portion 2205 of a cigar airflow adjustment instrument 2200. FIG. 22B shows the cross section of the working portion 2205 of FIG. 22A taken along line 22B-22B. FIG. 22C shows the cigar airflow adjustment instrument 2200 inserted into an axial cross-section of a cigar 110. FIG. 22D shows the cigar airflow adjustment instrument 2200 inserted into a longitudinal cross-section of a cigar 110 through the cut head 305 of the cigar 110. Working portion 2205 is very similar to the working portion 1805 of FIGS. 18A-18D except that instead of having three v-grooves, the working portion 2205 has five v-grooves 2250, 2252, 2254, 2256, 2258. Additionally, all five v-grooves 2250, 2252, 2254, 2256, 2258 have a narrower v-groove angle, as described with respect to FIGS. 14A-14D. In this case, the five v-grooves 2250, 2252, 2254, 2256, 2258 have a v-groove angle of about 15 degrees. The dark arrows in FIGS. 22C-22D illustrate tobacco within the cigar 110 pushing into the working portion recesses 2210 (shown in FIG. 22D) and the five v-grooves 2250, 2252, 2254, 2256, 2258 (shown in FIG. 22D).

Figure 23B:
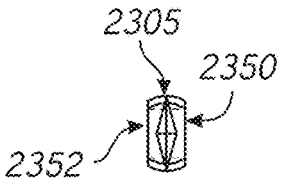
FIGS. 23A-23D are various views of another embodiment of a cigar airflow adjustment instrument.
Figure 23A:
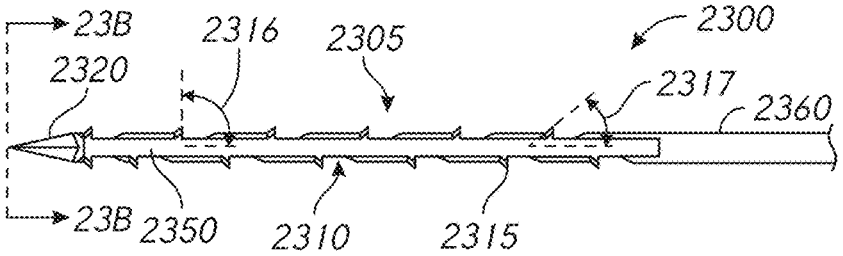
Figure 23C:
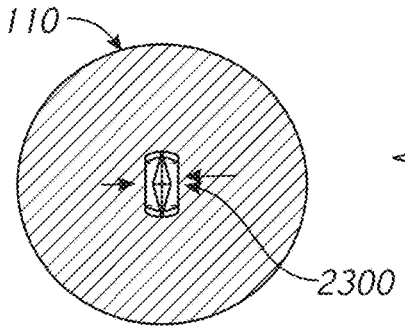
Figure 23D:
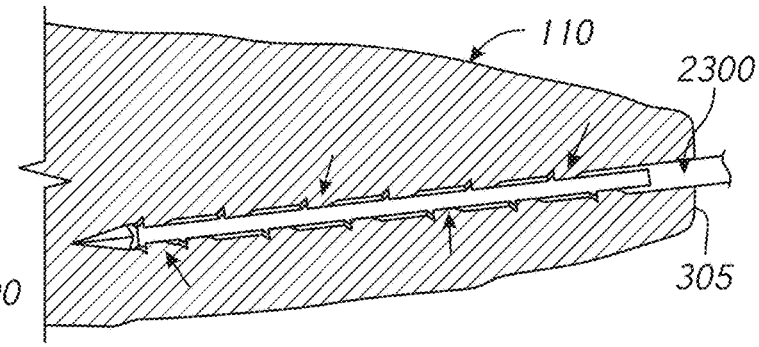

FIG. 23A illustrates an embodiment of a working portion 2305 of a cigar airflow adjustment instrument 2300. FIG. 23B shows a view of the front of the working portion 2305 of FIG. 23A taken along line 23B-23B. FIG. 23C shows the cigar airflow adjustment instrument 2300 inserted into an axial cross-section of a cigar 110. FIG. 23D shows the cigar airflow adjustment instrument 2300 inserted into a longitudinal cross-section of a cigar 110 through the cut head 305 of the cigar 110. Working portion 2305 includes a sharpened tip 2320, which may be narrower than other embodiments discussed above. The tip 2320 also includes a skirt blade, immediately behind the sharpened, thin tip 2320. Some embodiments of the tip 2320 do not include such a skirt blade. Behind the tip 2320, the working portion has a series of blades 2315 and working portion recesses 2310. The working portion 2305 of the cigar airflow adjustment instrument 2300 is flat on both sides, with first non-cutting flat face 2350 on one side and second non-cutting flat face 2352 on the other (this is shown particularly well in FIGS. 23B-23C). Potential benefits of having one or more non-cutting flat face are discussed above.

As can be see, the working portion 2305 includes a series of arcuate blades 2315. The blades 2315 are defined by a shoulder angle 2316, and a blade angle 2317, similar to the shoulder angle 1316 and blade angle 1317 of FIG. 13A. While other values are possible, the shoulder angle 2316 is about 90 degrees, while the blade angle 2317 is about 40 degrees. In the embodiment of the working portion shown in FIGS. 23A-23D, the working portion 2305 (behind the skirt blade) includes 11 blades 2315. Of course any number of blades may be included and the distance between blades may be decreased or increased. The number of blades 2315 determines the number of working portion recesses 2310. Additionally, how much the blades 2315 stand out from the inner rod or lay closer to the inner rod may define how deep the working portion recesses 2310 are—blades 2315 extending out far from the inner rod may create deep working portion recesses 2310 while blades 2315 remaining close to the inner rod may create shallow working portion recesses 2310. The dark arrows in FIG. 23D illustrate tobacco within the cigar 110 pushing into the working portion recesses 2310.

Figure 24B:
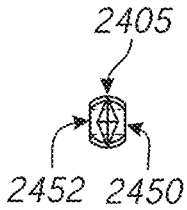
FIGS. 24A-24D are various views of another embodiment of a cigar airflow adjustment instrument.
Figure 24A:
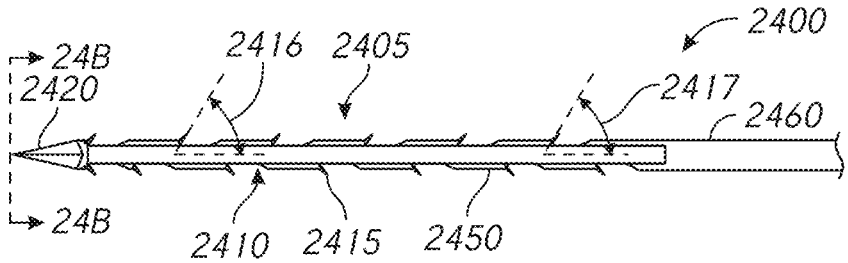
Figure 24C:
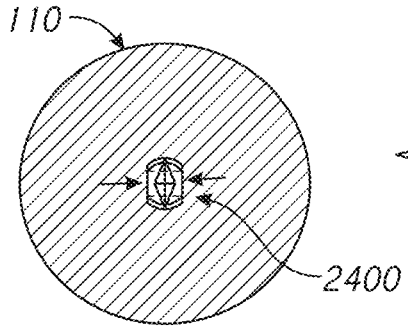
Figure 24D:
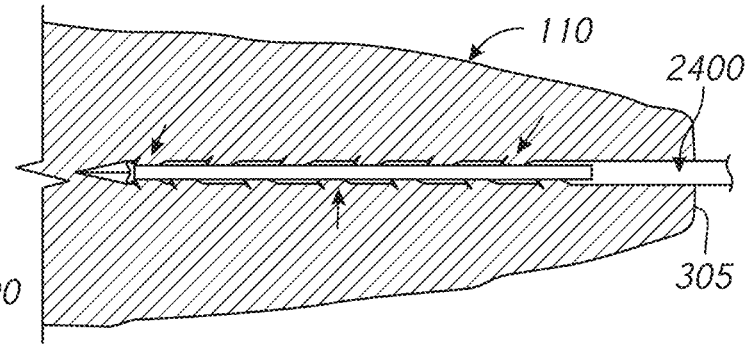

FIG. 24A illustrates an embodiment of a working portion 2405 of a cigar airflow adjustment instrument 2400. FIG. 24B shows a view of the front of the working portion 2405 of FIG. 24A taken along line 24B-24B. FIG. 24C shows the cigar airflow adjustment instrument 2400 inserted into an axial cross-section of a cigar 110. FIG. 24D shows the cigar airflow adjustment instrument 2400 inserted into a longitudinal cross-section of a cigar 110 through the cut head 305 of the cigar 110. Working portion 2405 is very similar to the working portion 2305 of FIGS. 23A-23D except that the shoulder angle 2416 and blade angle 2417 have been changed. Where the shoulder angle 2316 and blade angle 2317 of the working portion 2305 of FIG. 23A were about 90 degrees and 40 degrees, respectively. By contrast, the shoulder angle 2416 and blade angle 2417 of the working portion 2405 of FIG. 24A are about 70 degrees and 50 degrees, respectively. Such a change in degrees causes the blades 2415 to be sharper and have a small cavity under the blade 2415. As discussed with respect to the figures above, such a cavity or space under the blade 2415 may allow the cigar airflow adjustment instrument 2400 to more efficiently cut, pull, tear, or remove tobacco from the interior of the cigar 110. The dark arrows in FIG. 24D illustrate tobacco within the cigar 110 pushing into the working portion recesses 2410.

Figure 25B:
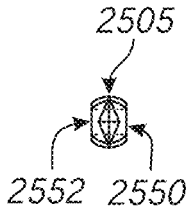
FIGS. 25A-25D are various views of another embodiment of a cigar airflow adjustment instrument.
Figure 25A:
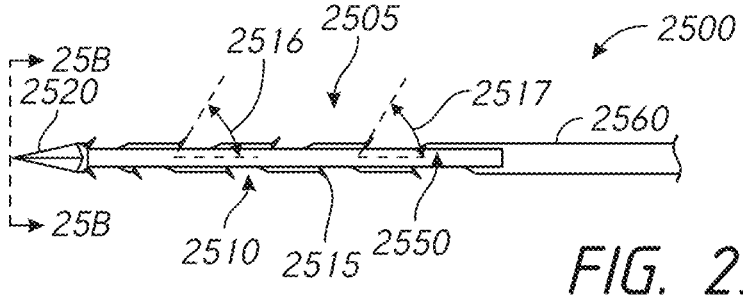
Figure 25C:
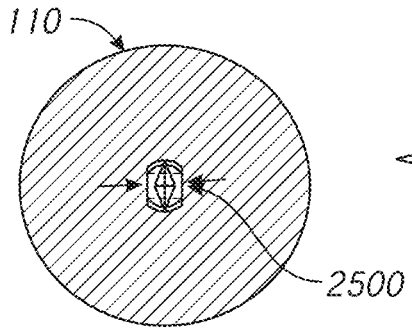
Figure 25D:
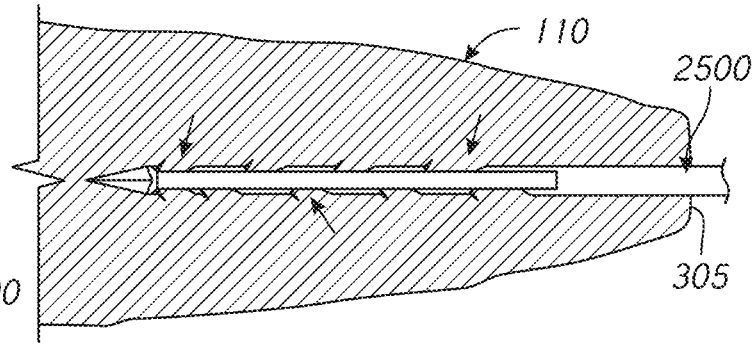

FIG. 25A illustrates an embodiment of a working portion 2505 of a cigar airflow adjustment instrument 2500. FIG. 25B shows a view of the front of the working portion 2505 of FIG. 25A taken along line 25B-25B. FIG. 25C shows the cigar airflow adjustment instrument 2500 inserted into an axial cross-section of a cigar 110. FIG. 25D shows the cigar airflow adjustment instrument 2500 inserted into a longitudinal cross-section of a cigar 110 through the cut head 305 of the cigar 110. Working portion 2505 is very similar to the working portion 2405 of FIGS. 24A-24D except that the working portion has fewer blades 2515 and working portion recesses 2510. While the working portion 2405 of the cigar airflow adjustment instrument 2400 shown in FIG. 24A has 11 blades 2415, the working portion 2505 of the cigar airflow adjustment instrument 2500 shown in FIG. 25A has only 7 blades 2515. The dark arrows in FIG. 25D illustrate tobacco within the cigar 110 pushing into the working portion recesses 2510.

Figure 26A:
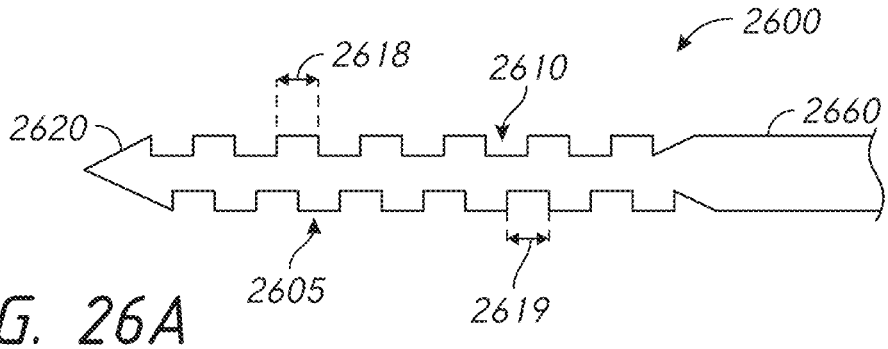
FIGS. 26A-26B are various views of another embodiment of a cigar airflow adjustment instrument.
Figure 26B:
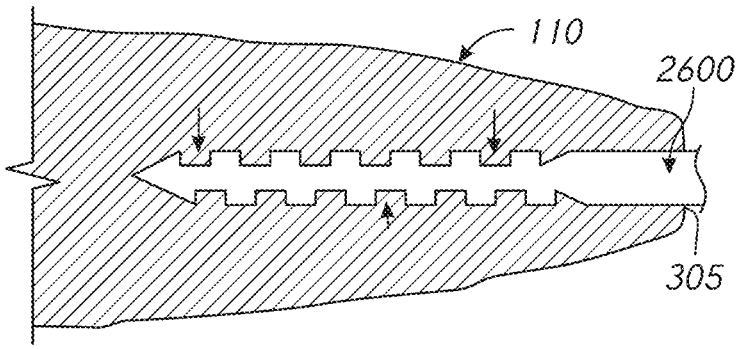

FIG. 26A illustrates an embodiment of a working portion 2605 of a cigar airflow adjustment instrument 2600. FIG. 26B shows the cigar airflow adjustment instrument 2600 inserted into a longitudinal cross-section of a cigar 110 through the cut head 305 of the cigar 110. Working portion 2605 includes a sharpened tip 2620 so as to ease the insertion of the cigar airflow adjustment instrument 2600 through the tobacco of the cigar 110. Unlike several other embodiments discussed above, the cigar airflow adjustment instrument 2600 does not includes blades in the standard sense. Instead, the working portion 2605 of the cigar airflow adjustment instrument 2600 includes one or more rectangular teeth and one or more recesses between the rectangular teeth. The rectangular teeth may be defined by a tooth width 2618, a tooth height (the distance the tooth rises from the inner rod of the working portion 2605), and a recess width 2619. The tooth width 2618 may be in the range of about 1-10 mm, about 1.5-9 mm, about 2-8 mm, about 2.5-8 mm, about 3-6 mm, and about 3.5-5 mm or any other width that facilitates functioning of the devices disclosed herein. In much the same way, the recess width 2619 may be in the range of about 1-10 mm, about 1.5-9 mm, about 2-8 mm, about 2.5-8 mm, about 3-6 mm, and about 3.5-5 mm or any other width that facilitates functioning of the devices disclosed herein. And, the tooth height may be in the range of about 0.1-3 mm, about 0.2-2.5 mm, about 0.3-2 mm, about 0.4-1.5 mm and about 0.5-1 mm, or any other height which facilitates functioning of the devices disclosed herein. Some embodiments of the working portion 2605 may have more teeth or fewer teeth.

The corners of the teeth may serve much the same function as the blades of other embodiments. That is, the teeth and working portion recesses may help the working portion 2605 to catch, cut, and/or pull tobacco during use of the working portion 2605 in a cigar 110. As discussed above, the working portion recesses may help with the functions of catching, cutting, and/or pulling, but they may also act as reservoirs to pull tobacco out of the cigar 110 (as is discussed with respect to other embodiments). The dark arrows in FIG. 26B illustrate tobacco within the cigar 110 pushing into the working portion recesses where it may be caught, pulled, or cut by the recesses and the corners of the teeth.

Figure 27A:
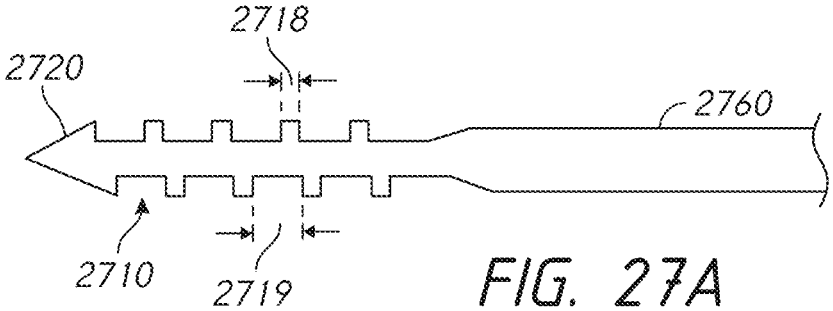
FIGS. 27A-27B are various views of another embodiment of a cigar airflow adjustment instrument.
Figure 27B:
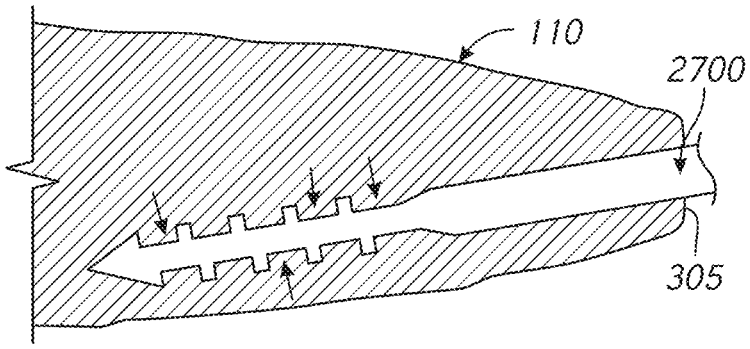

FIG. 27A illustrates an embodiment of a working portion 2705 of a cigar airflow adjustment instrument 2700. FIG. 27B shows the cigar airflow adjustment instrument 2700 inserted into a longitudinal cross-section of a cigar 110 through the cut head 305 of the cigar 110. Working portion 2705 is very similar to the working portion 2605 of FIGS. 26A-26D except that its tooth width 2718 is narrower, its recess width 2719 is wider, and it has fewer teeth and recesses. The dark arrows in FIG. 27B illustrate tobacco within the cigar 110 pushing into the working portion recesses where it may be caught, pulled, or cut by the recesses and the corners of the teeth.

Figure 28A:
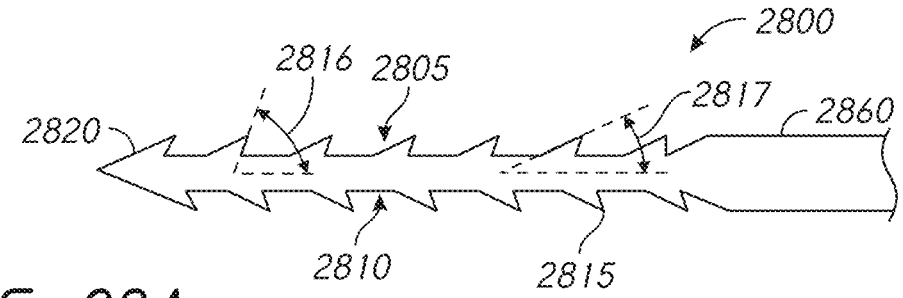
FIGS. 28A-28B are various views of another embodiment of a cigar airflow adjustment instrument.
Figure 28B:
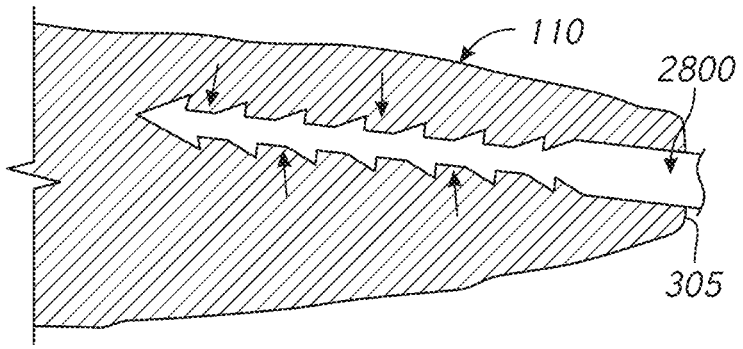

FIG. 28A illustrates a cross-sectional view of an embodiment of a working portion 2805 of a cigar airflow adjustment instrument 2800. FIG. 28B shows the cigar airflow adjustment instrument 2800 inserted into a longitudinal cross-section of a cigar 110 through the cut head 305 of the cigar 110. Working portion 2805 is very similar to the working portion 2005 of FIGS. 20A-20D except that the shoulder angle 2816 of the blade 2815 shown in FIGS. 28A-28D is shown as being less than the shoulder angle 2016 of the 2016 shown in FIGS. 20A-20D. The cross-sectional view of FIG. 28A allows a clear view of the shoulder angle 2816. In this case, the shoulder angle is about 80 degrees. However, as discussed above with respect to other embodiments, other shoulder angles may be used. The dark arrows in FIG. 28D illustrate tobacco within the cigar 110 pushing into the working portion recesses 2810.

Figure 29B:
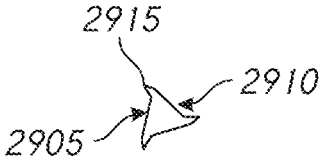
FIGS. 29A-29D are various views of another embodiment of a cigar airflow adjustment instrument.
Figure 29A:
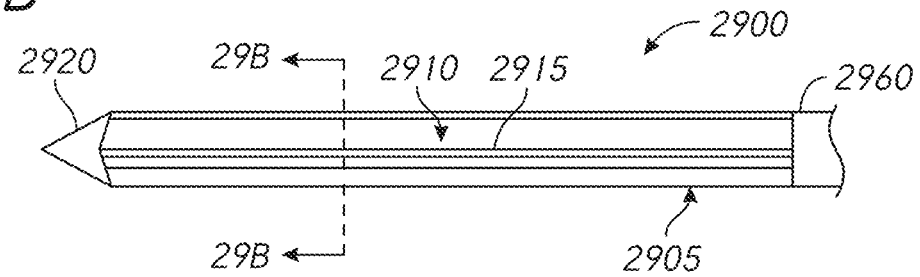
Figure 29C:
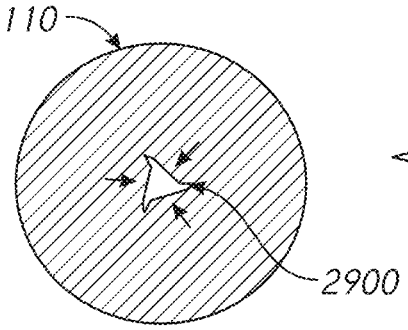
Figure 29D:
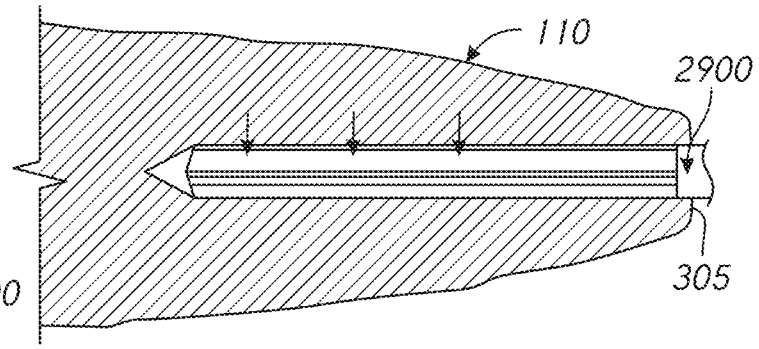

FIG. 29A illustrates an embodiment of a working portion 2905 of a cigar airflow adjustment instrument 2900. FIG. 29B shows the cross section of the working portion 2905 of FIG. 29A taken along line 29B-29B. FIG. 29C shows the cigar airflow adjustment instrument 2900 inserted into an axial cross-section of a cigar 110. FIG. 29D shows the cigar airflow adjustment instrument 2900 inserted into a longitudinal cross-section of a cigar 110 through the cut head 305 of the cigar 110. Working portion 2905 includes a sharpened tip 2920, and three longitudinal blades 2915 that extend out from the inner rod at a slight angle (shown in FIG. 29B). The three longitudinal blades 2915 create three longitudinal recesses 2910. The cigar airflow adjustment instrument 2900 illustrated in FIGS. 29A-29D may be used by inserting it into the cigar 110 as described above, then using predominantly rotation motions to catch, cut, and/or pull the tobacco. Unlike other embodiments disclosed herein, pushing and pulling motions of the working portion 2905 may diminished effectiveness in catching, cutting, and/or pulling the tobacco in the cigar 110. The dark arrows in FIGS. 29C-29D illustrate tobacco within the cigar 110 pushing into the working portion recesses 2910 (this is particularly well illustrated in FIG. 29C).

Figure 30B:
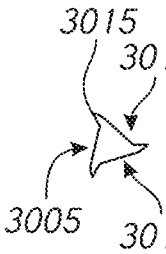
FIGS. 30A-30D are various views of another embodiment of a cigar airflow adjustment instrument.
Figure 30A:
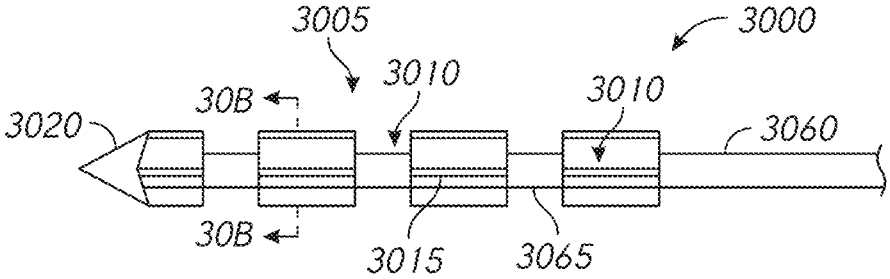
Figure 30C:
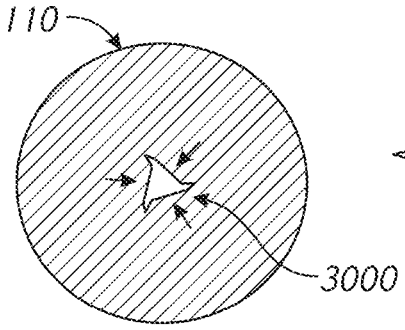
Figure 30D:
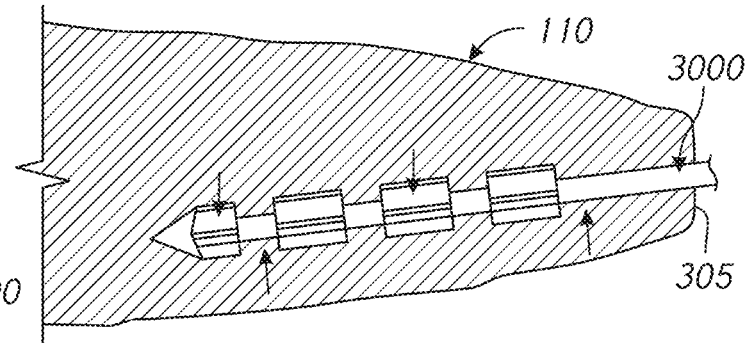

FIG. 30A illustrates an embodiment of a working portion 3005 of a cigar airflow adjustment instrument 3000. FIG. 30B shows the cross section of the working portion 3005 of FIG. 30A taken along line 30B-30B. FIG. 30C shows the cigar airflow adjustment instrument 3000 inserted into an axial cross-section of a cigar 110. FIG. 30D shows the cigar airflow adjustment instrument 3000 inserted into a longitudinal cross-section of a cigar 110 through the cut head 305 of the cigar 110. Working portion 3005 is very similar to the working portion 2905 of FIGS. 29A-29D except that the working portion 3005 has one or more discontinuities in its three longitudinal blades 1015, which leaves exposed portions of the inner rod 3065. FIG. 30A shows a working portion 3005 having three discontinuities. However, there may be more, and there may be less. In some embodiments, there is/are 1 discontinuity, 2 discontinuities, 4 discontinuities, 5 discontinuities, or any number of discontinuities that facilitates functioning of the systems disclosed herein. Incorporation of discontinuities into the longitudinal blades 3015 may make the working portion increasingly effective during pushing and pulling motions. When pushing, pulling, and/or rotating the working portion 3005, the longitudinal blades 3015 may cut the tobacco, while the discontinuities (and the edges of the blades 3015 they create) may catch, cut, and/or pull the tobacco so that it may be removed from within the cigar 110, thereby improving the draw of the cigar. The dark arrows in FIG. 30D illustrate tobacco within the cigar 110 pushing into the working portion recesses 3010 and into the discontinuities to reach the inner rod 3065.

Figure 31B:
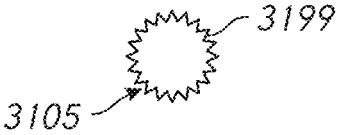
FIGS. 31A-31D are various views of another embodiment of a cigar airflow adjustment instrument.
Figure 31A:
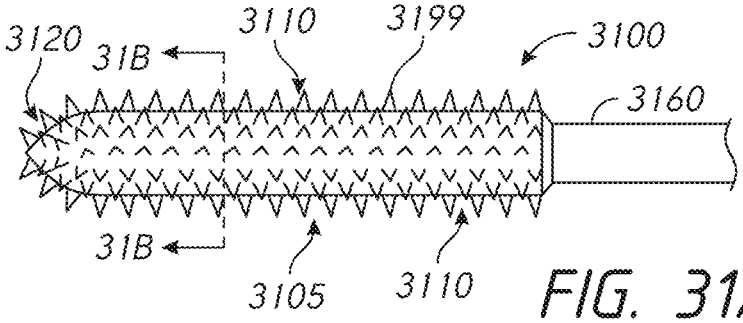
Figure 31C:
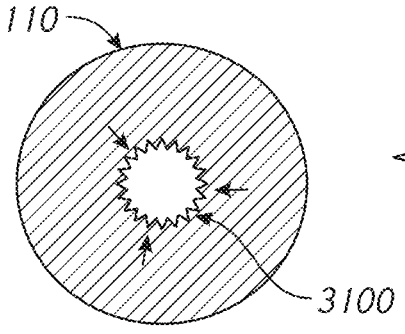
Figure 31D:
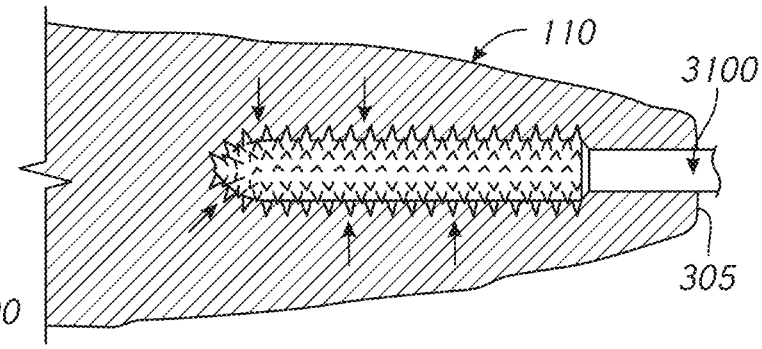

FIG. 31A illustrates an embodiment of a working portion 3105 of a cigar airflow adjustment instrument 3100. FIG. 31B shows the cross section of the working portion 3105 of FIG. 31A taken along line 31B-31B. FIG. 31C shows the cigar airflow adjustment instrument 3100 inserted into an axial cross-section of a cigar 110. FIG. 31D shows the cigar airflow adjustment instrument 3100 inserted into a longitudinal cross-section of a cigar 110 through the cut head 305 of the cigar 110. Working portion 3105 includes multiple spikes 3199, which define therebetween multiple recesses 3110. The tip 3120 of the working portion 3105 may also be covered in spikes 3199 (as shown in FIG. 31A). Alternatively, only the lateral surfaces of the working portion 3105 may be covered in spikes 3199. The combination of the multiple spikes 3199 and the multiple recesses 3110 may allow the working portion to catch tobacco, then shred, cut, and/or pull the tobacco as the working portion is pushed, pulled, and/or rotated in the cigar 110. In some embodiments, the spikes have a backward slant (not shown) to ease entry into the cigar 110. The dark arrows in FIGS. 31C-31D illustrate tobacco within the cigar 110 pushing into the working portion recesses 3110 between spikes 3199.

Figure 32B:
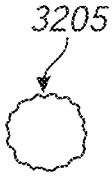
FIGS. 32A-32D are various views of another embodiment of a cigar airflow adjustment instrument.
Figure 32A:
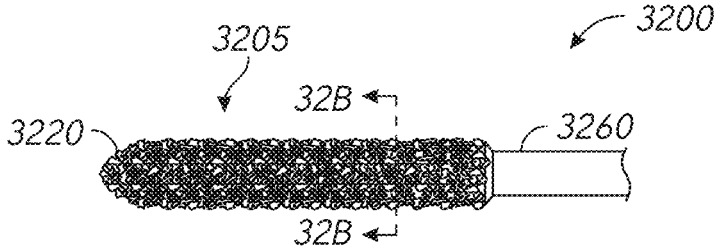
Figure 32C:
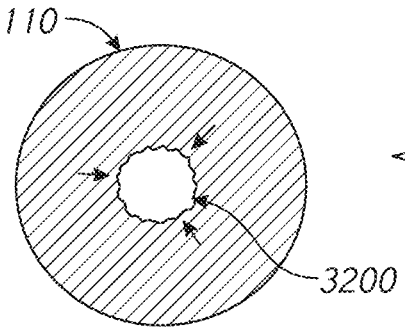
Figure 32D:
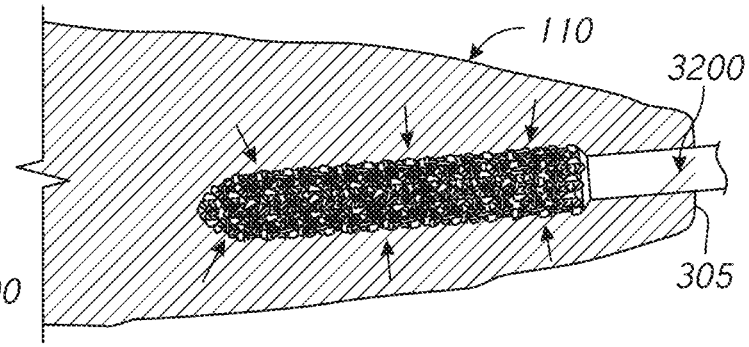

FIG. 32A illustrates an embodiment of a working portion 3205 of a cigar airflow adjustment instrument 3200. FIG. 32B shows the cross section of the working portion 3205 of FIG. 32A taken along line 32B-32B. FIG. 32C shows the cigar airflow adjustment instrument 3200 inserted into an axial cross-section of a cigar 110. FIG. 32D shows the cigar airflow adjustment instrument 3200 inserted into a longitudinal cross-section of a cigar 110 through the cut head 305 of the cigar 110. Working portion 3205 is similar to the working portion 3105 of FIGS. 31A-31D except that instead of having spikes 3199 covering its surface, the working portion 3205 is covered with a rough, pebbly, textured surface. The rough, pebbly, textured surface, may allow the working portion to catch, shred, grind, grate, cut, and/or pull the tobacco as the working portion 3205 is pushed, pulled, and/or rotated in the cigar 110. The dark arrows in FIGS. 31C-31D illustrate tobacco within the cigar 110 pushing up against the rough, pebbly, textured surface of the working portion 3205.

FIG. 33A-33E illustrate an embodiment of a flat cutting tip 3320 for the working portion 3305 of a cigar airflow adjustment instrument, including several of those disclosed herein. The flat cutting tip 3320 includes a pointed tip 3321 that extends backwards with two edges 3322. FIG. 33A illustrates the flat cutting tip 3320 from the broad side, so that the entire broad surface of the flat cutting tip 3320 may be seen. FIG. 33B shows a view of the front of the flat cutting tip 3320 of FIG. 33A taken along line 33B-33B. FIG. 33C shows the flat cutting tip 3320 of FIG. 33A rotated by 90 degrees about its longitudinal axis so that only the side of the flat cutting tip 3320 may be seen. FIG. 33D shows a view of the front of the flat cutting tip 3320 of FIG. 33C taken along line 33D-33D.

In some embodiments, the edges 3322 are merely thin, extending backwards from the pointed tip 3321 to the rest of the working portion 3305. In other embodiments, the edges 3322 are sharpened, extending backwards from the pointed tip 3321 to the rest of the working portion 3305. As shown in FIG. 33E, some embodiments of the flat cutting tip 3320 have serrated edges 3322. Such serrations may be pointed or rounded. Additionally, the serrations may be either straight edged or sharpened. Serrations may advantageously pull on the tobacco more as the flat cutting tip 3320 and working portion 3305 are being rotated, thereby improving function of the working portion 3305 and the cigar airflow adjustment instrument as a whole.

The shape of the flat cutting tip 3320 may allow it to be inserted into or under clumps of tobacco that have been excessively packed at the cut or punched head of a cigar. The flat cutting tip 3320 may be easier to maneuver and insert than other tips disclosed herein. When inserting the working portion 3305 into a cigar with the intention of removing tobacco from the inside of the cigar, the sharp and flattened flat cutting tip 3320, when rotated, may be able cut and pull off filler tobacco, making room to advance the working portion 3305 deeper into the cigar. Furthermore, the excess bits of tobacco generated by the working portion 3305 may accumulate on the flattened sides of the flat cutting tip 3320 which may help decrease or prevent additional outward force and expansion of the tobacco filler or breakage/cracking of the cigar's wrapper. By contrast, inserting a cigar airflow adjustment instruments having a conical tip into the center of the cigar may force filler tobacco outwards, thereby creating an even tighter packing of tobacco and expanding the tobacco. This could cause breaking or cracking of the cigar's fragile wrapper, which may destroy the cigar. Additionally, in some embodiments, the flat cutting tip 33230 may allow more targeted removal of tobacco filler from within a cigar. For example, inserting the flat cutting tip 3320 of the instrument under a clump may advantageously permit the working portion 3305 to simply lift that specific clump out of the cigar.

FIGS. 34A-34D illustrate various views of a cigar airflow adjustment instrument 3400 incorporating a flat cutting tip 3320. FIG. 34A shows a cigar airflow adjustment instrument 3400 with a flat cutting tip 3320 from the broad side so that the entire flat surface of the flat cutting tip 3320 may be seen (similar to FIG. 33A). FIG. 34B shows a view of the front of the cigar airflow adjustment instrument 3400 of FIG. 34A taken along line 34B-34B. FIG. 34C shows a cigar airflow adjustment instrument 3400 the same as in FIG. 34A except that the flat cutting tip 3320 has serrations. Finally, FIG. 34D shows a view of the front of the cigar airflow adjustment instrument 3400 of FIG. 34C taken along line 34D-34D.

Working portion 3405 of the cigar airflow adjustment instrument 3400 includes a flat cutting tip 3320 (shown in FIG. 34A with sharpened sides without serrations, and in FIG. 34C with serrations). Working portion 3405 also includes multiple petal blades 3415. Like embodiments described above, the petal blades have a blade angle 3476 (similar to the blade angles described above with respect to several other embodiments). However, unlike some of the embodiments described above, the petal blades 3415 are U-shaped or parabolic sharpened leaflets lifted from the body of the working portion 3405. The petal blades 3415 may be formed by making a cut into the working portion and lifting the cut portion to the blade angle 3476 to form the cutting portion of the petal blade 3415 and the recess 3410 under the petal blade. The cigar airflow adjustment instrument 3400 works in substantially the same fashion as has been described above with respect to other embodiments.

It is understood that any specific order or hierarchy of steps in any disclosed process is an example of a sample approach. Based upon design preferences, it is understood that the specific order or hierarchy of steps in the processes may be rearranged while remaining within the scope of the present disclosure. The accompanying method claims present elements of the various steps in a sample order, and are not meant to be limited to the specific order or hierarchy presented.

Various modifications to the implementations described in this disclosure may be readily apparent to those skilled in the art, and the generic principles defined herein may be applied to other implementations without departing from the spirit or scope of this disclosure. Thus, the disclosure is not intended to be limited to the implementations shown herein, but is to be accorded the widest scope consistent with the claims, the principles, and the novel features disclosed herein. The word "example" is used exclusively herein to mean "serving as an example, instance, or illustration." Any implementation described herein as "example" is not necessarily to be construed as preferred or advantageous over other implementations.

Certain features that are described in this specification in the context of separate implementations also can be implemented in combination in a single implementation. Conversely, various features that are described in the context of a single implementation also can be implemented in multiple implementations separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products. Additionally, other implementations are within the scope of the following claims. In some cases, the actions recited in the claims can be performed in a different order and still achieve desirable results.

What is claimed is:

1. An instrument for adjusting the draw of a cigar comprising:

a shaft;

a neck attached to the distal end of the shaft; and a working portion attached to the distal end of the neck, the working portion configured to be inserted into a cigar after the cigar has been made to catch or pull tobacco within the cigar, and wherein the working portion comprises a body and one or more structures that extend outward and away from the body.

2. The instrument for adjusting the draw of a cigar of claim 1, wherein the working portion comprises at least one of a corner, a blade, a spike, and a recess.

3. The instrument for adjusting the draw of a cigar of claim 1, wherein the working portion comprises a pointed tip, and a spiral blade extending from behind the pointed tip posteriorly towards the distal end of the neck.

4. The instrument for adjusting the draw of a cigar of claim 3, wherein the pointed tip and spiral blade comprise at least one groove.

5. The instrument for adjusting the draw of a cigar of claim 3 wherein the spiral blade extends to the distal end of the neck.

6. The instrument for adjusting the draw of a cigar of claim 3, wherein the spiral blade stops before reaching the distal end of the neck, thereby exposing at least a portion of an inner rod between the spiral blade and the distal portion of the neck.

7. The instrument for adjusting the draw of a cigar of claim 4, wherein the at least one groove is longitudinal.

8. The instrument for adjusting the draw of a cigar of claim 4, wherein the at least one groove is at least one of a U-shaped groove and a V-shaped groove.

9. The instrument for adjusting the draw of a cigar of claim 1, wherein the working portion comprises a pointed tip, an inner rod, and at least one discrete blade encircling the inner rod.

10. The instrument for adjusting the draw of a cigar of claim 9, wherein the pointed tip and at least one discrete blade comprise at least one groove.

11. The instrument for adjusting the draw of a cigar of claim 10, wherein the at least one groove is longitudinal.

12. The instrument for adjusting the draw of a cigar of claim 11, wherein the at least one groove is at least one of a U-shaped groove and a V-shaped groove.

13. The instrument for adjusting the draw of a cigar of claim 9, wherein the at least one discrete blade comprises sufficient discrete blades to cover the inner rod from behind the pointed tip to the distal end of the neck.

14. The instrument for adjusting the draw of a cigar of claim 9, wherein the at least one discrete blade comprises sufficient discrete blades spaced from behind the pointed tip to the distal end of the neck such that at least one portion of the inner rod remains exposed.

15. The instrument for adjusting the draw of a cigar of claim 9, wherein the at least one discrete blade does not cover at least a portion of the inner rod adjacent the neck.

16. The instrument for adjusting the draw of a cigar of claim 1, wherein the working portion comprises a plurality of spikes.

17. The instrument for adjusting the draw of a cigar of claim 16, wherein the plurality of spikes comprise small spikes covering the surface of the working portion.

18. The instrument for adjusting the draw of a cigar of claim 1, wherein the working portion comprises a flattened pointed tip.

19. The instrument for adjusting the draw of a cigar of claim 18, wherein the flattened pointed tip comprises at least one of sharpened sides and serrated sides.

20. A tool for removing tobacco from within a cigar comprising:

a handle;

an elongate shaft connected to the handle; and a tobacco removing portion configured to remove tobacco from within a cigar after the cigar has been made, and wherein the tobacco removing portion comprises one or more structures that extend outward and away from the elongate shaft.

21. A method for altering the draw of a cigar, the method comprising:

inserting a cigar airflow adjustment instrument into the cigar, the cigar airflow adjustment instrument comprising an elongate shaft and a working portion, the working portion configured to be inserted into the cigar after the cigar has been made to catch or pull tobacco within the cigar, and wherein the working portion comprises a body and one or more structures that extend outward and away from the body;

using the cigar airflow adjustment instrument inside the cigar, wherein the using comprises moving the working portion within the cigar in at least one of a pushing, pulling, and rotating action, wherein the using step effects at least one of tobacco dislodgement and tobacco repositioning; and removing tobacco from within the cigar.

22. A method for altering the draw of a cigar, the method comprising:

inserting a cigar airflow adjustment instrument into the cigar, the cigar airflow adjustment instrument comprising an elongate shaft and a tobacco removing portion configured to remove tobacco from within the cigar after the cigar has been made, and wherein the tobacco removing portion comprises one or more structures that extend outward and away from the elongate shaft;

moving the tobacco removing portion within the cigar in one or more of a pushing, pulling, and rotating action, wherein the moving step effects tobacco dislodgement or tobacco repositioning; and removing tobacco from within the cigar.

* * * * *